US008905658B2

(12) United States Patent
Yamaguchi

(10) Patent No.: US 8,905,658 B2
(45) Date of Patent: Dec. 9, 2014

(54) TAPE PRINTING APPARATUS AND TAPE CASSETTE

(75) Inventor: Koshiro Yamaguchi, Kakamigahara (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 620 days.

(21) Appl. No.: 12/792,280

(22) Filed: Jun. 2, 2010

(65) Prior Publication Data

US 2010/0239348 A1 Sep. 23, 2010

Related U.S. Application Data

(63) Continuation-in-part of application No. PCT/JP2008/073186, filed on Dec. 19, 2008.

(30) Foreign Application Priority Data

Dec. 27, 2007 (JP) ..... 2007-336816
Dec. 27, 2007 (JP) ..... 2007-337049
Dec. 27, 2007 (JP) ..... 2007-337295

(51) Int. Cl.

| | |
|---|---|
| ***B41J 11/00*** | (2006.01) |
| ***B41J 11/44*** | (2006.01) |
| ***B41J 3/407*** | (2006.01) |
| ***B41J 11/70*** | (2006.01) |
| ***B41J 15/04*** | (2006.01) |

(52) U.S. Cl.

CPC ..... *B41J 3/4075* (2013.01); *B41J 11/0095* (2013.01); *B41J 11/703* (2013.01); *B41J 15/044* (2013.01)

USPC ..... 400/76; 400/613; 400/621

(58) Field of Classification Search

USPC ..... 400/76, 613, 621

See application file for complete search history.

(56) References Cited

U.S. PATENT DOCUMENTS 4,712,113 A * 12/1987 Brooks et al. ..... 347/214
5,658,083 A 8/1997 Day et al.

(Continued)

FOREIGN PATENT DOCUMENTS

EP 0634275 1/1995
JP 7125736 5/1995

(Continued)

OTHER PUBLICATIONS

Japanese Office Action issued on Jun. 30, 2011 in Japanese Application No. 2008-323397.

(Continued)

*Primary Examiner* — Ren Yan
*Assistant Examiner* — Marissa Ferguson Samreth
(74) *Attorney, Agent, or Firm* — McCarter & English, LLP

(57) ABSTRACT

A tape cassette includes an ink ribbon having an ink layer formed thereon and a film tape having a transparent film with an adhesive layer formed on one side thereof. In the tape cassette, the adhesive layer and an ink layer contact at a printing position and the adhesive layer is heated by a thermal head, thereby exhibiting adhesiveness. Then, the ink layer and the adhesive layer are adhered and characters are printed on the film tape. In a tape printing apparatus, a cutter unit is arranged close to the downstream side from the thermal head in the conveying direction. Accordingly, the film tape is cut immediately after printing. The adhesive layer side of the film tape is adhered to an auxiliary sheet medium at the position of a feed roller. The film tape is cut by the second cutter arranged downstream of the feed roller in the conveying direction.

6 Claims, 55 Drawing Sheets

(56) References Cited

U.S. PATENT DOCUMENTS

| | | | |
|---|---|---|---|
| 5,826,995 | A | 10/1998 | Day et al. |
| 2009/0116893 | A1 | 5/2009 | Furuki et al. |

FOREIGN PATENT DOCUMENTS

| | | |
|---|---|---|
| JP | 2000006480 | 1/2000 |
| JP | 2005-247449 | 9/2005 |
| WO | 2007/013263 | 2/2007 |

OTHER PUBLICATIONS

European Search Report issued in Application No. 08868554.0 on Dec. 3, 2013.

* cited by examiner

TAPE PRINTING APPARATUS AND TAPE CASSETTE

CROSS-REFERENCE TO RELATED APPLICATION

The present application is a continuation-in-part application based upon and claims the benefit of the prior PCT International Patent Application No. PCT/JP2008/073186 filed on Dec. 19, 2008, the disclosure of which is herein incorporated by reference in its entirety.

TECHNICAL FIELD

The disclosure relates to a tape printing apparatus and a tape cassette which makes it possible to reduce an amount of consumed tape.

BACKGROUND

Various types of tape printing apparatuses have been conventionally proposed for producing a tape with characters printed thereon. Generally, a tape cassette to be used in a tape printing apparatus has a cassette case comprising a ribbon spool onto which an ink ribbon is wound, a film tape spool onto which a film tape serving as a printing medium is wound, and an adhesive tape spool onto which an adhesive tape is wound. In the above-described tape cassette, characters and the like are printed on the film tape using a thermal head provided in the tape printing apparatus, through the ink ribbon, while the ink ribbon and the film tape are being conveyed, to thereby produce a tape with characters printed thereon.

In general, to improve the scratch resistance of the characters and the like formed on the film after the printing operation in the tape printing apparatus, an adhesive tape is pasted on the character printed surface of the post-printing film tape by means of a pasting roller or the like, after which the tape is cut.

In another tape printer, an adhesive tape is pasted on the character printed surface to thereby protect the printed surface of the printing tape.

However, since the adhesive tape needs to be pasted on the character printed surface of the film tape after the characters and the like have been printed thereon, the adhesive tape spool onto which the adhesive tape is wound and the pasting roller must be accommodated in the tape cassette used in the conventional tape printing apparatus.

As a result, the size of the tape cassette becomes larger, thereby causing a problem that the overall size of the printing apparatus must inevitably be made larger to allow for installation of a cassette mounting unit. Further, since the pasting roller provided inside the tape cassette is configured so as to be arranged between the thermal head and the cutting mechanism provided in the tape printing apparatus, the thermal head is inevitably arranged far away from the cutting mechanism. As a result, a front blank space (blank space portion corresponding to the distance between a cutting position of the printing tape and the thermal head of the tape printing apparatus) of the produced printing tape becomes large. Therefore, it has been desired to narrow a blank space portion.

On the other hand, since the printing mechanism and the cutting mechanism are not arranged adjacent to each other, blank space portion of the front edge side of the produced printing tape becomes large in another tape printing apparatus as mentioned above. For using the printing tape economically, it has been desired to narrow such a blank space.

SUMMARY

The disclosure has been made in view of the above-described circumstances and has an object to provide a tape printing apparatus and a tape cassette which can reduce an amount of consuming a tape.

To achieve the purpose of the disclosure, there is provided a tape printing apparatus comprising: a print head that applies printing onto a printing tape; a first conveying roller that conveys the printing tape; a second conveying roller that conveys the printing tape with a release sheet adhered thereto; a first cutter that cuts the printing tape without the release sheet adhered thereto, the first cutter being arranged between the print head and the first conveying roller; a second cutter that cuts the printing tape with the release sheet adhered thereto, the second cutter being arranged downstream of the second conveying roller in a printing tape-conveying direction; a control device that controls respective operations of the first conveying roller, the second conveying roller, the first cutter and the second cutter, wherein the control device is configured to: operate the first conveying roller to thereby conduct printing and conveyance of the printing tape; operate, upon detecting that the printing tape has reached the second conveying roller, the second conveying roller to thereby convey the printing tape and the release sheet; and operate, upon detecting that a predetermined position of the printing tape has reached the first cutter, the first cutter to thereby cut the printing tape at the predetermined position.

According to another aspect of the disclosure, there is provided a tape printing apparatus comprising: a print head that applies printing onto a printing tape; a first conveying roller that conveys the printing tape; a second conveying roller that conveys the printing tape with an adhesive tape adhered thereto; a first cutter that cuts the printing tape without the adhesive tape adhered thereto, the first cutter being arranged between the print head and the first conveying roller; a second cutter that cuts the printing tape with the adhesive tape adhered thereto, the second cutter being arranged downstream of the second conveying roller in a printing tape-conveying direction; a control device that controls respective operations of the first conveying roller, the second conveying roller, the first cutter and the second cutter, wherein the control device is configured to: operate the first conveying roller to thereby conduct printing and conveyance of the printing tape; operate, upon detecting that the printing tape has reached the second conveying roller, the second conveying roller to thereby convey the printing tape and the adhesive tape; and operate, upon detecting that a predetermined position of the printing tape has reached the first cutter, the first cutter to thereby cut the printing tape at the predetermined position.

According to yet another aspect of the disclosure, there is provided a tape cassette comprising: a pair of conveying rollers; an adhesive tape; a cassette case that accommodates the pair of conveying rollers and the adhesive tape; and a tape discharge port arranged in the cassette case, wherein the tape cassette is detachable in a tape printing apparatus having a print head; wherein, while mounted in the tape printing apparatus, the pair of conveying rollers is configured to be positioned downstream of a first tape cutter in a printing tape-discharging direction, the first tape cutter being provided in the tape printing apparatus and configured to cut a printing tape that was printed by the tape printing apparatus, wherein the adhesive tape is conveyed by the pair of conveying rollers and adhered to a printed-surface side of the printing tape, while being mounted in the tape printing apparatus and wherein the printing tape with the adhesive tape adhered thereto is discharged from the tape discharge port.

BRIEF DESCRIPTION OF THE DRAWINGS

FIG. 40 an explanatory diagram showing a pattern of a transferring mechanism in which the ink layer is transferred to the adhesive layer upon being heated by the thermal head according to a fourth embodiment and the like;

DETAILED DESCRIPTION

A detailed description of exemplary embodiments of a tape cassette and a printing apparatus according to the disclosure will now be given referring to the accompanying drawings.

First Embodiment

A description will now be given of a tape cassette and a tape printing apparatus according to a first embodiment, based on FIG. 1 and FIG. 2.

Figure 1:
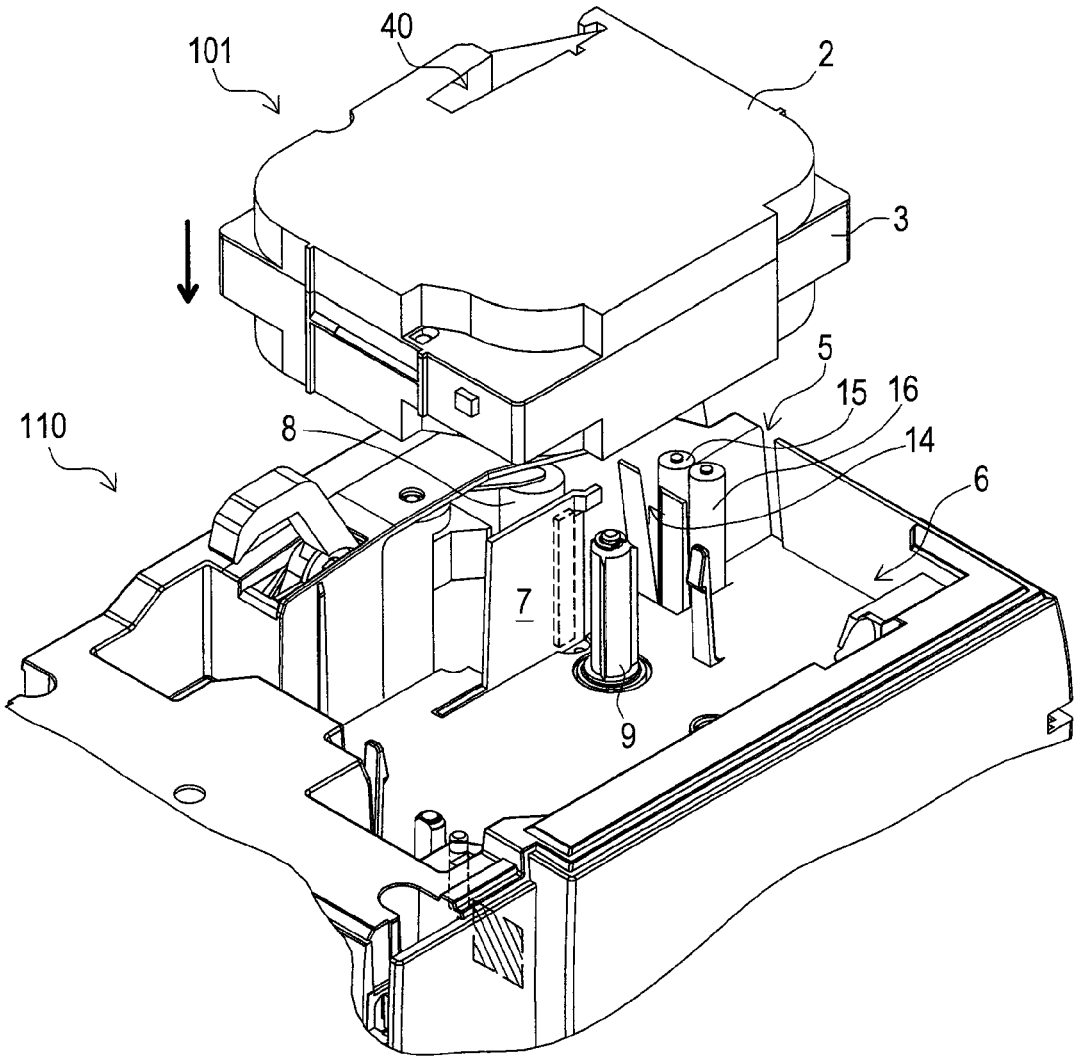
FIG. 1 is an enlarged perspective view of a relevant part showing mounting of a tape cassette in a cassette housing part of a tape printing apparatus according to a first embodiment.
Figure 2:
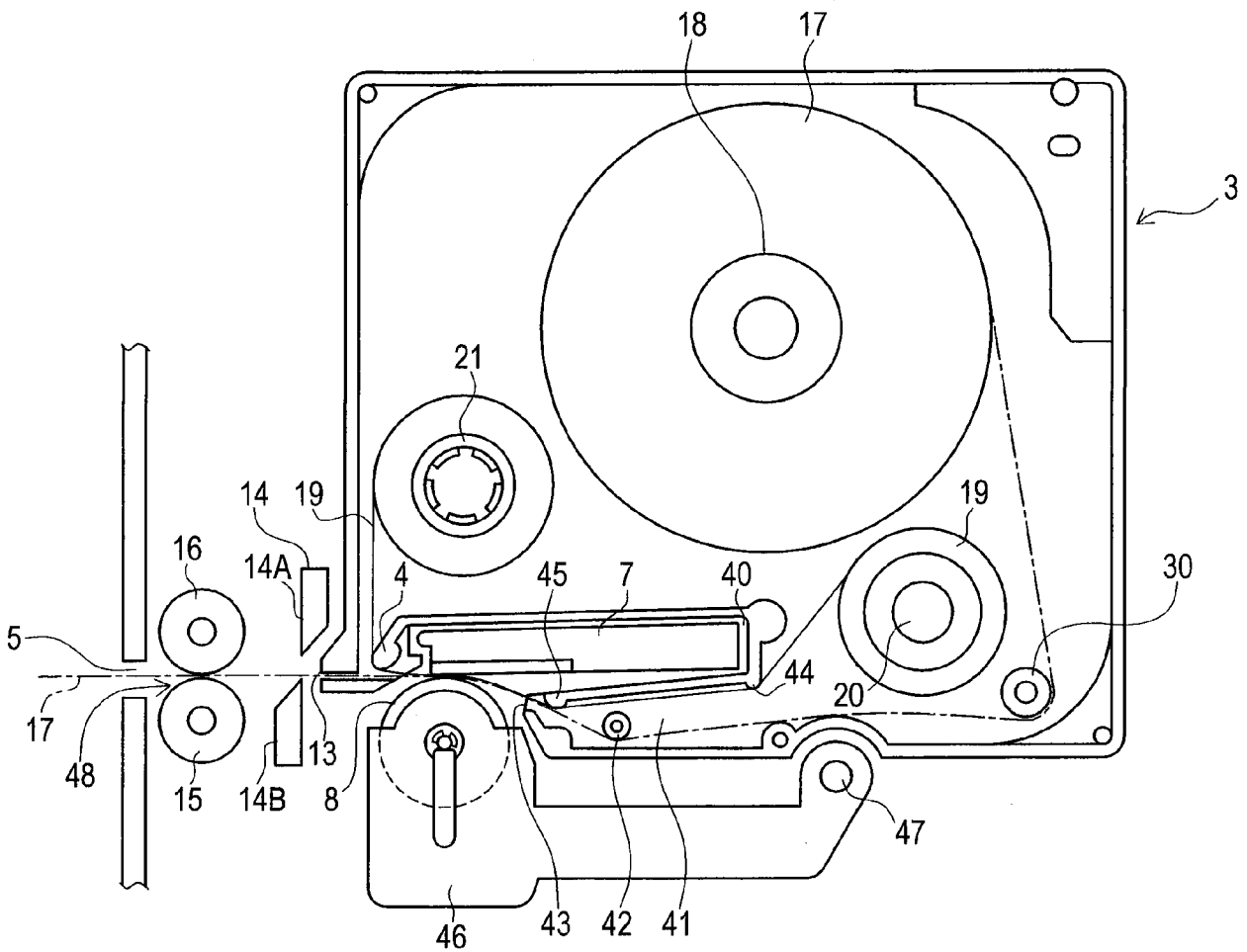
FIG. 2 is a plan view showing a pattern of an internal configuration of the tape cassette according to the first embodiment.

In FIG. 1, a tape cassette 101 is detachable in a cassette housing part 6 provided in a tape printing apparatus 110. The tape cassette 101 has an upper case 2 and a lower case 3. The upper case 2 serves as a lid member for covering an upper surface of the lower case 3. The lower case 3 has a tape spool 18 onto which a film tape 17 is wound arranged at a slightly upper position than a center part thereof, as shown in FIG. 2. The lower case 3 also has a ribbon spool 20 onto which an ink ribbon 19 is wound, and a ribbon take-up spool 21 that draws out the ink ribbon 19 from the ribbon spool 20 and takes up the ink ribbon 19 consumed in character printing, arranged at a lower right position of the tape spool 18.

The tape cassette 101 has a head insertion opening 40 formed so as to pass through the upper case 2 and the lower case 3. Upon loading the tape cassette 101 in the cassette housing part 6, a thermal head 7 to be described later is inserted in the head insertion opening 40. The head insertion opening 40 has a separating member 4 formed downstream (center left side in FIG. 2) of the thermal head 7. The separating member 4 has the role of reversing the feed direction of the ink ribbon 19 which is pressed onto the film tape 17 by being clamped between a platen roller 8 and a thermal head 7 and separating the ink ribbon 19 from the film tape 17, at the time of character printing using the thermal head 7, as will be described later.

The tape cassette 101 is formed with a discharge port 13 for discharging the film tape 17 onto which characters and the like have been printed to the exterior of the tape cassette 101, after the ink ribbon 19 has been separated from the film tape 17 by means of the separating member 4.

Next, a description will be given on the configuration of the tape housing part 6 in the tape printing apparatus 110. As shown in FIG. 1 and FIG. 2, the thermal head 7 is fixed in the cassette housing part 6 of the tape printing apparatus 110. The thermal head 7 is tabular with a rectangular shape in a longitudinal direction thereof, and has a predetermined number of heat generating elements formed at a left-hand margin at a front surface thereof, the heat generating elements being aligned along the above-described left-hand margin. The cassette housing part 6 has a platen holder 46 which is rotatably supported therein around a holder shaft 47. The platen holder 46 has a platen roller 8 rotatably supported therein. The platen holder 46 is biased in a counterclockwise direction around the holder shaft 47 by an elastic member which is not shown to be driven in a clockwise direction by a motor or the like at the time of printing onto the film tape 17. This enables the platen roller 8 to come in contact with or move away with respect to the thermal head 7.

The cassette housing part 6 has a ribbon take-up shaft 9 that is coupled to the ribbon take-up spool 21 of the tape cassette 101. The ribbon take-up shaft 9 is coupled to a driving mechanism such as a motor and the like which is not shown and is adapted to drive and rotate the ribbon take-up spool for taking up ink ribbon 19 which has been separated from the film tape 17 by means of the separating member 4, as described in the above text.

The cassette housing part 6 has a clipper-type cutter unit 14 arranged adjacent to the tape discharge port 13 of the tape cassette 101. The cutter unit 14 is composed of a fixed blade 14A and a movable blade 14B which is actuated with respect to the fixed blade 14A to cut the post-printing film tape 17.

A pair of conveying rollers 48 are arranged downstream of the cutter unit 14. The conveying rollers 48 are composed of a heat roller 15 that heats the adhesive layer (to be described later) formed in the film tape 17 and a tape feeding roller 16 arranged opposite to the heat roller 15 and adapted to feed the post-printing film tape 17 to the exterior of the tape printing apparatus 101 through the cooperation with the heat roller 15.

Upon loading the tape cassette 101 having the above-described configuration in the cassette housing part 6 of the tape printing apparatus 110 to thereby print characters and the like onto the film tape 17, the film tape 17 wound onto the tape spool 18 is guided from a tape guiding skid 30 provided at a corner of the lower case 3 over a guiding pin 42 formed in an arm part 41 at an inner wall of the lower case 3, and through an opening 43 of the arm part 41, towards the thermal head 7 and the platen roller 8. The ink ribbon 19 is guided through the opening 43 towards the thermal head 7 and the platen roller 8 while being regulated by regulating protruding parts 44 and 45 of the arm part 41.

The film tape 17 and the ink ribbon 19 guided as described in the above text are superimposed between the thermal head 7 and the platen roller 8. Each of the heat generating elements of the thermal head 7 is driven to generate heat, with the film tape 17 being superimposed on the ink ribbon 19. As a result, characters and the like are printed onto the film tape 17 through the ink ribbon 19. Thereafter, the ink ribbon 19 is fed downstream the thermal head 7, and after being separated from the film tape 17 through the separating member 4, it is taken up by the ribbon take-up spool 21.

After characters and the like are printed onto the film tape through the ink ribbon 19 and the thermal head 7, and the ink ribbon 19 is separated therefrom through the separating member 4, the film tape 17 is discharged to the exterior of the tape cassette 101 from the tape discharging port 13 and is further discharged to the exterior of the tape printing apparatus 110 through the pair of conveying rollers 48. At this time, the adhesive layer of the film tape 17 is heated by the heat roller 15 of the pair of conveying rollers 48, thereby making the adhesive layer exhibit adhesive properties as will be described later.

Then, when the film tape 17 has reached a predetermined length, the cutter unit 14 is driven to cut the film tape 17 at a predetermined length through the cooperation of the fixed blade 14A and the movable blade 14B.

Figure 3:
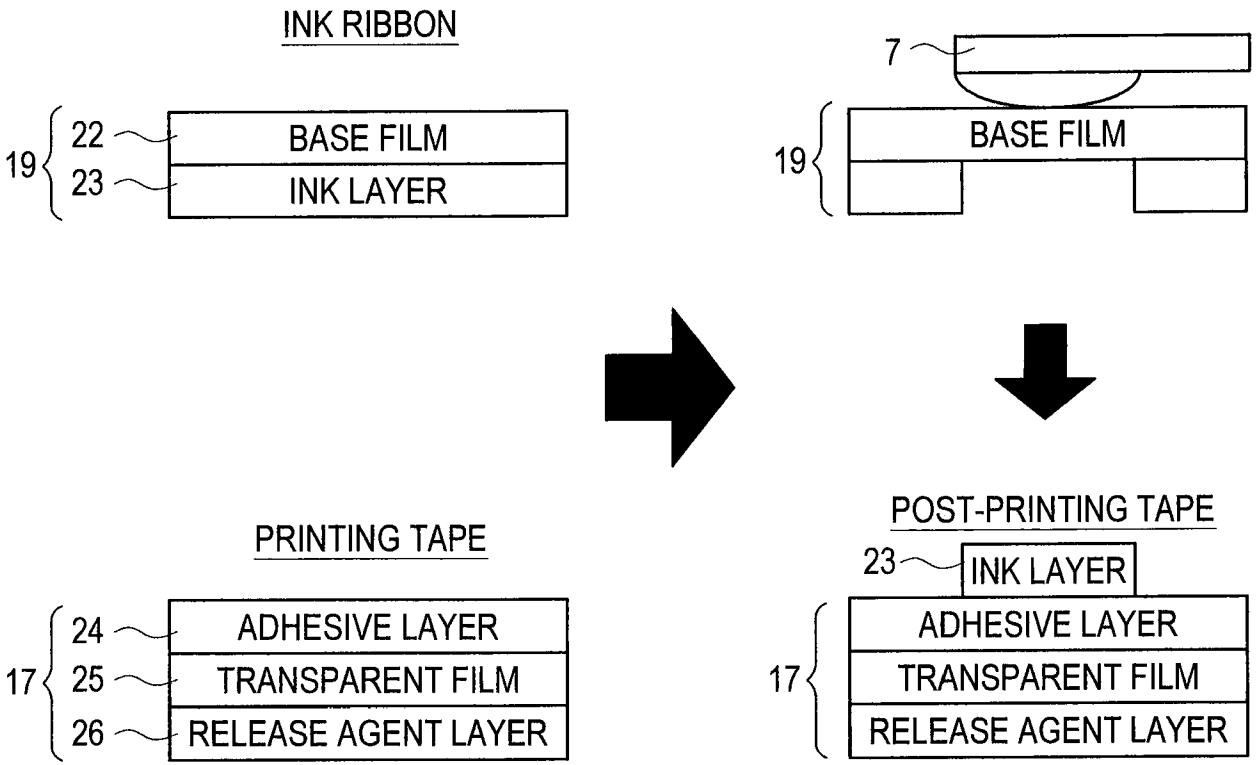
FIG. 3 is an explanatory diagram showing a pattern of the relationship between an ink ribbon and a film tape in a character printing process according to the first embodiment.

Next, the configuration of the ink ribbon and the printing tape according to the first embodiment will be described based on FIG. 3. As shown in FIG. 3, the ink ribbon 19 includes a base film 22 and an ink layer 23. The film tape 17 having the role of a printing tape has an adhesive layer 24 formed on one surface (upper side of the transparent film in FIG. 3) of a transparent film tape 25 and a release agent layer 26 formed on the other surface (lower side of the transparent film in FIG. 3) of the transparent film tape 25.

The above-described adhesive layer 24 includes a material having special properties in that it does not exhibit adhesive properties at ambient temperature, but starts exhibiting adhesive properties upon being heated, and maintains these adhesive properties after it has been heated once, even if its temperature decreases. This adhesive agent 24 may include an adhesive agent employed for heat seal labels, as described in JP Patent Num. 3394752, for instance. This type of adhesive agent melts upon being heated to 80° C. to 100° C. by the heat roller and the like, thereby exhibiting adhesive properties. In the first embodiment, the heat roller 15 heats the adhesive agent up to 80° C. or more but below 90° C.

The above-described film tape 17, having the adhesive layer 24 superimposed on one surface of the transparent film tape 25, is wound for loading in the tape spool 18 with the adhesive layer 24 at an inner side and the release agent layer 26 of the transparent film 25 at an outer side. Since the adhesive layer 24 is wound through the release agent layer 26, direct adherence of the adhesive layer 24 to the transparent film 25 can be avoided.

The film tape 17 drawn from the tape spool 18 is conveyed from the tape guiding skid 30 and the like up to a printing position found between the thermal head 7 and the platen roller 8 of the tape printing apparatus 10, as was described earlier. The film tape 17 is superimposed onto the ink ribbon 19 at the printing position, whereby the adhesive layer 24 of the film tape 17 comes in contact with the ink layer 23 of the ink ribbon 19.

When the adhesive layer 24 of the film tape 17 comes in contact with the ink layer 23 of the ink ribbon 19, the location at which the adhesive layer 24 and the ink layer 23 are in contact with each other is clamped between the thermal head 7 and the platen roller 8. As shown in FIG. 3, when the thermal head 7 is brought in contact with the other surface (back surface side of the ink layer 23) of the base film 22, the ink layer 23 of the ink ribbon 19 melts under the heat from the thermal head 7, thereby making the adhesive layer 24 exhibit adhesive properties. The melted ink layer 23 is adhered to the adhesive layer 24, whereby characters and the like are transferred to the film tape 17.

The tape printing apparatus 110 is provided with a drive control device (not shown) for driving and controlling the heat generating parts of the thermal head. Thus, since control is carried out so that the transferred ink layer 23 is printed as mirror image with respect to the film tape 17, characters and the like printed as normal image can be visually checked when looking from the side of the transparent film tape 25 of the film tape 17.

Figure 4:
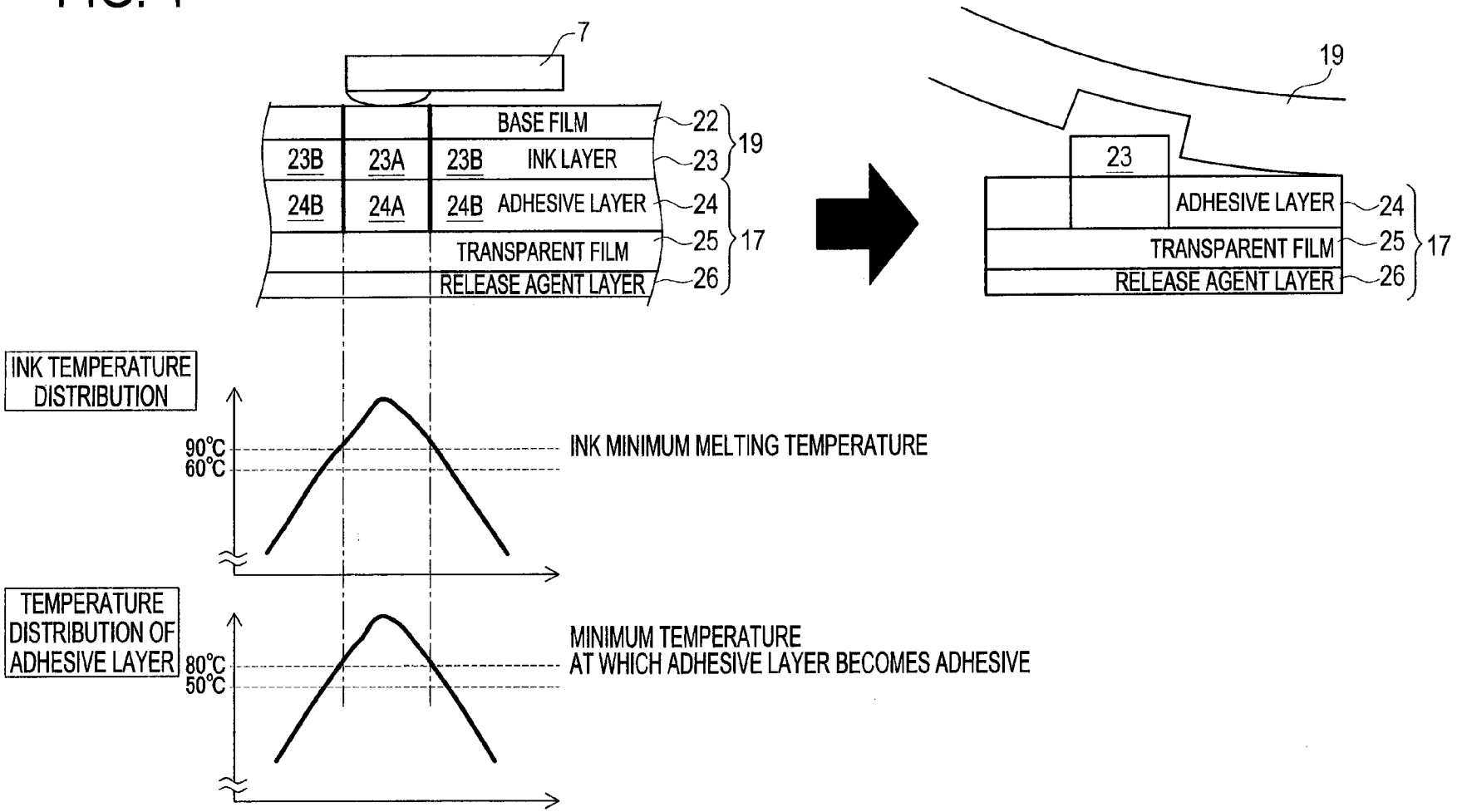
FIG. 4 is an explanatory diagram showing a pattern of a transfer mechanism in which an ink layer is transferred to an adhesive layer upon being heated by a thermal head according to the first embodiment.

Next, a transfer mechanism in which an ink layer is transferred to an adhesive layer upon being heated by a thermal head 7 will be described based on FIG. 4. As shown in FIG. 4, when the film tape 17 and the ink ribbon 19 are superimposed at a printing position between the thermal head 7 and the platen roller 8, the adhesive layer 24 of the film tape 17 is brought in contact with the ink layer 23 of the ink ribbon 19. Although the ink layer 23 and the adhesive layer 24 are simultaneously heated at the above described contact portion by the thermal head 7, heat transfer loss occurs at the boundary portion when heat is transferred from the ink layer 23 to the adhesive layer 24, which leads to differences in temperature at the boundary part of the adhesive layer 24 and the ink layer 23. Since the ink layer 23 of the ink ribbon 19 to be used in the tape cassette 101 according to the first embodiment employs a high melting point-type ink which melts at a temperature of 90° C. or above, and the adhesive layer 24 of the film tape 17 employs an adhesive agent that exhibits adhesive properties when heated to 80° C. or above, when the temperature at a heated portion of the ink layer 23A becomes 90° C. or above, the temperature at a heated portion of the adhesive layer 24A as well, becomes 80° C. or above, and as a result, the ink layer 23A and the adhesive layer 24A are adhered at their heated portions, respectively.

Since the temperature of the adhesive layer 24B when it is not heated by the thermal head 7 is below 80° C. and thus exhibits no adhesive properties, and the temperature of the ink layer 23B at a portion corresponding to the adhesive layer 24B, as well, is below 90° C., after these layers pass the thermal head 7 and the separating part 4 arranged downstream from the thermal head 7, they are heated and only the ink layer 23A which has been adhered to the adhesive layer 24A is transferred to the film tape 17, as shown in FIG. 4. The remaining portions of the ink ribbon are taken up by the ribbon take-up spool 21, as consumed ink ribbon 19.

As shown in FIG. 4, the thermal head 7 has a heat concentrated-type glaze structure. The ink layer 23 and the adhesive layer 24 are heated by focusing the heat into a pin-point. Accordingly, since the temperature difference between the heated portions of the ink layer 23A and the adhesive layer 24A and the unheated portions of the ink layer 23B and the adhesive layer 24B becomes large, the ink layer and the adhesive layer can be adhered, with the boundary between the heated portion 23A and the unheated portions 23B of the ink layer and the heated portion 24A and the unheated portions 24B of the adhesive layer 24A clearly defined.

The ink layer 23 includes a wax-type ink so that only the heated portions of the ink later 23 are transferred, even if they cool down after being heated. Accordingly, the heated ink layer 23 can be reliably adhered to the adhesive layer 24A at the heated portion even if the ink 23 cools down, thereby being reliably transferred to a film tape 17 onto which characters and the like are printed.

The film tape 17 onto which characters and the like are printed is drawn up to a clipper-type cutter unit 14 serving as a cutting device, through the cooperation of the tape feeding roller 16 and the heat roller 15 as described above. The post-printing film tape 17 can be cut to a predetermined length through the cooperation of the fixed blade 14A and the movable 14B of the cutter unit 14. The cut film tape 17 is passed between the tape feeding roller 16 and the heat roller 15 where it is heated by the heat roller to exhibit adhesive properties in the adhesive layer 24B at portions other than portions where the ink layer 23 is adhered. Thereafter, the post-printing film tape 17 which exhibits adhesive properties is discharged to the exterior of the tape printing apparatus 110, as a linerless tape as cut.

It is to be noted that drive controls of the above-described units are carried out by a not-shown processor (for instance, CPU) which is provided in the printing apparatus. For instance, the thermal head 7 operates based on a head driving circuit. The tape feed motor operates based on a motor driving circuit. The cutter unit operates based on a cutter driving circuit. The press contact release motor operates based on a press contact release motor driving circuit. These driving circuits operate based on the processor. This operating pattern is the same for the other embodiments to be described later.

As described in the above, since the tape cassette 101 does not house the adhesive tape spool and the pasting roller and the tape feeding roller 16 and the heat roller 15 are arranged downstream of the cutter unit 14, the post-printing film tape 17 can be cut by the cutter unit 14 arranged immediately downstream of the thermal head 7 right after characters and the like have been printed thereon. This makes it possible to shorten the front blank space of the post-printing film tape 17, thereby reducing the running cost of the film tape 17.

Further, since the heat roller 15 heats the target layers to 80° C. or above but below 90° C., but the ink to be used is a high melting point-type ink (the melting point of the ink is 90° C. or above), the heat roller 15 does not melt the ink that is adhered to the adhesive layer 24, thereby eliminating the risk of faulty printing caused by ink melting and the like.

Since the heat roller 15 is brought into contact with the tape film 17 from the side of the release agent layer 26 (the back surface side of the adhesive layer 24) of the post-printing film tape 17, direct contact between the heat roller 15 and the adhesive layer can be avoided, thereby preventing adherence of the heated adhesive layer 24 to the heat roller 15.

Since the heated adhesive layer 24 maintains its adhesive properties even after its temperature decreases, the linerless tape produced as described above is pasted onto the target body as is, through the adhesive layer 24. As a result, the user does not have to remove the release sheet, as was done in the case of using the conventional laminated tape. Further, since the characters and the like in the transferred ink layer 23 are printed as mirror image with respect to the film tape 17, the user can recognize the characters printed as normal image, through the transparent film. Here, the release adhesive layer is also transparent. Needless to say, the adhesive layer present between the film layer and the ink layer is necessarily transparent or semi-transparent, to thus make the ink layer visible through the transparent film.

It is to be noted that the outer shape of the tape printing apparatus 110, the tape cassette 101 as shown in the description of the first embodiment are given as merely one example, and the one or more aspects of the disclosure is not limited to this outer shape.

Second Embodiment

Next, a tape cassette and a tape printing apparatus according to a second embodiment will be described based on FIG. 5 and FIG. 6.

The configuration of the tape cassette 101 according to the second embodiment is the same as the configuration of the tape cassette 101 according to the first embodiment. Also, the configuration of the tape printing apparatus 210 according to the second embodiment is substantially the same as the configuration of the tape printing apparatus 110 according to the first embodiment. In the following description, elements which are the same as those of the tape cassette 101 and the tape printing apparatus 110 according to the first embodiment are denoted by the same numerical symbols.

In the tape printing apparatus 110 according to the first embodiment, the tape conveying roller 16 is arranged in the tape printing apparatus 110. However, in the second embodiment, a conveying roller 77 having the same function as the tape conveying roller 16 in the first embodiment is provided in an auxiliary cassette 70. The tape printing apparatus 210 is not provided with a roller for conveying a tape. In the second embodiment, the tape printing apparatus 210 is provided with a conveying roller shaft 72 coupled with the conveying roller 77 and an auxiliary sheet medium take-up shaft 73 coupled with an auxiliary sheet medium take-up spool 76.

Figure 5:
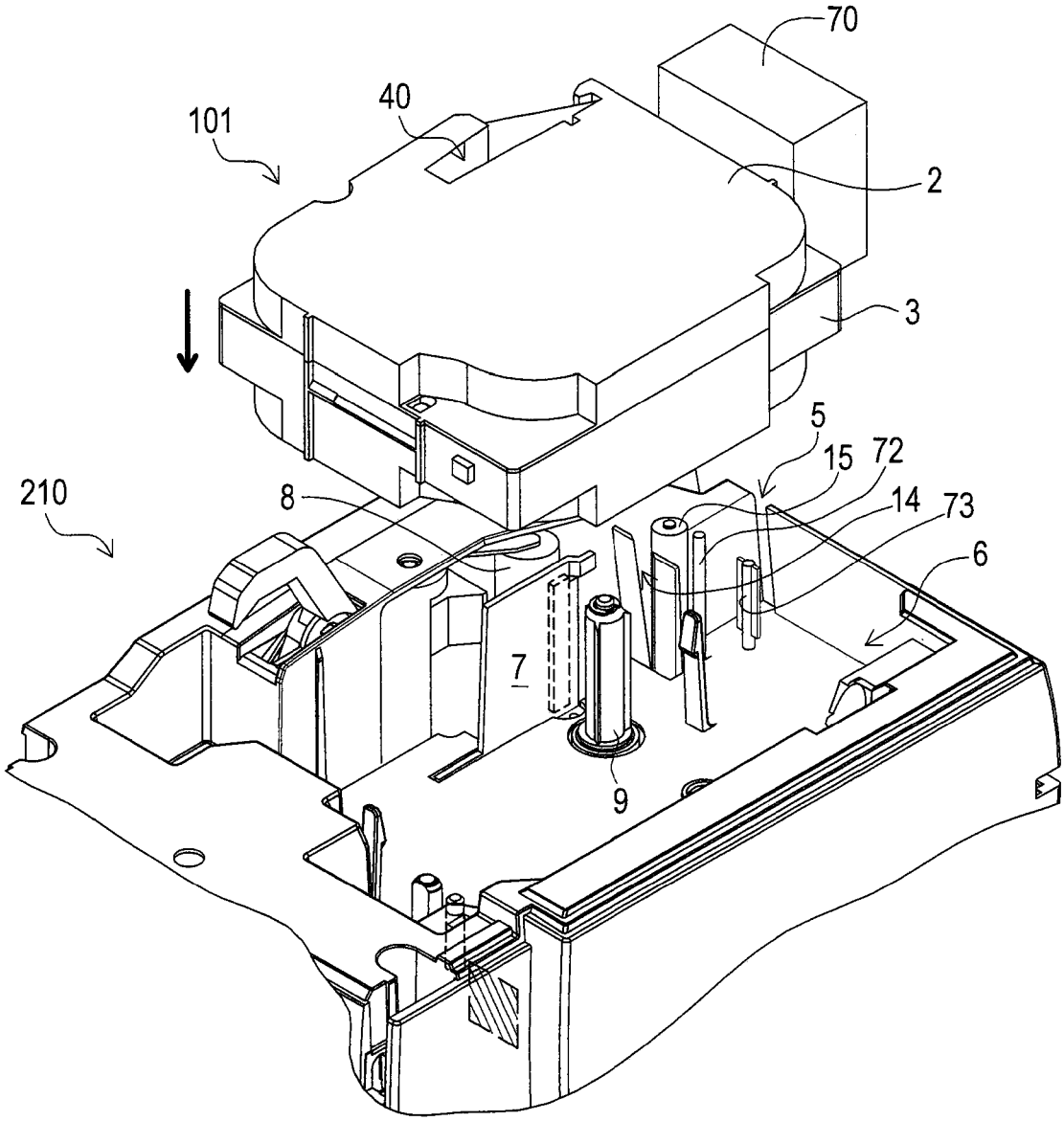
FIG. 5 is an enlarged perspective view of a relevant part showing mounting of a tape cassette and an auxiliary cassette in a cassette housing part of a tape printing apparatus according to a second embodiment.
Figure 6:
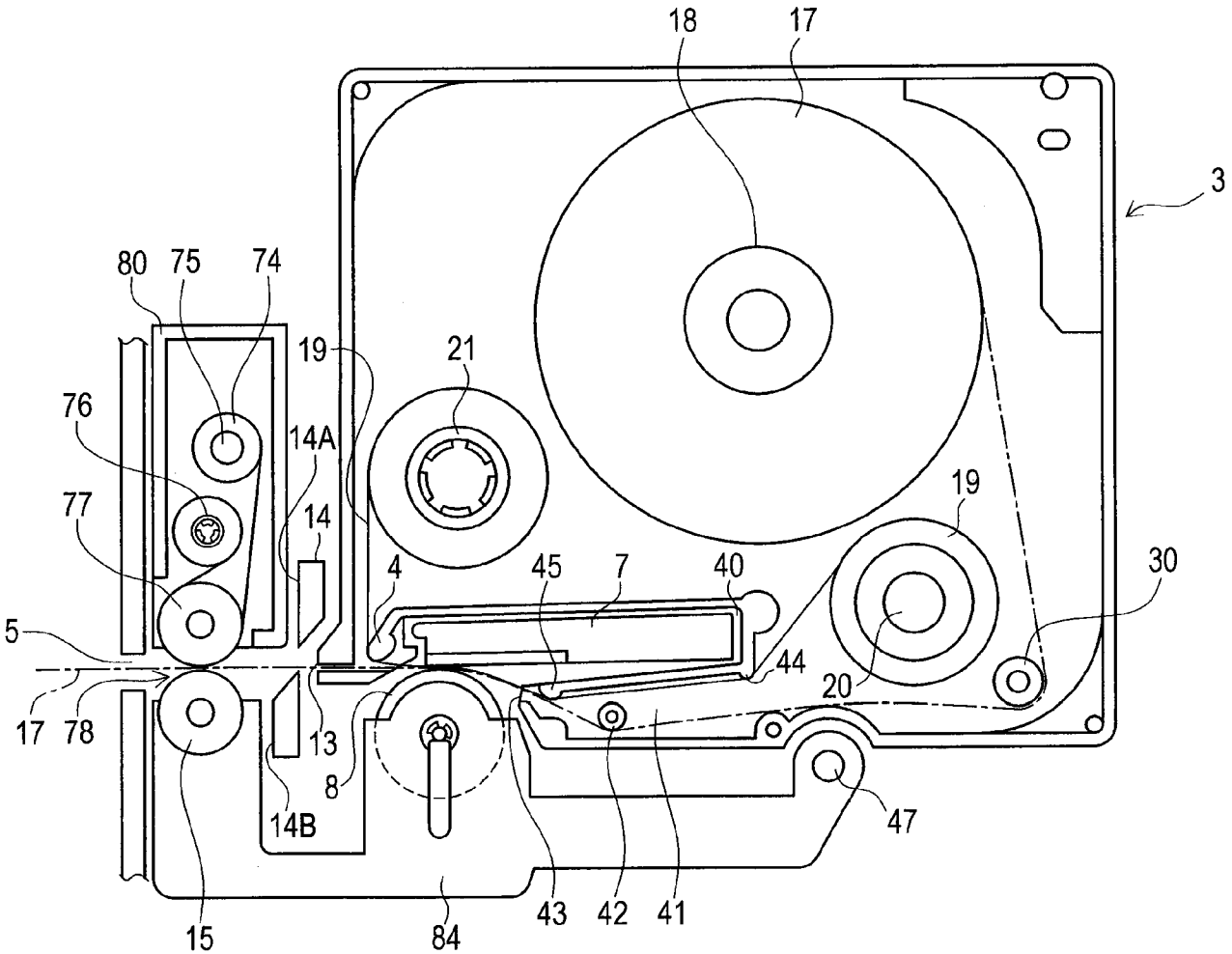
FIG. 6 is a plan view showing a pattern of an internal configuration of the tape cassette and the auxiliary cassette according to the second embodiment.

In FIG. 5, the tape cassette 101 is detachable in the cassette housing part 6 provided in the tape printing apparatus 210. The tape cassette 101 of the second embodiment has the same configuration as the tape cassette 101 of the first embodiment, and further description thereof is hereby omitted.

Also, in FIG. 5, the auxiliary cassette 70 is detachable in the cassette housing part 6 provided in the tape printing apparatus 210. The auxiliary cassette 70 is provided with an auxiliary sheet medium spool 75 onto which an auxiliary sheet medium 74 is wound, as shown in FIG. 6. The auxiliary cassette 70 is also provided with an auxiliary sheet medium take-up spool 76 that draws and takes up the auxiliary sheet medium 74 from the auxiliary sheet medium spool 75.

The outer shape of the auxiliary cassette 70 is defined by the cassette case 80. In other words, the auxiliary cassette 70 is configured so that the auxiliary sheet medium 74 and the feed roller are accommodated inside the cassette case 80.

Further, the feed roller 77 is rotatably mounted on the auxiliary cassette 70, with one portion thereof being exposed from the auxiliary cassette 70. In other words, the cassette case 80 has an opening defined therein. At the time of printing, the feed roller 77 faces the heat roller 15 provided in the tape printing apparatus 210. Specifically, the feed roller 77 and the heat roller 15 can be brought into contact with each other by pressing against each other.

At the time of printing, the auxiliary sheet medium 74 is fed to the conveying roller 77, and is further fed in a downstream direction together with the post-printing film tape 17. Thereafter, the auxiliary sheet medium 74 is fed to the auxiliary sheet medium take-up spool 76. In other words, since the film tape 17 and the auxiliary sheet medium 74 come into contact with each other at the time of printing, the conveying roller 77 and the film tape 17 are out of touch with each other. This contact position is the position where the heat roller 15 and the conveying roller 77 face each other, as shown in FIG. 6.

Next, a description will be given on the configuration of the tape housing part 6 in the tape printing apparatus 210. As shown in FIG. 5 and FIG. 6, a thermal head 7 is fixed in the cassette housing part 6 of the tape printing apparatus 210. The thermal head 7 is tabular with a substantially rectangular shape in a longitudinal direction thereof when viewed from the front and, as shown in FIG. 6, has a predetermined number of heat generating elements formed on a left margin at a front surface thereof, and aligned along the left margin. The cassette housing part 6 has a holder 84 that is rotatably supported around the holder shaft 47. In turn, the holder 84 has a platen roller 8 rotatably supported therein. The holder 84 is biased in a counterclockwise direction around the holder shaft 47 by an elastic member not shown, and at the time of printing onto the film tape 17, it is driven in a clockwise direction by a motor or the like. This allows the platen roller to come into contact and move away with respect to the thermal head 7. The holder 84 also has a heat roller 15 which is rotatably supported therein. As was described in the above, the holder 84 is biased in a counterclockwise direction around the holder shaft 47 by an elastic member which is not shown, and at the time of printing onto the film tape 17, it is driven in a clockwise direction by a motor or the like, thereby allowing the heat roller 15 to come into contact or move away with respect to the conveying roller 77.

As described above, the cassette housing part 6 is provided with an auxiliary sheet medium take-up shaft 73 that is coupled to the auxiliary sheet medium take-up spool 76 of the auxiliary cassette 70. The auxiliary sheet medium take-up shaft 73 is coupled to a driving mechanism such as a motor or the like, not shown, and serves to drive and rotate the auxiliary sheet medium take-up spool 76. The cassette housing part 6 is also provided with a conveying roller shaft 72. The conveying roller shaft 72 is coupled to a driving mechanism such as a motor and the like, not shown, and serves to drive and rotate the conveying roller 77.

A heat roller 15 for heating the adhesive layer (to be described later) formed in the film tape 17 is provided downstream of the cutter unit 14. The post-printing film tape 17 is discharged to the exterior of the tape printing apparatus 210 through the cooperation of the heat roller 15 and the conveying roller 77. For convenience of the description to follow, the pair including the heat roller 15 and the conveying roller 77 may be denoted as the pair of conveying rollers 78. The auxiliary sheet medium take-up spool 76 as well is driven and rotated to thus convey the auxiliary sheet medium, together with the post-printing film tape 17, through the cooperation of the heat roller 15 and the conveying roller 77.

After characters and the like are printed through the ink ribbon 19 and the thermal head 7 and simultaneously, the ink ribbon 19 is separated therefrom by the separating member 4, the film tape 17 is discharged from the tape discharge port 13 to the exterior of the tape cassette 1, and further discharged to the exterior of the tape printing apparatus 210 through the pair of conveying rollers 78. At this time, the adhesive layer of the film tape 17 is heated by the heat roller 15 of the pair of conveying rollers 78, and as a result, the adhesive layer exhibits adhesive properties.

Since the ink ribbon and the printing tape according to the second embodiment have the same configuration as that described in the first embodiment (refer to FIG. 2), further description thereof is hereby omitted. Also, since the transfer mechanism in which the ink layer is transferred to the adhesive layer upon being heated by the thermal head 7, according to the second embodiment is the same as the mechanism in the above-described first embodiment (refer to FIG. 3 and FIG. 4), further description thereof is hereby omitted.

The film tape 17 onto which characters and the like have been printed is drawn up to the clipper-type cutter unit 14 serving as a cutting device, through the cooperation of the tape conveying roller 16 and the heat roller 15, as described above. The post-printing film tape 17 can thus be cut to a predetermined length through the cooperation of the fixed blade 14A and the movable blade 14B of the cutter unit 14. The cut film tape 17 is passed between the tape conveying roller 16 and the heat roller 15, and upon being heated by the heat roller 15, starts exhibiting adhesive properties in the adhesive layer 24B at portions other than portions where the ink layer 23 has been adhered. Then, the post-printing film tape 17 exhibiting adhesive properties is discharged to the exterior of the tape printing apparatus 210, as a linerless tape as was cut.

As described above, the adhesive agent of the post-printing film tape 17 exhibits adhesive properties upon being heated by the heat roller 15. Here, if the adhesive force of the post-printing film tape 17 is strong, there is a risk that the adhesive agent will be transferred to the surface coming in contact with the adhesive layer. In the second embodiment, the auxiliary sheet medium 74 and the adhesive surface of the printing tape are configured so as to come into contact. Unused (namely, clean) portions of auxiliary sheet medium 74 that come into contact with the adhesive surface are continuously fed to the pair of conveying rollers 78 by the auxiliary sheet medium take-up spool 76. In this way, the adhesive agent of the post-printing film tape 17 does not adhere to the conveying roller 77. Even if the adhesive agent of the post-printing film tape 17 adheres to the auxiliary sheet medium 74, since the auxiliary sheet medium 74 is fed to the auxiliary sheet medium take-up spool 76, the auxiliary sheet medium 74 onto which the adhesive agent is pasted cannot adhere to the post-printing film tape 17 that is to be subsequently fed.

Thus, since the tape cassette 101 does not accommodate an adhesive tape spool and a pasting roller and the pair of conveying rollers 78 are arranged downstream of the cutter unit 14, the post-printing film tape 17 can be cut immediately after characters and the like have been printed thereon by the cutter unit 14 which is arranged immediately downstream of the thermal head 14. This makes it possible to shorten the front blank space of the post-printing film tape 17, thereby reducing the running cost of the film tape 17.

The heat roller 15 heats the target layers to 80° C. or above but below 90° C., but since the ink to be used is a high melting point-type ink, (melting point of the ink is 90° C. or above), the ink which is adhered to the adhesive layer 24 is not melted by the heat roller, thereby eliminating the risk of faulty printing caused by ink melting or the like.

Since the heat roller 15 is brought into contact with the tape film 17 from the side of the release agent layer 26 (the back surface side of the adhesive layer 24) of the post-printing film tape 17, direct contact between the heat roller 15 and the adhesive layer can be avoided, thereby preventing adherence of the heated adhesive layer 24 to the heat roller 15.

Since the heated adhesive layer 24 maintains its adhesive properties even after its temperature decreases, the linerless tape produced as described above is pasted onto the target body as is, through the adhesive layer 24. As a result, the user does not have to remove the release sheet, as was done in the case of using the conventional laminated tape. Further, since the characters and the like in the transferred ink layer 23 are printed as mirror image with respect to the film tape 17, the user can recognize the characters printed as normal image, through the transparent film. Here, the release agent layer is also transparent. Needless to say, the adhesive layer present between the film layer and the ink layer is necessarily transparent or semi-transparent, to thus make the ink layer visible through the transparent film.

In the second embodiment, since the adhesive layer of the post-printing film tape 17 does not come into contact with the conveying roller 77 when the post-printing film tape 17 is heated, the adhesive agent does not adhere to the conveying roller 77, thereby making it possible to prevent faulty conveyance from occurring. Also, even if the adhesive agent adheres to the auxiliary sheet medium 74, it is possible to prevent the adhesive agent that adhered from smearing on the post-printing film tape 17 which is subsequently fed.

Further, the auxiliary sheet medium 74 can include a medium having a release agent layer coated onto a surface thereof that comes into contact with the post-printing film tape 17. As a result, the auxiliary sheet medium 74 and the heated post-printing film 17 can be smoothly peeled, thereby allowing excellent tape conveyance.

Figure 7:
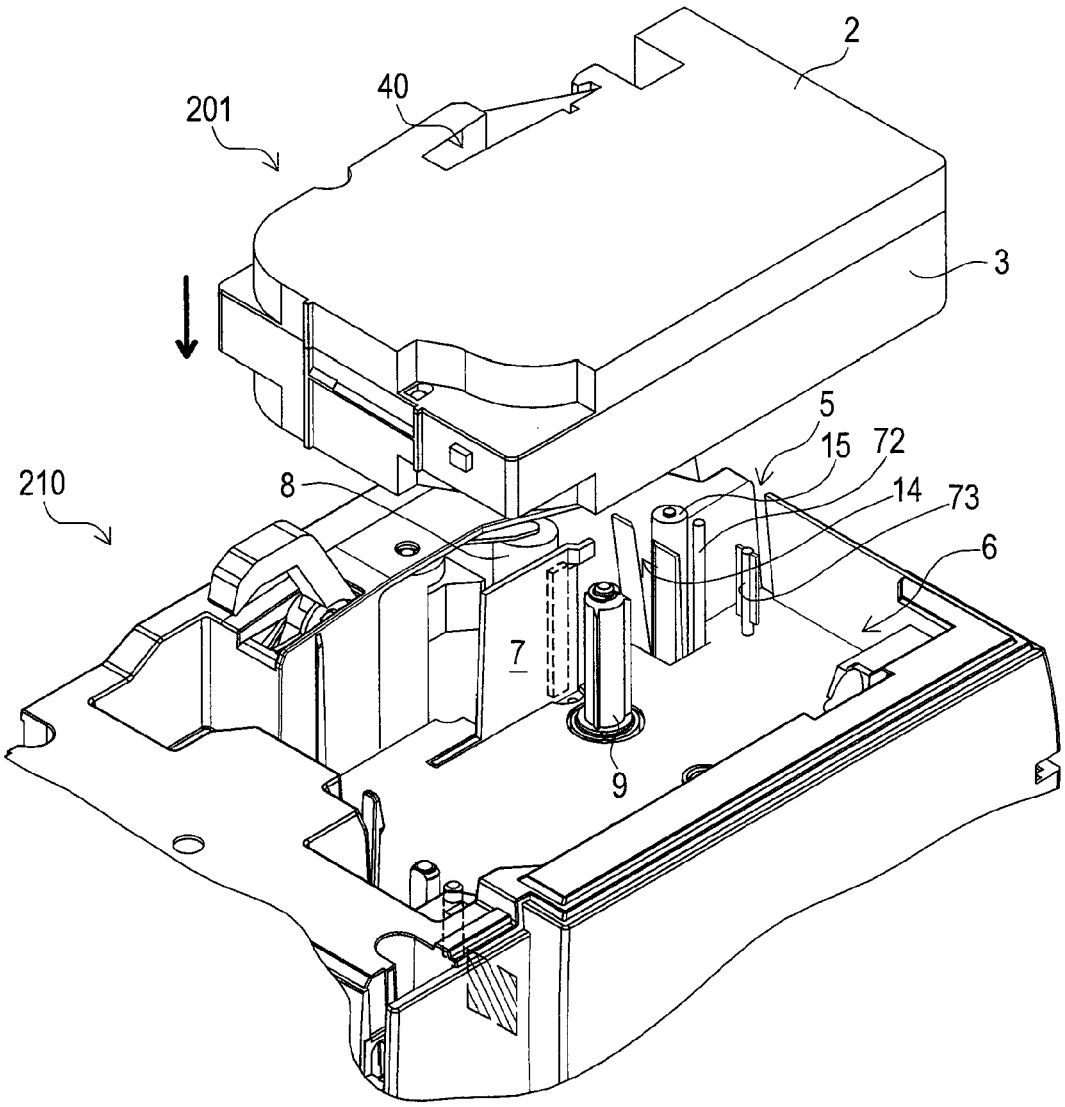
FIG. 7 is an enlarged perspective view of a relevant part showing mounting of the tape cassette in the cassette housing part of the tape printing apparatus according to the second embodiment.

In the second embodiment, the tape cassette 101 and the auxiliary cassette 70 are configured separately, but the tape cassette and the auxiliary cassette can also be integrally configured, as shown in FIG. 7.

Figure 8:
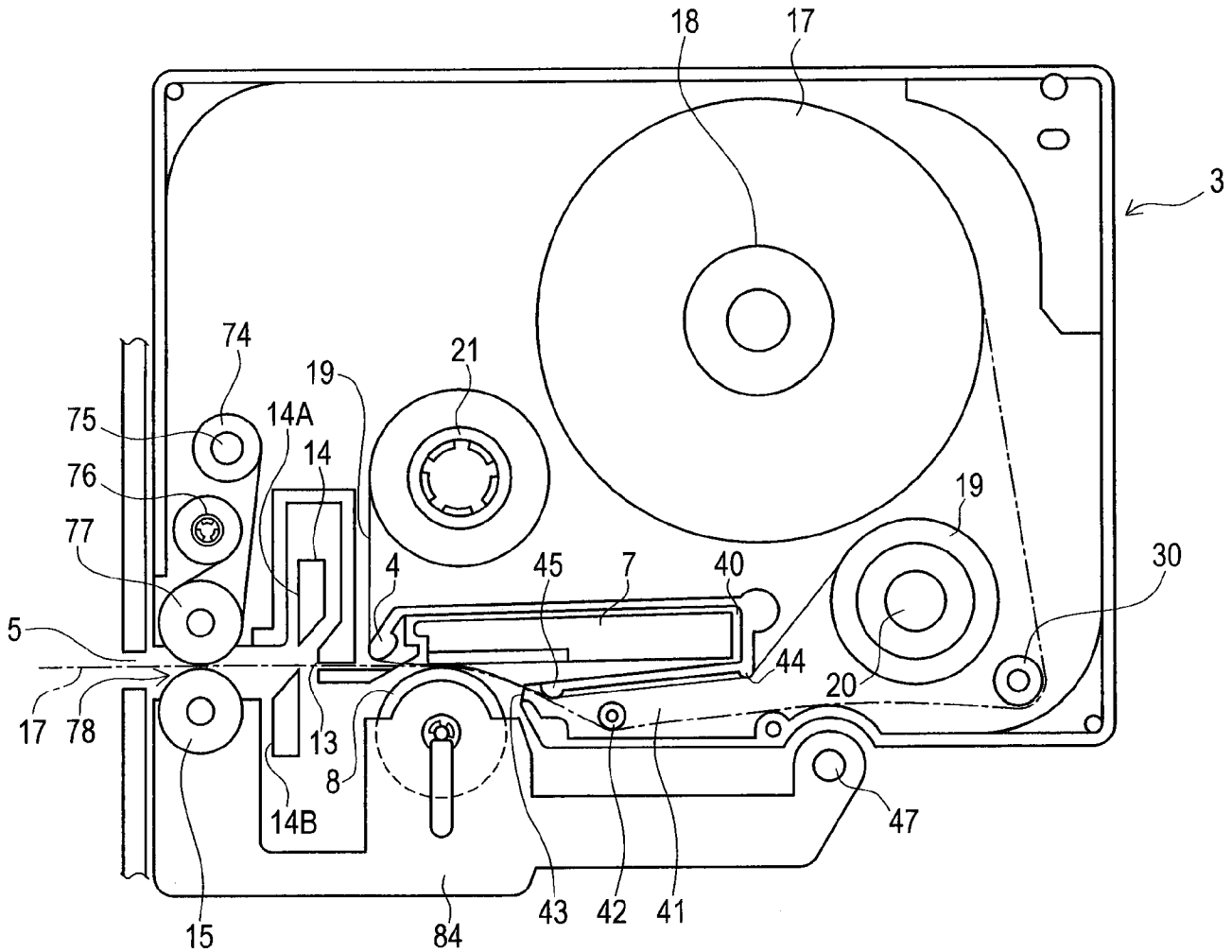
FIG. 8 is a plan view showing a pattern of an internal configuration of the tape cassette according to the second embodiment.

In this case, the tape cassette 201 is provided with the auxiliary sheet medium 74, the auxiliary sheet medium take-up spool 76, the conveying roller 77, the film tape 17, the ink ribbon 19 and the like, as shown in FIG. 8. The tape cassette 201 has a cut-out portion, as shown in FIG. 8. If this cut-out portion is present between the conveying roller 77 and the tape discharge port 13. When the tape cassette 201 is mounted on the tape printing apparatus 210, the fixed blade 14A of the tape printing apparatus 210 is positioned in this cut-out portion. In the tape printing apparatus 201 using the tape cassette 201, as well, since the adhesive layer of the post-printing film tape 17 does not come into contact with the conveying roller 77 when the post-printing film tape 17 is heated, the adhesive agent does not adhere to the conveying roller 77, thereby making it possible to prevent faulty conveyance. Thus, even if the adhesive agent adheres to the auxiliary sheet medium 74, it is possible to prevent the adhesive agent that adhered to the auxiliary sheet medium from smearing on the post-printing film tape 17 that is subsequently fed.

The outer shape of the tape printing apparatus 210, the tape cassette 101, the tape cassette 201, and the auxiliary cassette 70 as shown in the description of the second embodiment are given as merely one example, and the one or more aspects of the disclosure is not limited to this outer shape.

Third Embodiment

In the second embodiment described above, the auxiliary sheet medium is rewound onto the auxiliary sheet medium take-up spool as the printed film tape is conveyed. As a result, it is no longer necessary to peel off the auxiliary sheet medium at the time of adhering the printed film tape to the target body.

At the same time, however, the adhesive layer of the film tape is not protected. This makes it difficult to store the film tape formed in the manner described above, for a long period of time without being adhered to the target body.

The third embodiment that will be described next has been worked out to solve these problems.

Figure 9:
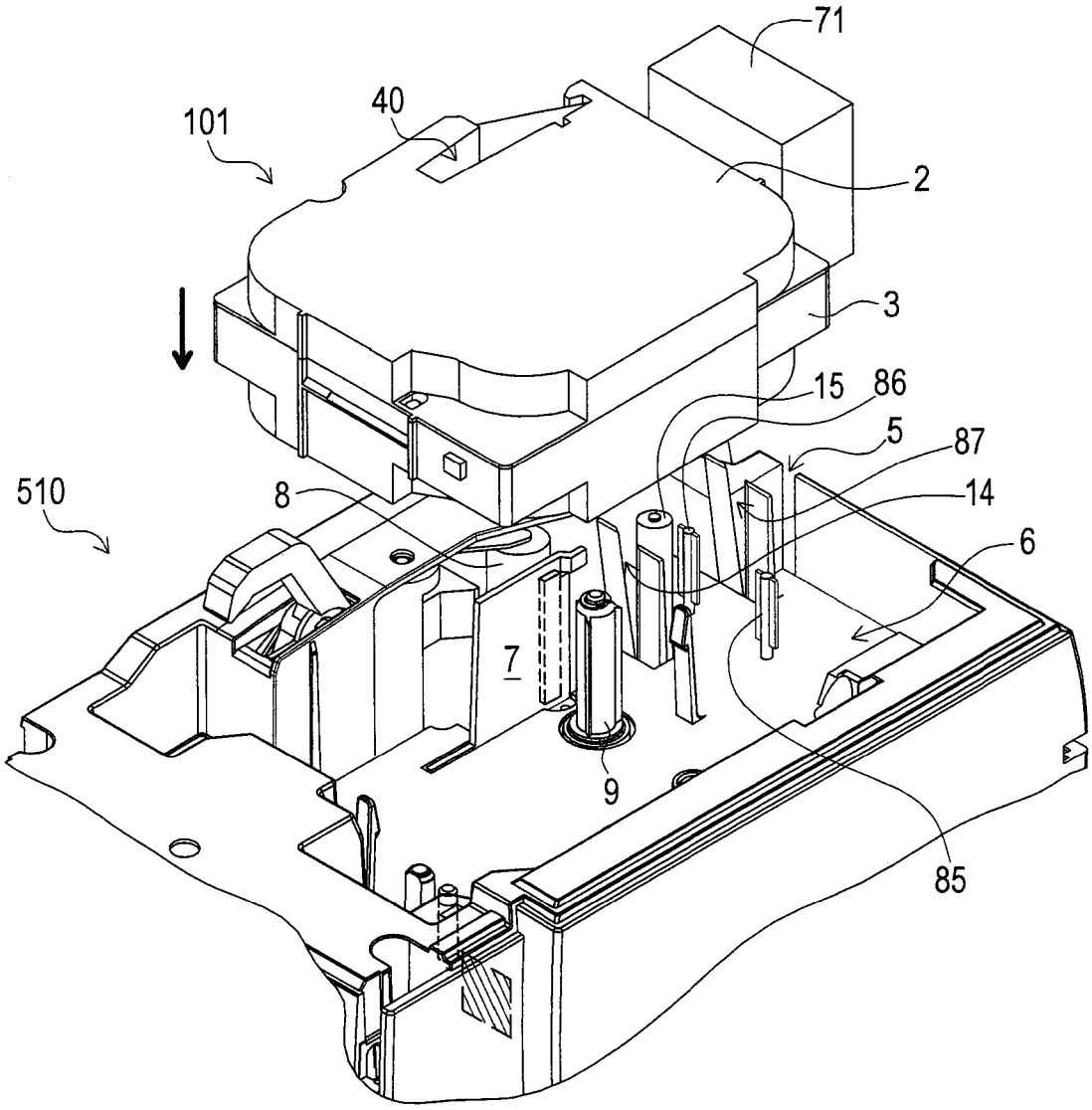
FIG. 9 is an enlarged perspective view of a relevant part showing mounting of a tape cassette in a cassette housing part of a tape printing apparatus according to a third embodiment.
Figure 10:
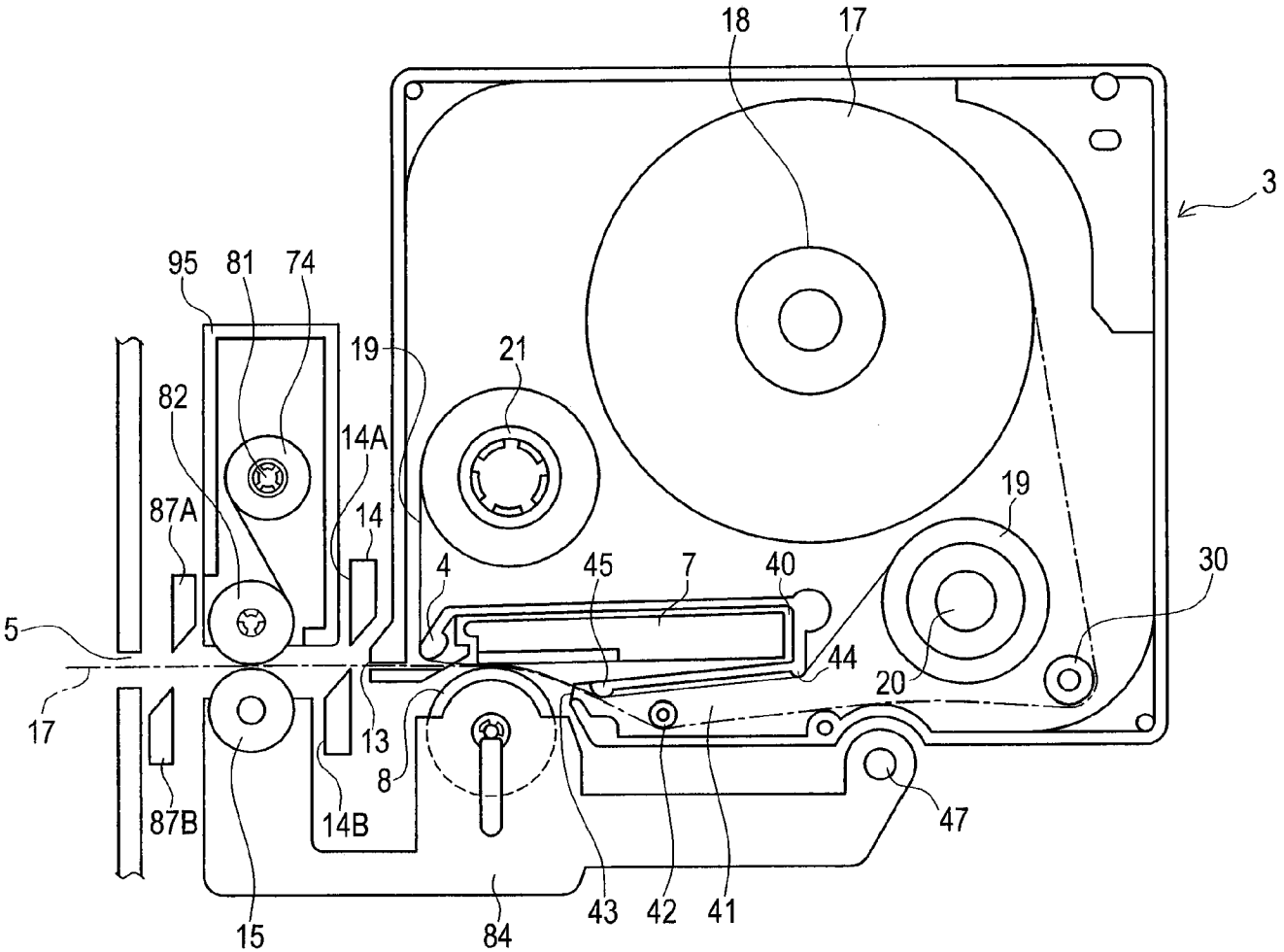
FIG. 10 is a plan view showing a pattern of an internal configuration of the tape cassette according to the third embodiment.

A tape cassette, auxiliary cassette, and tape printing apparatus according to the third embodiment will next be described based on FIG. 9 and FIG. 10.

The configuration of the tape cassette 101 according to the third embodiment is the same as the configuration of the tape cassette 101 according to the second embodiment.

Also, the configuration of the tape printing apparatus 510 according to the third embodiment is substantially the same as the configuration of the tape printing apparatus 210 according to the second embodiment.

Also, the configuration of the auxiliary cassette 71 according to the third embodiment is substantially the same as the configuration of the auxiliary cassette 70 according to the second embodiment.

In the following description, elements which are the same as those of the tape cassette 101, the tape printing apparatus 210, and the auxiliary cassette 70 according to the second embodiment are denoted by the same numerical symbols.

(Auxiliary Cassette)

First, an auxiliary cassette 71 according to the present embodiment will now be described. The auxiliary cassette 71 is detachable in a cassette housing unit 6 provided in a tape printing apparatus 510.

An auxiliary sheet medium spool 81 and a feed roller 82 are mounted on the auxiliary cassette 71. An auxiliary sheet medium 74 is wound onto the auxiliary sheet medium spool 81.

The outer shape of the auxiliary cassette 71 is defined by a cassette case 95. Specifically, the auxiliary cassette 71 is configured so that the auxiliary sheet medium 74 and the feed roller 82 are accommodated inside the cassette case 95.

The feed roller 82 is rotatably mounted on the auxiliary cassette 71. A portion of the feed roller 82 is exposed from the auxiliary cassette 71. Specifically, the cassette case 95 has an opening defined therein. Also, the auxiliary cassette 71 is mounted on the cassette housing unit 6 at a location so as to face a heat roller 15. Specifically, the feed roller 82 and the heat roller 15 can be brought into contact with each other by pressing against each other.

(Tape Printing Apparatus)

Next, the tape printing apparatus 510 according to the present embodiment will be described. An auxiliary sheet medium rewind shaft 85 and a feed roller shaft 86 are mounted on the cassette housing unit 6. If the auxiliary cassette 71 is mounted on the cassette housing unit 6, the auxiliary sheet medium rewind shaft 85 is coupled to the auxiliary sheet medium spool 81. The auxiliary sheet medium rewind shaft 85 is rotated by a driving mechanism not shown here. When the auxiliary sheet medium rewind shaft 85 is rotated, the auxiliary sheet medium 74 is rewound in an opposite direction with the conveying direction at the time of printing.

If the auxiliary cassette 71 is mounted on the cassette housing unit 6, the feed roller shaft 86 is linked with the feed roller 82. The feed roller shaft 86 is rotated by a driving mechanism not shown here. When the feed roller shaft 86 is rotated, the auxiliary sheet medium 74 is adhered to the printed film tape 17, and at the same time, the printed film tape 17 is conveyed towards a second cutter 87 (to be described later).

The second cutter 87 is arranged downstream from the feed roller shaft 86 in the conveying direction. The second cutter 87 is composed of a fixed blade 87A and a movable blade 87B. The printed film tape 17 is cut by movement of the movable blade 87B towards the fixed blade 87A. The movable blade 87B is driven and controlled by a driving mechanism not shown here.

The film tape 17 which was printed at the location of the thermal head 7 and the platen roller 8 is conveyed by rotation of the platen roller 8 to the location of the second cutter 87.

Figure 11:
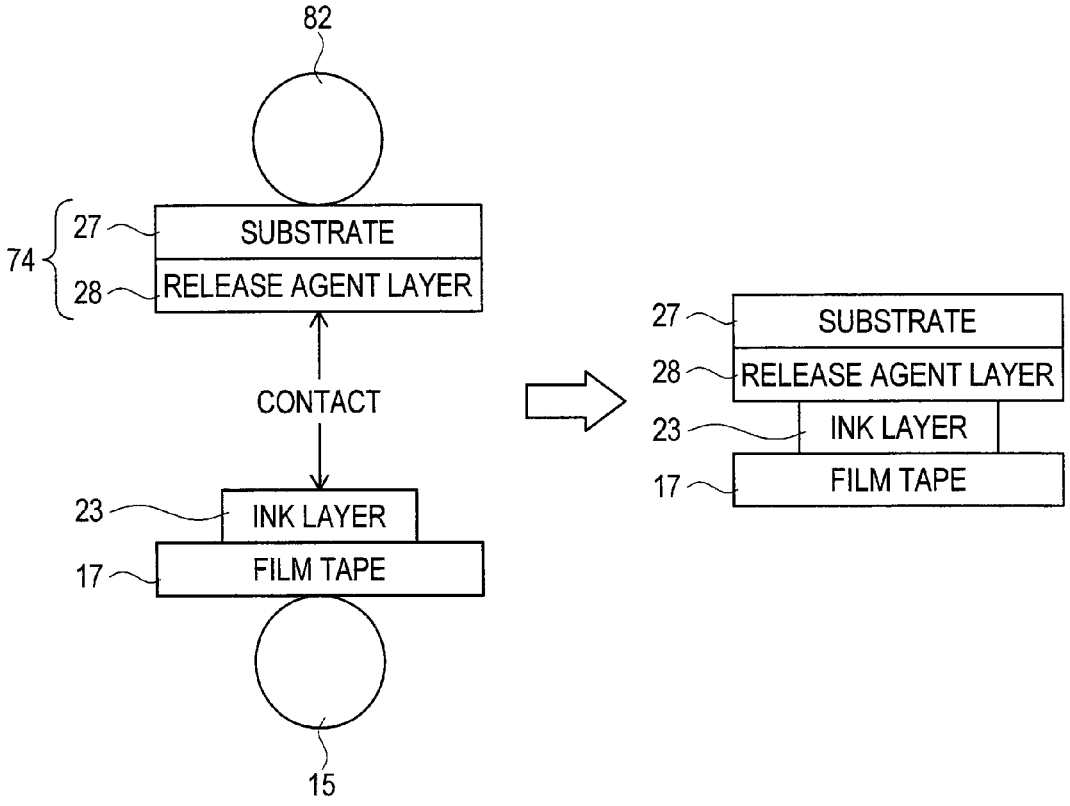
FIG. 11 is a schematic view showing a condition where an auxiliary sheet medium is adhered to a printed film tape.
Figure 12:
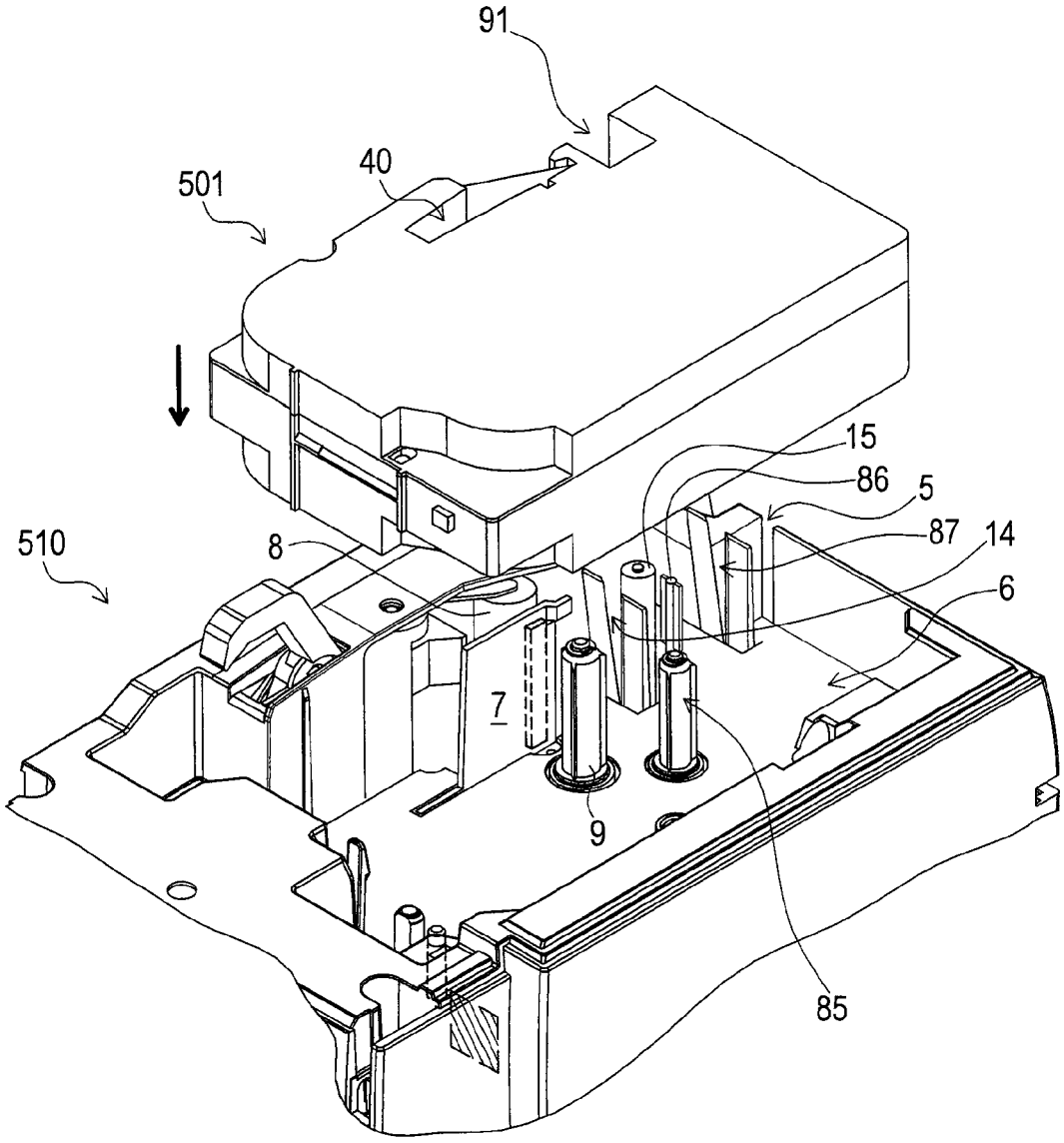
FIG. 12 is an enlarged perspective view of a relevant part showing mounting of the tape cassette in the cassette housing part of the tape printing apparatus according to the third embodiment.
Figure 13:
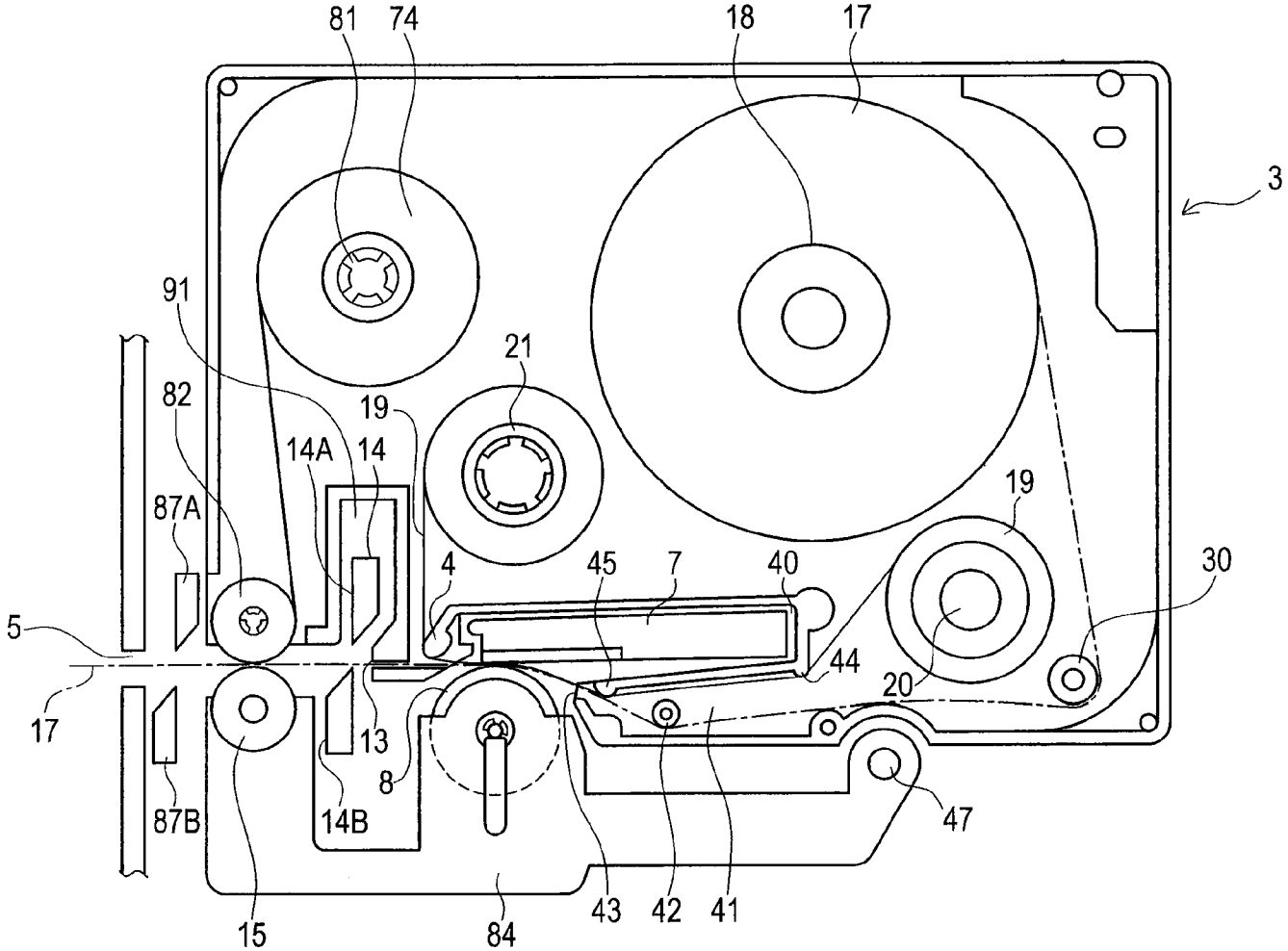
FIG. 13 is a plan view showing a pattern of an internal configuration of the tape cassette according to the third embodiment.
Figure 14:
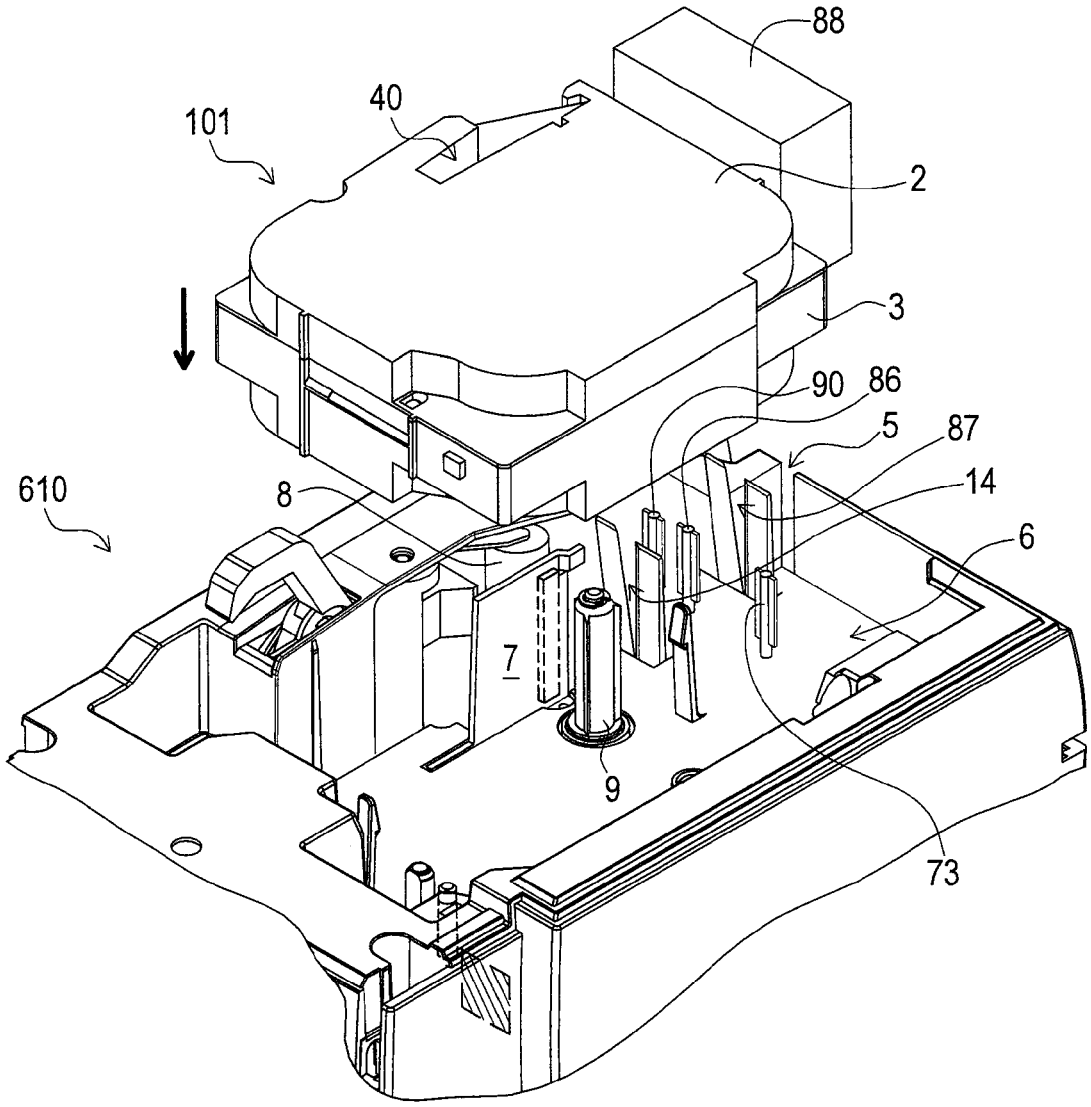
FIG. 14 is an enlarged perspective view of a relevant part showing mounting of a tape cassette in a cassette housing part of a tape printing apparatus according to a fourth embodiment.
Figure 15:
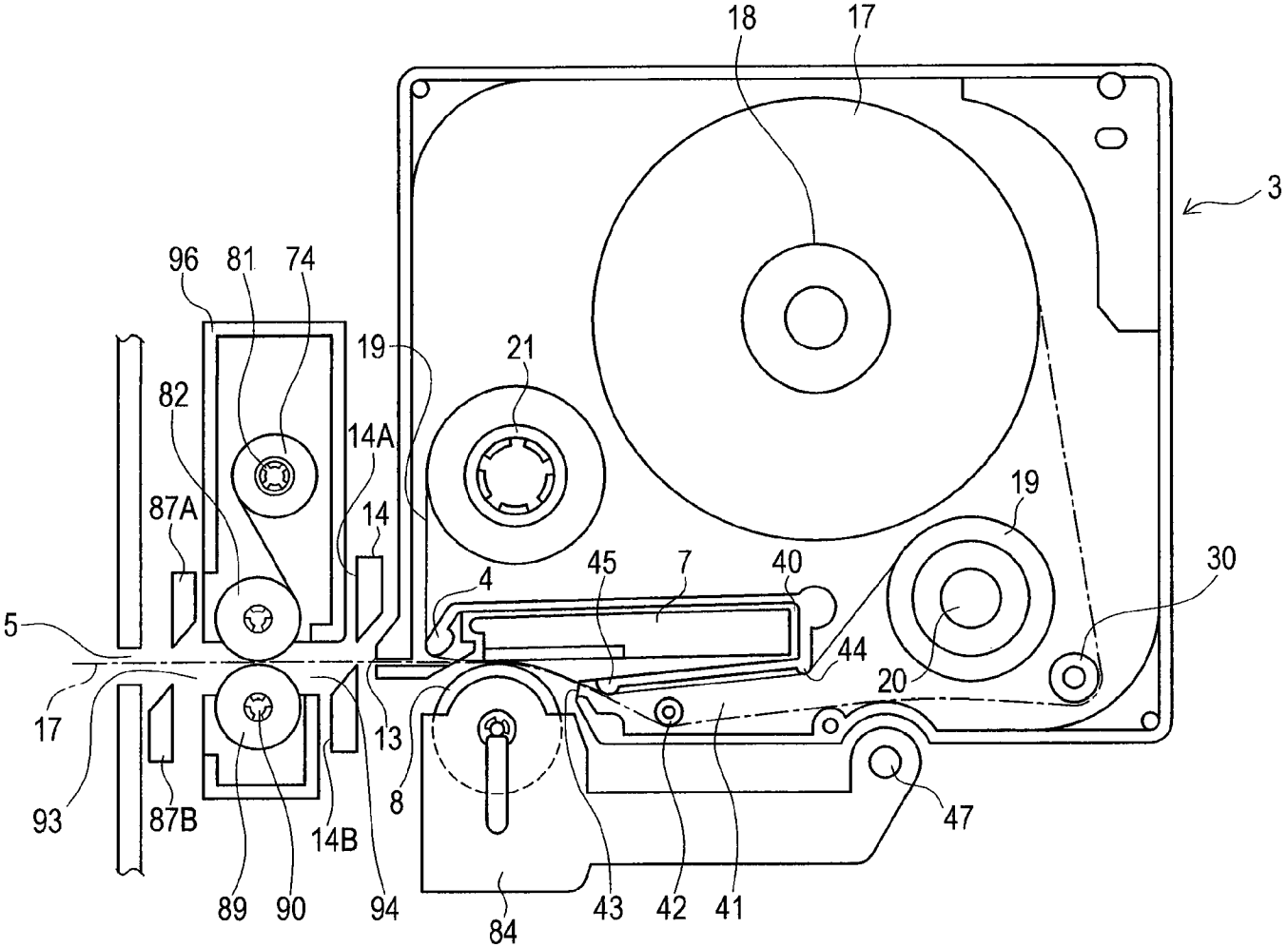
FIG. 15 is a plan view showing a pattern of an internal configuration of the tape cassette according to the fourth embodiment.

As shown in FIG. 11, the auxiliary sheet medium 74 is constituted of a substrate 27 and a release agent layer 28. The printed film tape 17 having an ink layer 23 adhered thereto and the auxiliary sheet medium 74 come into contact with each other between the heat roller 15 and the feed roller 82, whereby the auxiliary sheet medium 74 is adhered to the printed film tape 17. The printed film tape 17 to which the auxiliary sheet medium 74 has been adhered is discharged to the exterior of the tape cassette 101 from a discharge port 5.

The adhesive layer 24 is thus protected by the auxiliary sheet medium 74, which enables easy storage of the film tape 17 which is formed in the manner described above, for a long period of time without being adhered to the target body. The auxiliary sheet medium 74 is peeled off upon being adhered to the target body. Since the adhesive layer 24 and the feed roller 82 do not come into contact with each other, it is unlikely that the adhesive agent of the adhesive layer 24 will adhere to the feed roller 82. Since the cutter unit 14 is mounted on the vicinity of a downstream side from the thermal head 7 in the conveying direction, a blank portion at the front end portion of the thus formed film tape 17 can be shortened. As a result, the amount of consumed film tape 17 can be reduced.

In the third embodiment, the tape cassette 101 and the auxiliary cassette 71 are configured separately, but the tape cassette and the auxiliary cassette can also be integrally configured.

In this case, the tape cassette 501 is provided with the auxiliary sheet medium 74, the conveying roller 82, the film tape 17, the ink ribbon 19 and the like.

The tape cassette 501 has a cut-out portion 91. This cut-out portion 91 is positioned between the tape conveying roller 82 and the tape discharge port 13. When the tape cassette 501 is mounted on the tape printing apparatus 510, the fixed blade 14A of the tape printing apparatus 510 is positioned in the cut-out portion 91.

When the printed film tape 17 is heated in the tape printing apparatus 510 which employs the tape cassette 501, the adhesive layer of the printed film tape 17 does not come into contact with the feed roller 82. This prevents the adhesive agent from adhering to the feed roller 82. As a result, conveyance failures can be prevented. Since the adhesive layer is protected by the base, the film tape 17 which is discharged from the discharge port 5 can be easily stored for a long time without being adhered to the target body. The auxiliary sheet medium 74 is peeled off upon being adhered to the target body.

The outer shape of the tape printing apparatus, the tape cassette, and the auxiliary cassette as shown in the description of the third embodiment are given as merely one example, and the one or more aspects of the disclosure is not limited to this outer shape.

Fourth Embodiment

Next, the fourth embodiment will be described. Similarly with the third embodiment described earlier, in the fourth embodiment, the printed film tape is discharged with the auxiliary sheet medium adhered thereto. The fourth embodiment differs from the third embodiment described above in that the heat roller is mounted on the auxiliary cassette.

The configuration of the tape cassette 101 according to the third embodiment is the same as the configuration of the tape cassette 101 according to the third embodiment.

Also, the configuration of the tape printing apparatus 610 according to the fourth embodiment is substantially the same as the configuration of the tape printing apparatus 510 according to the third embodiment.

Also, the configuration of the auxiliary cassette 88 according to the fourth embodiment is substantially the same as the configuration of the auxiliary cassette 71 according to the third embodiment.

In the following description, elements which are the same as those of elements according to the above embodiments are denoted by the same numerical symbols.

A tape printing apparatus 610 is not provided with a heat roller but is provided with a heat roller shaft 90. If an auxiliary cassette 88 (to be described later) is mounted on the cassette housing unit 6, the heat roller shaft 90 is coupled to a heat roller 89 (to be described later).

The specific configuration of the heat roller shaft 90 will now be described. A portion or the entire front face of the heat roller shaft 90 (contact face with the heat roller 89) is formed of a conductor. A current (voltage) supplied from a predetermined supply source provided in the tape printing apparatus 610 is supplied to the conductor of the heat roller shaft 90. The heat roller shaft 90 is rotated by a driving mechanism not shown here.

(Auxiliary Cassette)

The specific configuration of the auxiliary cassette 88 and the heat roller 89 arranged in the auxiliary cassette 88 will now be described. The auxiliary cassette 88 is provided with a heat roller 89, in addition to the auxiliary sheet medium spool 81 and the feed roller 82 described above. The printed film tape 17 is conveyed between the feed roller 82 and the heat roller 89.

The outer shape of the auxiliary cassette 88 is defined by the cassette case 96. In other words, the auxiliary cassette 88 is configured so that the auxiliary sheet medium 74, the feed roller 82, and the heat roller 89 are accommodated inside the cassette case 89.

The cassette case 96 is provided with a tape discharge port 93 and a tape entry port 94. The printed film tape 17 to which the auxiliary sheet medium 74 has been adhered is discharged from the tape discharge port 93. The printed film tape 17 is inserted into the auxiliary cassette 88 through the tape entry port 94.

The cutter unit 14 is thus located at the tape entry port 94 side of the auxiliary cassette 88. The second cutter 87 is located at the tape discharge port 93 side of the auxiliary cassette 88.

A conductor is formed in the shaft hole of the heat roller 89. This conductor comes into contact with the conductor of the heat roller shaft 90. As a result, current (voltage) supplied from a predetermined supply source provided in the tape printing apparatus 610 is transmitted to the heat roller 89. The front surface of the heat roller 89 is thus heated by the supplied current. As a result of heating the front face of the heat roller 89, the adhesive layer 24 of the film tape 17 that is in contact with the heat roller 89 starts exhibiting adhesive properties.

The configuration of the heat roller as described above is merely one example thereof. Specifically, any configuration may be employed as long as it is possible to generate an amount of heat sufficient to cause the adhesive layer 24 to exhibit adhesive properties at a front face of the heat roller.

The heat roller 89 is rotated by the rotation driving of the heat roller shaft 90. As a result, the printed film tape 17 can be conveyed.

According to the fourth embodiment, since the heat roller is not mounted on the tape printing apparatus, even in the event the heat roller fails, it is sufficient to replace the auxiliary cassette alone. Thus, the tape printing apparatus itself needs not be replaced.

Figure 16:
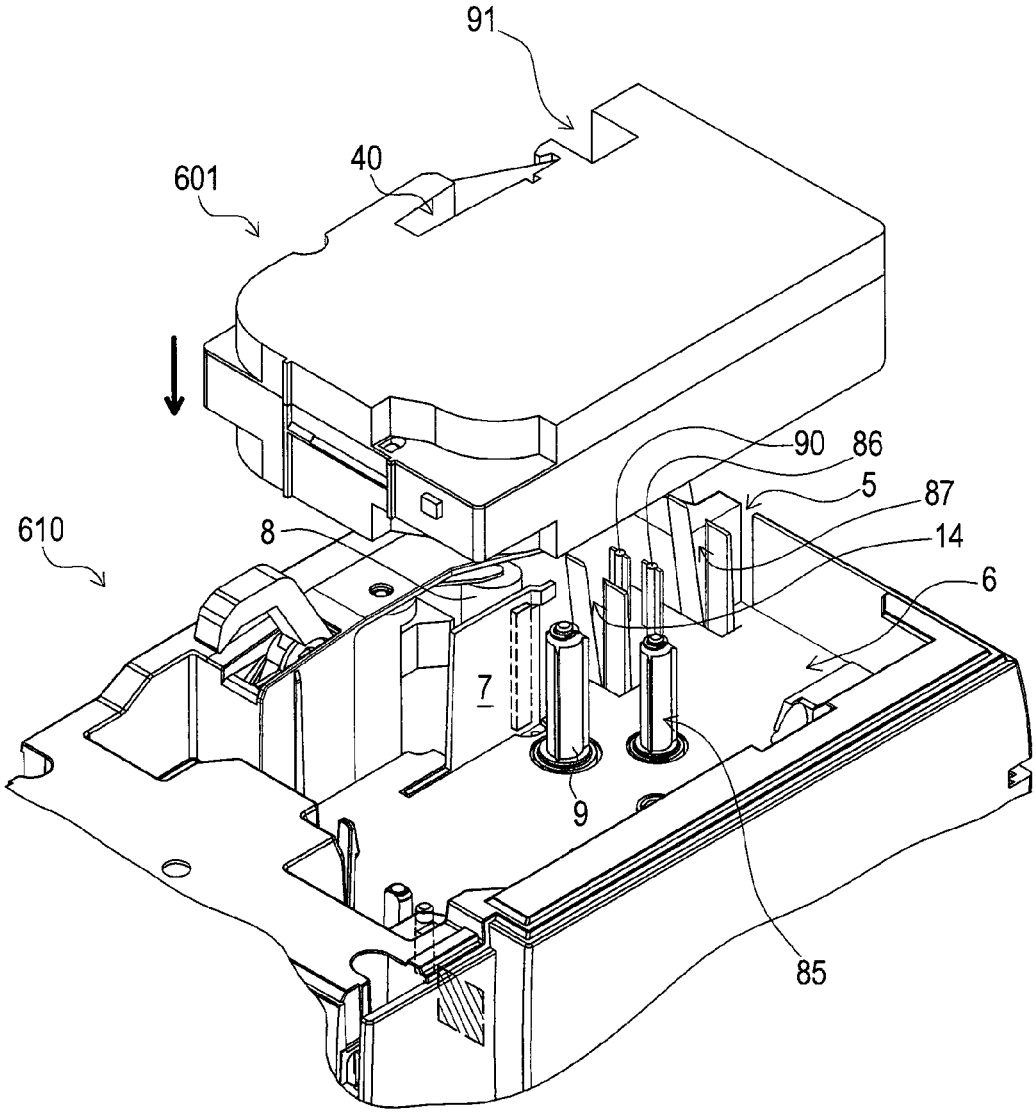
FIG. 16 is an enlarged perspective view of a relevant part showing mounting of the tape cassette in the cassette housing part of the tape printing apparatus according to the fourth embodiment.
Figure 17:
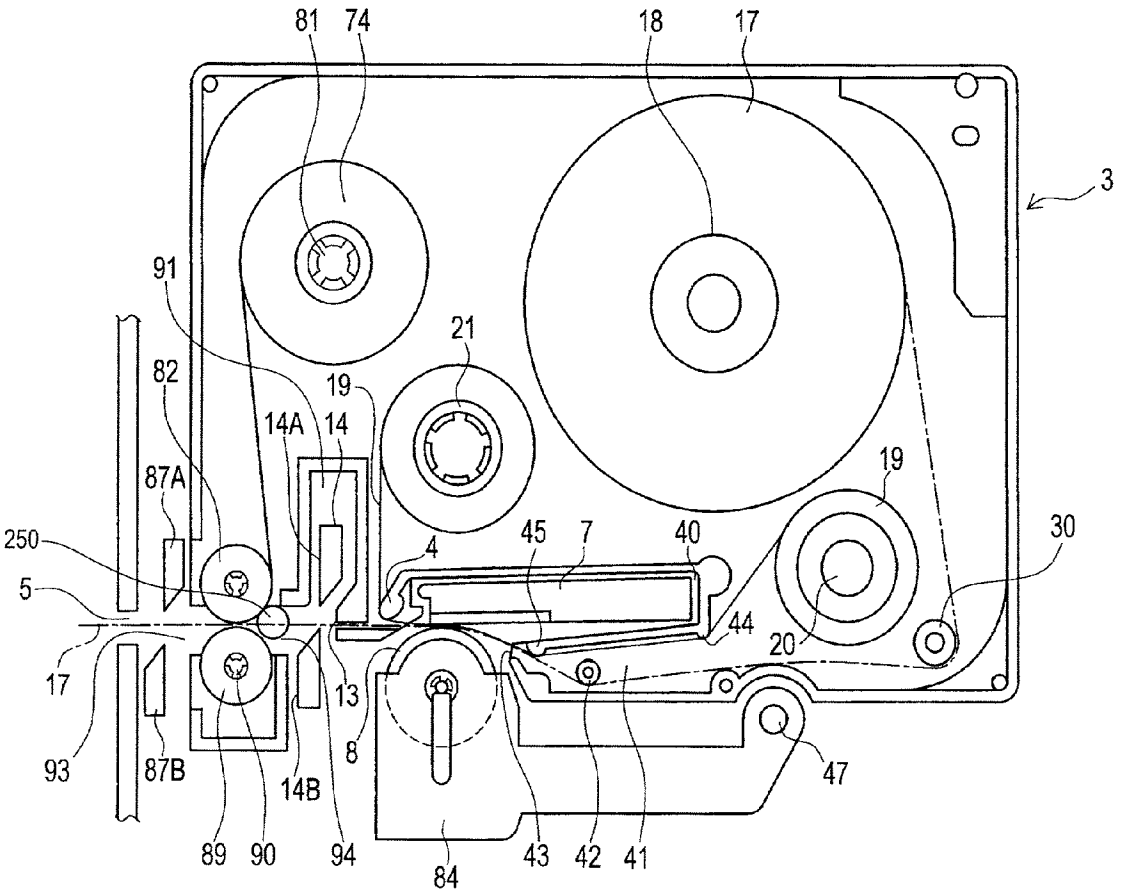
FIG. 17 is a plan view showing a pattern of an internal configuration of the tape cassette according to the fourth embodiment.

In the fourth embodiment, the tape cassette 101 and the auxiliary cassette 88 are configured separately, but the tape cassette and the auxiliary cassette can also be integrally configured, as shown in FIG. 16 and FIG. 17. In this case, the tape cassette 601 is provided with the auxiliary sheet medium 74, the conveying roller 77, the heat roller 89, the film tape 17, the ink ribbon 19 and the like.

As shown in FIG. 16, the tape cassette 601 has a cut-out portion 91. The tape cassette 601 has a cut-out portion 91. This cut-out portion 91 is positioned between the tape conveying roller 82 and the tape discharge port 13. When the tape cassette 601 is mounted on the tape printing apparatus 610, the fixed blade 14A of the tape printing apparatus 610 is positioned in the cut-out portion 91. When the printed film tape 17 is heated in the tape printing apparatus 610 which employs the tape cassette 601, the adhesive layer of the printed film tape 17 does not come into contact with the feed roller 82. As a result, the adhesive agent never adheres to the feed roller 82, which thus helps prevent any conveyance failures. Since the adhesive layer is protected by the auxiliary sheet medium 74, the film tape discharged from the discharge port 5 is easily stored. The auxiliary sheet medium 74 is peeled off when the film tape is adhered to the target body. Since the adhesive layer 24 and the feed roller 82 do not come into contact with each other, the adhesive agent of the adhesive layer 24 is unlikely to adhere to the feed roller 82.

The outer shape of the tape printing apparatus, the tape cassette, and the auxiliary cassette as shown in the description of the fourth embodiment are given as merely one example, and the one or more aspects of the disclosure is not limited to this outer shape.

Fifth Embodiment

Next, a tape cassette and a tape printing apparatus according to a fifth embodiment will now be described based on FIG. 18 and FIG. 19.

A tape cassette and a tape printing apparatus according to the fifth embodiment have the same basic configuration as the tape cassette 1 and the tape printing apparatus 110 according to the first embodiment. Consequently, in the description to follow, elements which are the same as those in the tape cassette 101 and the tape printing apparatus 110 according to the first embodiment will be denoted by the same numerical symbol, the description will be focused on elements that differ from those in the tape cassette 101 and the tape printing apparatus 110 according to the first embodiment.

Figure 18:
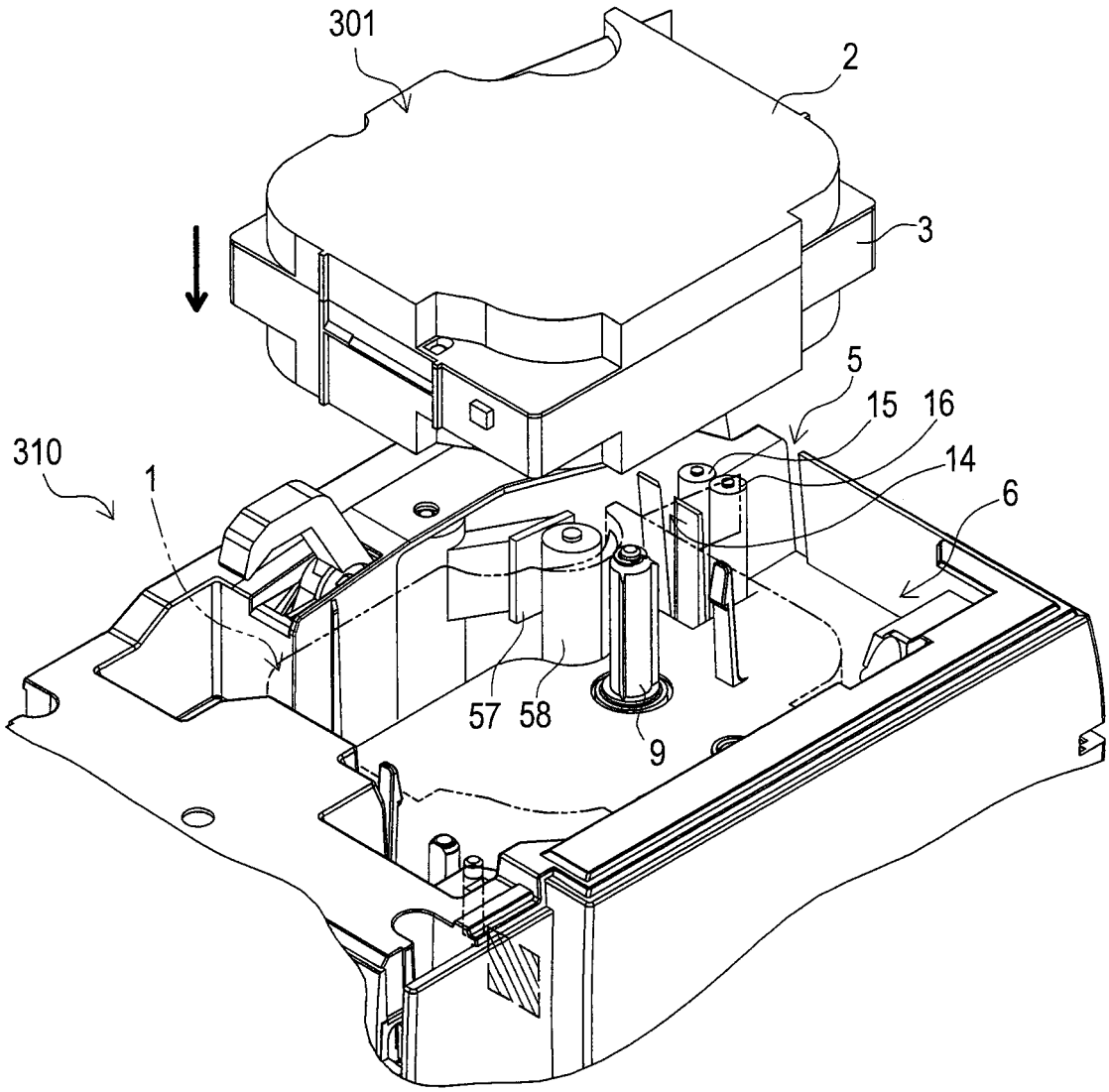
FIG. 18 is an enlarged perspective view of a relevant part showing mounting of a tape cassette in a cassette housing part of a tape printing apparatus according to a fifth embodiment.
Figure 19:
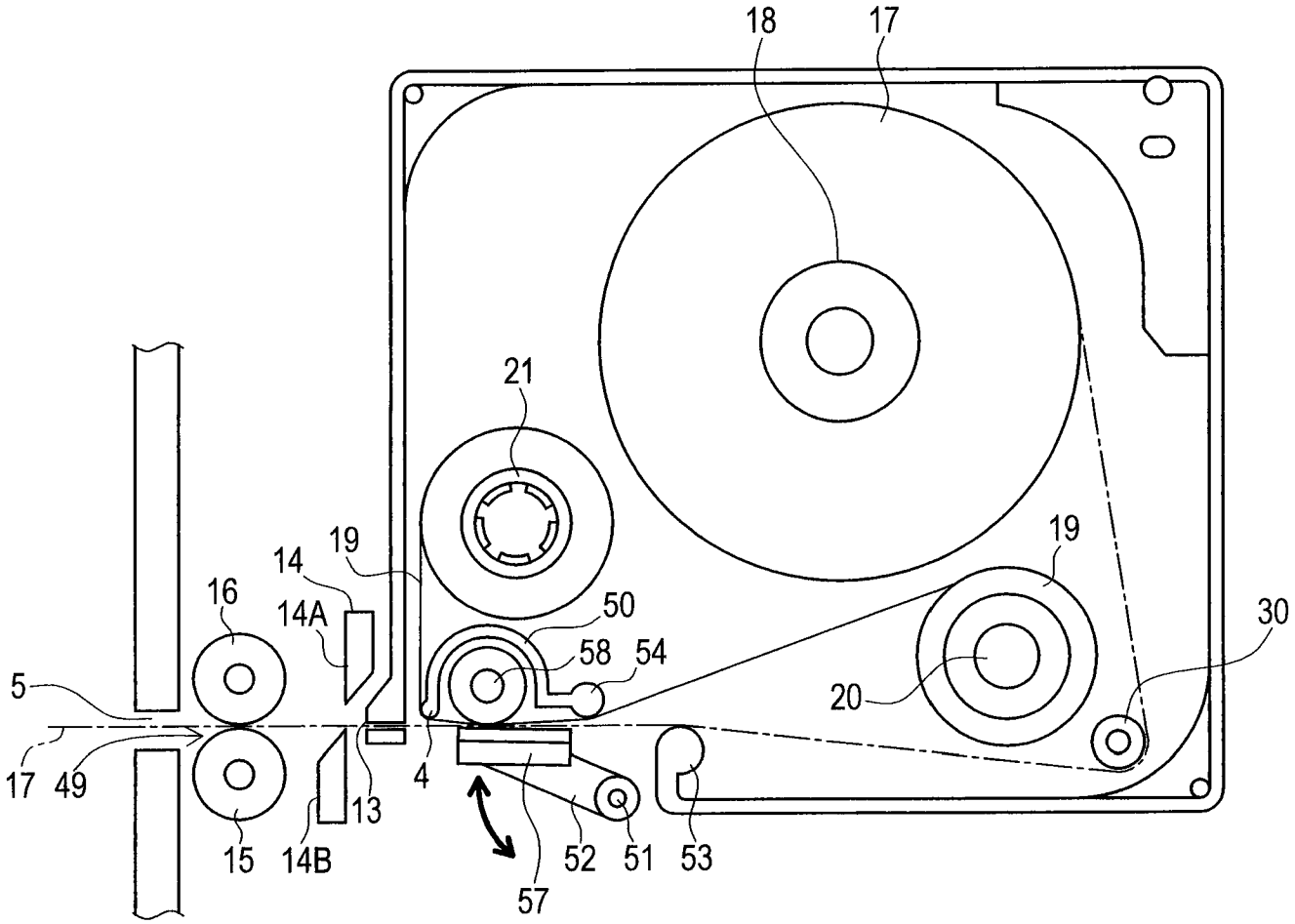
FIG. 19 is a plan view showing a pattern of an internal configuration of the tape cassette according to the fifth embodiment.

In FIG. 18, a tape cassette 301 having an upper case 2 and a lower case 3 is detachable in the cassette housing part 6 provided in a tape printing apparatus 301. The upper case 2 serves as a lid member that covers an upper surface of the lower case 3. The lower case 3 has a tape spool 18 onto which the film tape 17 is wound, arranged at a slightly upper position from its center, as shown in FIG. 18. The lower case 3 has a ribbon spool 20 onto which the ink ribbon 19 is wound, arranged at a lower right position of the tape spool 18. The lower case 3 also has a ribbon take-up spool 21 which draws the ink ribbon 19 from the ribbon spool 20 and takes up the ink ribbon 19 which was used in character printing.

The tape cassette 301 has a roller arranging part 50 formed so as to pass through the upper case 2 and the lower case 3. Upon loading the tape cassette 301 in the cassette housing part 6, the platen roller 58 to be described later is arranged in the roller arranging part 50. The roller arranging part 50 has a separating member 4 formed downstream of the thermal head 57 (center left side in FIG. 19). As will be described later, at the time of character printing by the thermal head 57, the separating member 4 has the role of reversing the feed direction of the ink ribbon 19 which is pressed onto the film tape 17 when clamped between the platen roller 58 and the thermal head 57 and separating the ink ribbon 19 from the film tape 17.

The tape cassette 301 has a discharge port 13 formed therein for discharging the film tape 17 onto which characters and the like have been printed to the exterior of the tape cassette 301 after the ink ribbon 19 has been separated therefrom by the separating member 4.

The configuration of the tape housing part 6 in the tape printing apparatus 310 will now be described. As shown in FIG. 18 and FIG. 19, the cassette housing part 6 of the tape printing apparatus 310 has a thermal head 57 mounted on the head supporting member 52 which is arranged so as to be able to rotate around the head supporting shaft 51. The thermal head 57 is tabular with a rectangular shape in a longitudinal direction thereof, and has a predetermined number of heat generating elements formed at a left margin of a front surface thereof and aligned along the left margin. The cassette housing part 6 has a platen roller 58 rotatably supported therein.

The head supporting member 52 is biased in a counterclockwise direction around the head supporting shaft 51 by an elastic member which is not shown. At the time of printing onto the film tape 17, the head supporting member 52 is driven in a clockwise direction by a motor or the like, thereby enabling the thermal head 57 to come into contact and move away with respect to the platen roller 58.

The cassette housing part 6 has a ribbon take-up shaft 9 that is coupled to the ribbon take-up spool 21 of the tape cassette 301. The ribbon take-up shaft 9 is coupled to a driving mechanism such as a motor and the like which is not shown and is adapted to drive and rotate the ribbon take-up spool for taking up ink ribbon 19 which has been separated by the separating member 4, as described above.

The cassette housing part 6 has a clipper-type cutter unit 14 arranged adjacent to the tape discharge port 13 of the tape cassette 301. The cutter unit 14 is composed of a fixed blade 14A and a movable blade 14B which is actuated with respect to the fixed blade 14A to cut the post-printing film tape 17.

A pair of conveying rollers 49 are arranged downstream of the cutter unit 14. The conveying rollers 49 are composed of a heat roller 15 that heats the adhesive layer (to be described later) formed in the film tape 17 and a tape conveying roller 16 arranged opposite to the heat roller 15 and adapted to feed the post-printing film tape 17 to the exterior of the tape printing apparatus 310 through the cooperation with the heat roller 15.

When the tape cassette 301 having the above-described configuration is loaded in the cassette housing part 6 of the printing apparatus 310 for character printing onto the film tape 17, the film tape 17 wound onto the tape spool 18 is guided over the tape guiding skid 30 provided at a corner of the lower case 3 and a guiding supporting part 53 formed in an inner wall of the lower case 3 towards the thermal head 57 and the platen roller 58. Also, the ink ribbon is guided toward the thermal head 57 and the platen roller 58 while being guided and supported by the guiding supporting part 54 formed at an end part of the roller arranging part 50.

The film tape 17 and the ink ribbon 19 guided as described above are superimposed between the thermal head 57 and the platen roller 58. Each of the heat generating elements of the thermal head 57 is driven to generate heat, with the film tape 17 being superimposed on the ink ribbon 19. As a result, characters and the like are printed onto the film tape 17 through the ink ribbon 19. Thereafter, the ink ribbon 19 is fed downstream from the thermal head 57, and after being separated from the film tape 17 through the separating member 4, it is taken up by the ribbon take-up spool 21.

After characters and the like are printed onto the film tape through the ink ribbon 19 and the thermal head 57, and the ink ribbon 19 is separated therefrom through the separating member 4, the film tape 17 is discharged to the exterior of the tape cassette 301 from the tape discharging port 13 and is further discharged to the exterior of the tape printing apparatus 310 through the pair of conveying rollers 49. At this time, the adhesive layer of the film tape 17 is heated by the heat roller 15 of the pair of conveying rollers 49, thereby making the adhesive layer exhibit adhesive properties as will be described later.

Then, when the film tape 17 has reached a predetermined length, the cutter unit 14 is driven to cut the film tape 17 at a predetermined length through the cooperation of the fixed blade 14A and the movable blade 14B.

Figure 20:
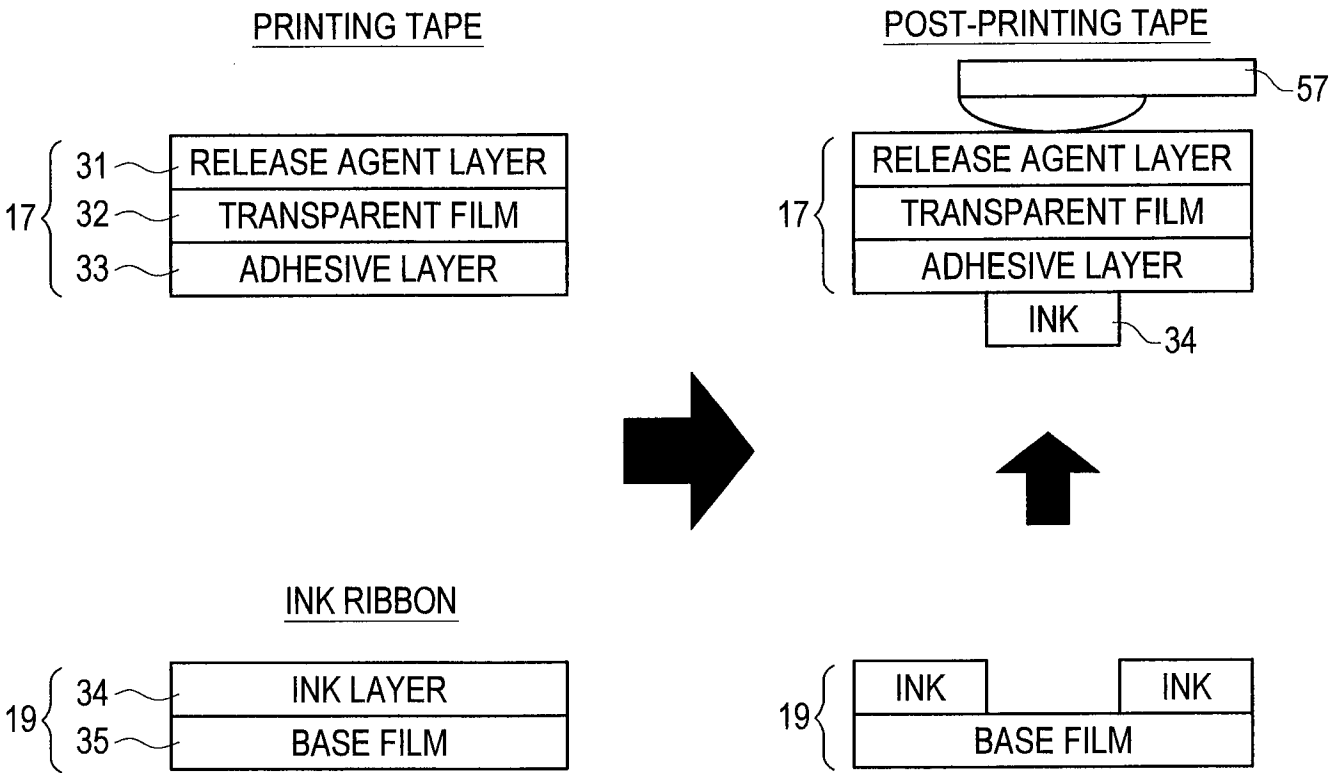
FIG. 20 is an explanatory diagram showing a pattern of the relationship between an ink ribbon and a film tape in a character printing process according to the fifth embodiment.

The configuration of the ink ribbon and the printing tape according to the fifth embodiment will now be described based on FIG. 20. As shown in FIG. 20, the ink ribbon 19 is composed of a base film 35 and an ink layer 34. The film tape 17 serving as a printing tape has an adhesive layer 33 formed on one surface (in FIG. 20, lower side of the transparent film) of the transparent film tape 32, and a release adhesive layer 31 formed on the other surface (upper side of the transparent film in FIG. 20) of the transparent film.

The above-described adhesive layer 33 is composed of a material having special properties in that it does not exhibit adhesive properties at ambient temperature, but starts exhibiting adhesive properties upon being heated, and maintains these adhesive properties after it has been heated once, even if its temperature decreases. Similarly with the first embodiment, the adhesive agent 24 may include an adhesive agent employed for heat seal labels, as described in JP Patent Num. 3394752, for instance. This type of adhesive agent melts upon being heated to 80° C. to 100° C. by the heat roller and the like, thereby exhibiting adhesive properties. In the fifth embodiment, the heat roller heats the adhesive agent up to 80° C. or above but below 90° C., similarly with the first embodiment.

The above-described film tape 17, having the adhesive layer 33 superimposed on one surface thereof, is wound in the tape spool 18 with the adhesive layer 33 at the inner side, for loading. Since the film tape 17 has a release agent layer 31 formed on a back surface side of the adhesive layer 33 of the transparent film tape 32, the adhesive layer 33 never adheres to the transparent film 17, to an inner side of the tape cassette and to other parts in the printing apparatus, even in the case a part of the adhesive layer should exhibit adhesive properties when it is already wound onto the tape spool 18.

The film tape 17 drawn from the tape spool 18 is conveyed from the tape guiding skid 30 and the like up to a printing position found between the thermal head 57 and the platen roller 8 of the tape printing apparatus 310, as was described earlier. The film tape 17 is superimposed onto the ink ribbon 19 at the printing position, whereby the adhesive layer 33 of the film tape 17 comes in contact with the ink layer 34 of the ink ribbon 19.

As described above, when the adhesive layer 33 of the film tape 17 and the ink layer 34 of the ink ribbon 19 come into contact; the contact location where the adhesive layer 33 and the ink layer 34 come into contact with each other is clamped between the thermal head 57 and the platen roller 58 and, as shown in FIG. 20, the thermal head 57 comes into contact with the release adhesive layer 31 side of the transparent film 32. As a result, the adhesive layer 33 exhibits adhesive properties upon being heated by the thermal head 57 and the ink layer 34 of the ink ribbon 19 melts upon being heated by the thermal head 57. The melted ink layer 34 is adhered to the adhesive layer, whereby characters and the like are transferred to the film tape 17.

The tape printing apparatus 310 is provided with a drive control device (not shown) for driving and controlling the heat generating parts of the thermal head 57. Thus, since control is carried out so that the transferred ink layer 34 is printed as mirror image with respect to the film tape 17, characters and the like printed as normal image can be visually checked when looking from the side of the transparent film tape 32 of the film tape 17.

Figure 21:
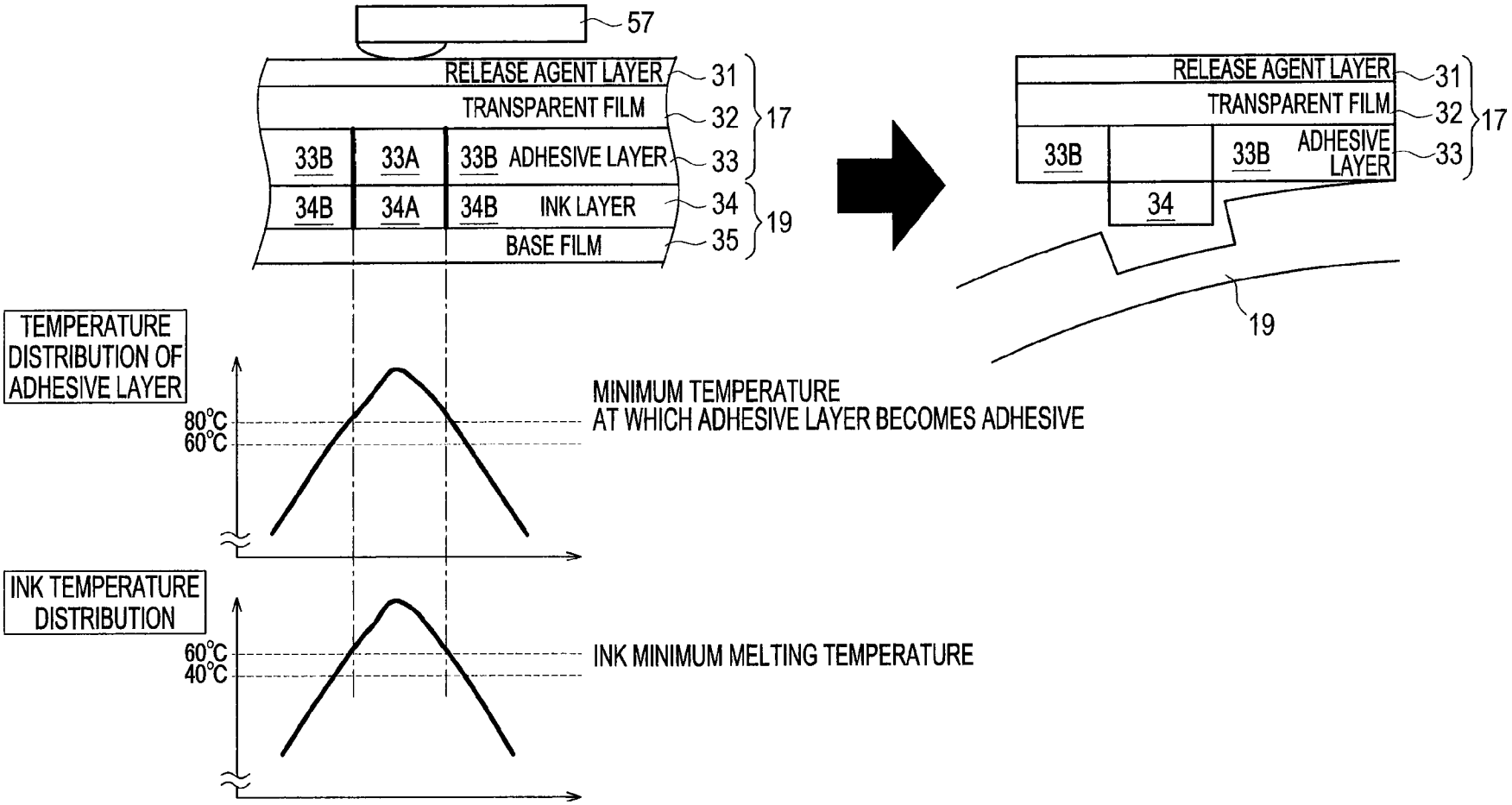
FIG. 21 an explanatory diagram showing a pattern of a transferring mechanism in which an ink layer is transferred to an adhesive layer upon being heated by a thermal head according to the fifth embodiment.

A transfer mechanism in which an ink layer is transferred to an adhesive layer upon being heated by the thermal head 57 will now be described based on FIG. 21. As shown in FIG. 21, when the film tape 17 and the ink ribbon 19 are superimposed at a printing position, between the thermal head 57 and the platen roller 58, the adhesive layer 33 of the film tape 17 is brought into contact with the ink layer 34 of the ink ribbon 19. Although the adhesive layer 33 and the ink layer 34 are simultaneously heated at the above described contact portion by the thermal head 57, heat transfer losses occur at the boundary portion when heat is transferred from the adhesive layer 33 to the ink layer 34, which leads to differences in temperature at the boundary part of the ink layer 34 and the adhesive layer 33. Since the adhesive layer 33 of the film tape 17 to be used in the tape cassette 301 according to the third embodiment employs an adhesive agent that exhibits adhesive properties when heated to 80° C. or above, and the ink layer 34 of the ink ribbon 19 employs a high melting point-type ink which melts at a temperature of 60° C. or above, when the temperature at a heated portion of the adhesive layer 33A becomes 80° C. or above, the temperature at a heated portion of the ink layer 34A as well, becomes 60° C. or above. As a result, the adhesive layer 33A and the ink layer 34A are adhered at their heated portions, respectively.

Since the temperature of the adhesive layer 33B when it is not heated by the thermal head 57 is below 80° C. and thus exhibits no adhesive properties, and the temperature of the ink layer 34B at a portion corresponding to the adhesive layer 33B, as well, is below 60° C., after these layers pass the thermal head 57 and the separating part 4 arranged downstream from the thermal head 57, they are heated and only the ink layer 34A which has been adhered to the adhesive layer 33A is transferred to the film tape 17, as shown in FIG. 21. The remaining portions of the ink ribbon are taken up by the ribbon take-up spool 21, as consumed ink ribbon 19.

As shown in FIG. 21, the thermal head 57 has a heat concentrated-type glaze structure. The ink layer 34 and the adhesive layer 33 are heated by focusing the heat into a pin-point. Accordingly, since the temperature difference between the heated portions of the ink layer 34A and the adhesive layer 33A and the unheated portions of the ink layer 34B and the adhesive layer 33B becomes large, the ink layer and the adhesive layer can be adhered, with the boundary between the heated portion 34A and the unheated portions 34B of the ink layer and the heated portion 33A and the unheated portions 33B of the adhesive layer clearly defined.

The ink layer 34 includes a wax-type ink so that only the heated portions of the ink later 34 are transferred, even if they cool down after being heated. Accordingly, the heated ink layer 34 can be reliably adhered to the adhesive layer 33A at the heated portion even if the ink layer 34 cools down, thereby being reliably transferred to a film tape 17 onto which characters and the like are printed.

The film tape 17 onto which characters and the like are printed is drawn up to a clipper-type cutter unit 14 serving as a cutting device, through the cooperation of the tape conveying roller 16 and the heat roller 15 as described above. The post-printing film tape 17 can be cut to a predetermined length through the cooperation of the fixed blade 14A and the movable blade 14B of the cutter unit 14. The cut film tape 17 is passed between the tape conveying roller 16 and the heat roller 15 where it is heated by the heat roller to exhibit adhesive properties in the adhesive layer 33B at portions other than portions where the ink layer 34 is adhered. Thereafter, the post-printing film tape 17 which exhibits adhesive properties is discharged to the exterior of the tape printing apparatus, as a linerless tape as was cut.

As described above, since the tape cassette 301 does not house the adhesive tape spool and the pasting roller and the tape conveying roller 16 and the heat roller 15 are arranged downstream of the cutter unit 14, the post-printing film tape 17 can be cut by the cutter unit 14 arranged immediately downstream of the thermal head 57 right after characters and the like have been printed thereon. This makes it possible to shorten the front blank space of the post-printing film tape 17, thereby reducing the running cost of the film tape 17.

Further, when the heat roller 15 heats the target layers to 80° C. or above but below 90° C., the temperature inside the ink layer becomes 60° C. or above, but because the ink used in the ink layer 34 is a low melting point-type ink (the melting point of the ink becomes 60° C. or above), the ink is once fused in the adhesive agent having high viscosity at the time of character printing. As a result, melting of the ink under the heat from the heat roller 15 becomes difficult, thereby eliminating the risk of faulty printing caused by ink re-melting when being heated by the heat roller 15. Here, the release adhesive layer is also transparent. Needless to say, the adhesive layer present between the film layer and the ink layer is necessarily transparent or semi-transparent, to thus make the ink layer visible through the transparent film.

Since the heat roller 15 comes in contact with the film tape 17 onto which characters and the like have been printed from the release agent layer 31 side thereof (back surface side of the adhesive layer 33), it is possible to avoid direct contact with the adhesive layer 33, thereby preventing the heated adhesive layer 33 from adhering to the heat roller 15.

Since the heated adhesive layer 33 maintains its adhesive properties even after its temperature decreases, the user can paste the linerless tape produced as described above onto the target body. As a result, the user no longer needs to remove the release sheet, as was done in the case of using the conventional laminated tape. Further, since the transferred ink layer 34 is printed as mirror image with respect to the film tape 17, as described above, the user can recognize the characters and the like printed as normal image, through the transparent film.

The outer shape of the tape printing apparatus 310 and the tape cassette 301 as shown in the description of the fifth embodiment is given as merely one example, and one or more aspects of the disclosure is not limited to this outer shape.

Sixth Embodiment

The tape cassette and the tape printing apparatus according to the sixth embodiment will now be described based on FIG. 22 and FIG. 23.

The configuration of the tape cassette according to the sixth embodiment is the same as the configuration of the tape cassette 301 according to the fifth embodiment. Also, the configuration of the tape printing apparatus according to the sixth embodiment is substantially the same as the configuration of the tape printing apparatus 310 according to the fifth embodiment. In the following description, elements which are the same as those of the tape cassette 301 and the tape printing apparatus 310 according to the fifth embodiment are denoted by the same numerical symbols.

The tape printing apparatus 310 according to the fifth embodiment has a tape conveying roller 16 arranged in the tape printing apparatus 310, but in the sixth embodiment, the conveying roller 77 having the same function as the tape conveying roller 16 according to the third embodiment is arranged in the auxiliary cassette 70. The tape printing apparatus 410 does not have a tape conveying roller arranged therein. In the sixth embodiment, the tape printing apparatus 410 has a conveying roller shaft 72 for coupling with the conveying roller 77 and an auxiliary sheet medium take-up shaft 73 for coupling to the auxiliary sheet medium take-up spool 76 arranged therein.

Figure 22:
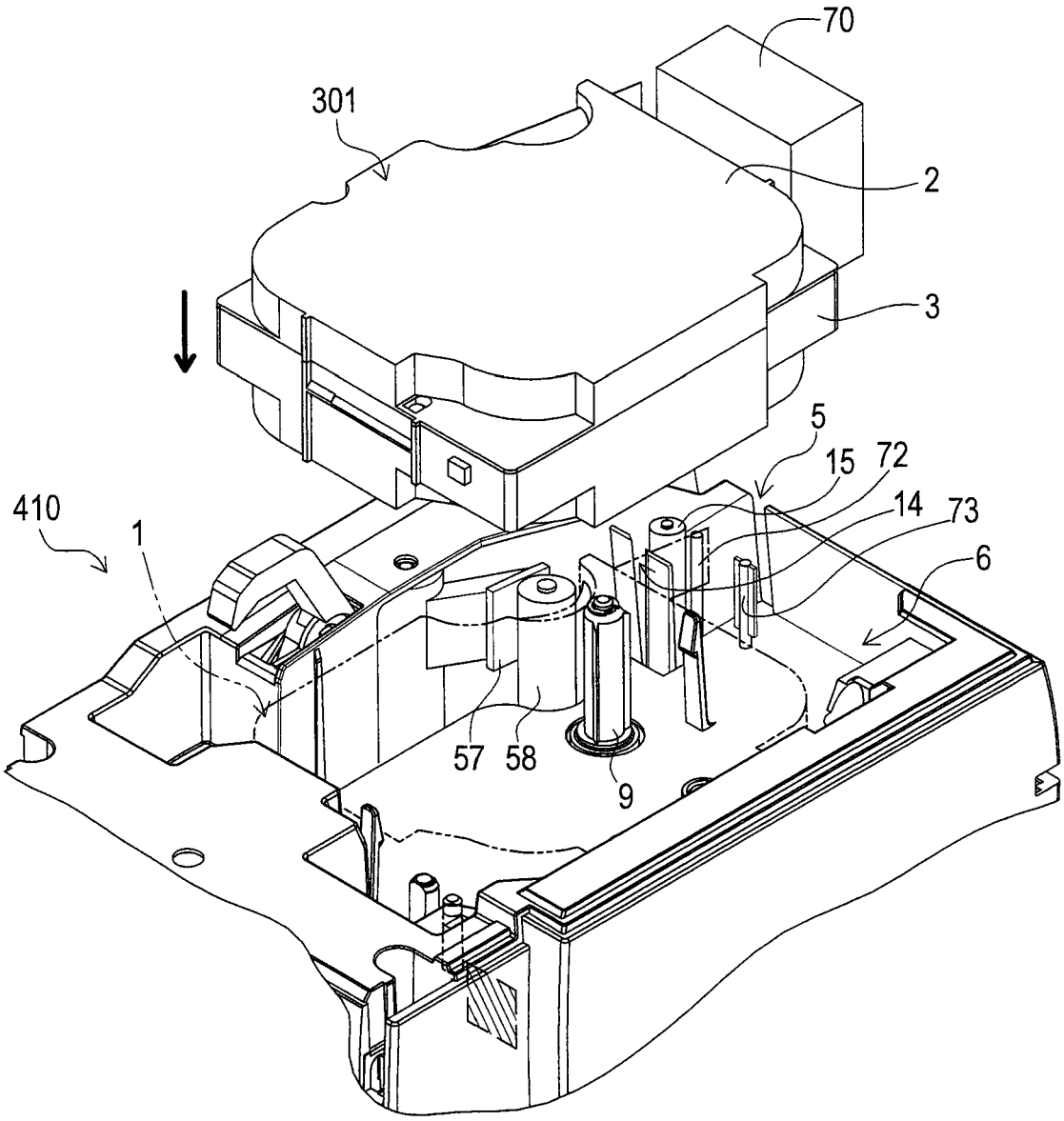
FIG. 22 is an enlarged perspective view of a relevant part showing mounting of a tape cassette in a cassette housing part of a tape printing apparatus according to a sixth embodiment.

In FIG. 22, the tape cassette 301 is detachable in the cassette housing part 6 provided in the tape printing apparatus 410. Since the tape cassette 301 of the sixth embodiment has the same configuration as the tape cassette 301 of the fifth embodiment, further description thereof is hereby omitted.

Figure 23:
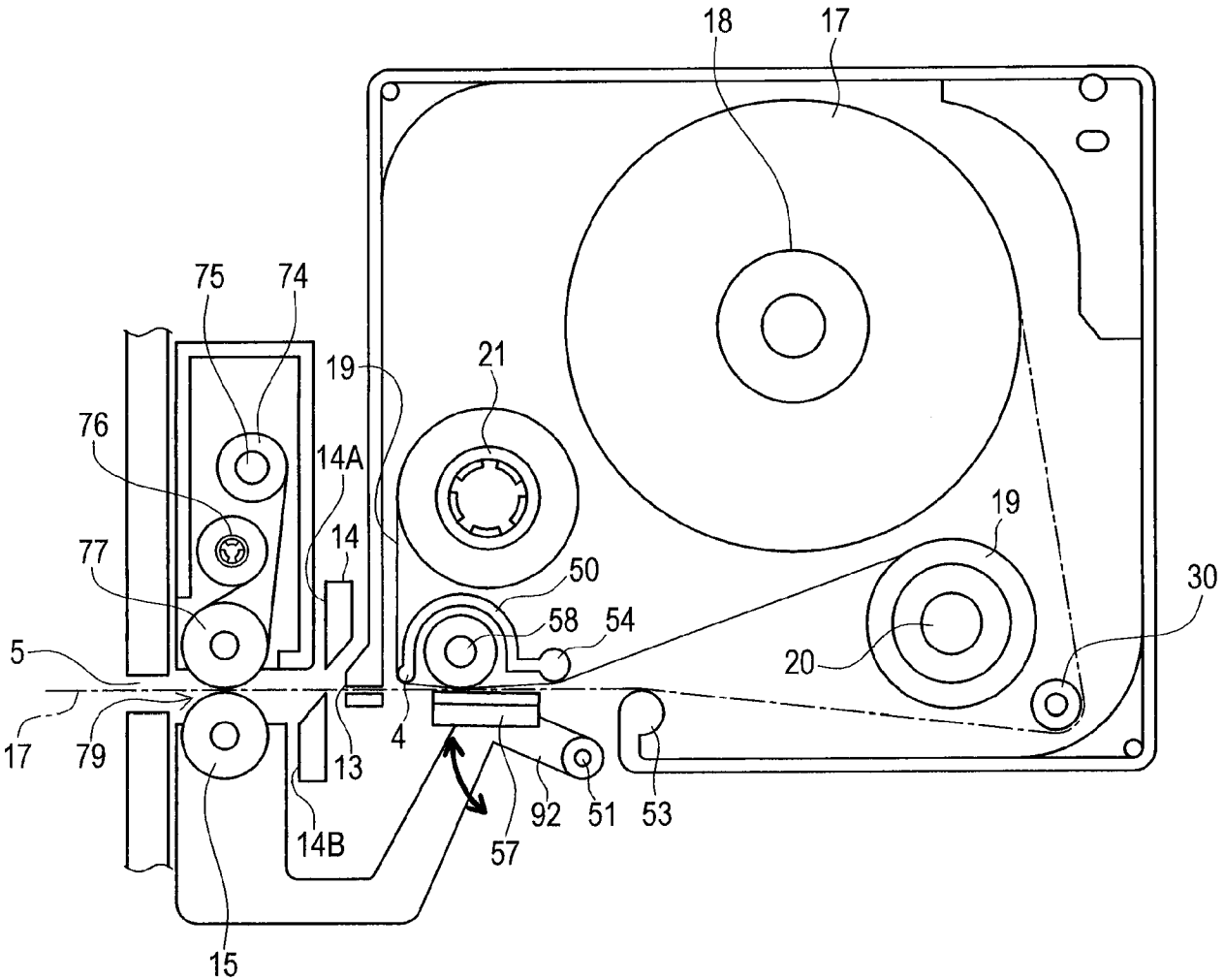
FIG. 23 is a plan view showing a pattern of an internal configuration of the tape cassette according to the sixth embodiment.

As shown in FIG. 23, the auxiliary cassette 70 is detachable in the cassette housing part 6 provided in the tape printing apparatus 410. The auxiliary cassette 70 is provided with an auxiliary sheet medium spool 75 onto which an auxiliary sheet medium 74 is wound, as shown in FIG. 23. The auxiliary cassette 70 is also provided with an auxiliary sheet medium take-up spool 76 that draws and takes up the auxiliary sheet medium 74 from the auxiliary sheet medium spool 75. Further, the conveying roller 77 is rotatably provided in the auxiliary cassette 70, with a portion thereof being exposed from the auxiliary cassette 70. At the time of printing, the conveying roller 77 faces the heat roller 15 of the tape printing apparatus 410. A portion of the feed roller 77 is exposed from the auxiliary cassette 70. At the time of printing, the feed roller 77 faces the heat roller 15 provided in the tape printing apparatus 410.

At the time of printing, the auxiliary sheet medium 74 is fed to the conveying roller 77, which further feeds it in a downstream direction together with the film tape 17. The auxiliary sheet medium 74 and the film tape 17 are then fed to an auxiliary sheet medium take-up spool 76. In other words, since the film tape 17 and the auxiliary sheet medium 74 come into contact at the time of printing, the conveying roller 77 does not touch the film tape 17. The position at which the film tape 17 and the auxiliary sheet medium 74 come into contact is the position at which the heat roller 15 and the conveying roller 77 face each other, as shown in FIG. 23.

The configuration of the tape housing part 6 in the tape printing apparatus 410 will now be described. As shown in FIG. 22 and FIG. 23, the cassette housing part 6 of the tape printing apparatus 410 has a thermal head 57 mounted on the head supporting member 92 which is arranged so as to be able to rotate around the head supporting shaft 51. The thermal head 57 is tabular with a substantially rectangular shape in a longitudinal direction thereof when viewed from the front as shown in FIG. 23, and has a predetermined number of heat generating elements formed at a left margin of a front surface thereof and aligned along the left margin. The cassette housing part 6 has a platen roller 58 rotatably supported therein. The head supporting member 92 is biased in a counterclockwise direction around the head supporting shaft 51 by an elastic member which is not shown. At the time of printing onto the film tape 17, the head supporting member 92 is driven in a clockwise direction by a motor or the like, thereby enabling the heat roller to come into contact and move away with respect to the conveying roller 77.

The cassette housing part 6 has the auxiliary sheet medium take-up shaft 73 that is coupled to the auxiliary sheet medium take-up spool 76 of the auxiliary cassette 70. The auxiliary sheet medium take-up shaft 73 is coupled to a driving mechanism such as a motor or the like, not shown, and serves to drive and rotate the auxiliary sheet medium take-up spool 76. The cassette housing part 6 is also provided with a conveying roller shaft 72. The conveying roller shaft 72 is coupled to a driving mechanism such as a motor and the like, not shown, and serves to drive and rotate the conveying roller 77.

The heat roller 15 is arranged downstream of the cutter unit 14 for heating the adhesive layer formed in the film tape 17. The post-printing film tape 17 is discharged to the exterior of the tape printing apparatus 410 through the cooperation of the heat roller 15 and the tape conveying roller 77. For convenience of the description to follow, the pair including the heat roller 15 and the tape conveying roller 77 may be denoted as the pair of conveying rollers 79. The auxiliary sheet medium take-up spool 76 as well is driven to rotate and thus convey the auxiliary sheet medium, together with the post-printing film tape 17 through the cooperation of the heat roller 15 and the tape conveying roller 77.

After characters and the like are printed onto the film tape through the ink ribbon 19 and the thermal head 57, and the ink ribbon 19 is separated therefrom through the separating member 4, the film tape 17 is discharged to the exterior of the tape cassette 301 from the tape discharging port 13 and is further discharged to the exterior of the tape printing apparatus 410 through the pair of conveying rollers 79. At this time, the adhesive layer of the film tape 17 is heated by the heat roller 15 of the pair of conveying rollers 79, thereby making the adhesive layer exhibit adhesive properties.

Since the ink ribbon and the printing tape according to the sixth embodiment have the same configuration as that described in the fifth embodiment (refer to FIG. 19), further description thereof is hereby omitted. Also, since the transfer mechanism in which the ink layer is transferred to the adhesive layer upon being heated by the thermal head 57, according to the sixth embodiment is the same as the mechanism in the fifth embodiment (refer to FIG. 20 and FIG. 21), further description thereof is hereby omitted.

The film tape 17 onto which characters and the like are printed is drawn up to the clipper-type cutter unit 14 serving as a cutting device, through the cooperation of the tape conveying roller 77 and the heat roller 15, as described above. The post-printing film tape 17 can thus be cut to a predetermined length through the cooperation of the fixed blade 14A and the movable blade 14B of the cutter unit 14. The cut film tape 17 passes between the tape conveying roller 77 and the heat roller 15 and upon being heated, starts exhibiting adhesive properties in the adhesive layer 33 at portions other than portions where the ink layer 34 has been adhered. The post-printing film tape 17 exhibiting adhesive properties is then discharged to the exterior of the printing apparatus as a linerless tape as was cut.

As described above, the adhesive agent of the post-printing film tape 17 exhibits adhesive properties upon being heated by the heat roller 15. Here, if the adhesive force of the post-printing film tape 17 is strong, there is a risk that the adhesive agent will be transferred to the surface coming in contact with the adhesive layer. In the sixth embodiment, the auxiliary sheet medium 74 and the adhesive surface of the post-printing film tape 17 are configured so as to come into contact with each other. Unused portions of auxiliary sheet medium 74 that come into contact with the adhesive surface are continuously fed to the pair of conveying rollers 79 by the auxiliary sheet medium take-up spool 76. In this way, the adhesive agent of the post-printing film tape 17 never adheres to the tape conveying roller 77. Even if the adhesive agent of the post-printing film tape 17 adheres to the auxiliary sheet medium 74, since the auxiliary sheet medium 74 is fed to the auxiliary sheet medium take-up spool 76, the auxiliary sheet medium 74 to which the adhesive agent has adhered never adheres to the post-printing film tape 17 that is to be subsequently fed.

As described in the above, since the tape cassette 301 does not house the adhesive tape spool and the pasting roller and the tape conveying roller 77 and the heat roller 15 are arranged downstream of the cutter unit 14, the post-printing film tape 17 can be cut by the cutter unit 14 arranged immediately downstream of the thermal head 57 right after characters and the like have been printed onto the film tape 17. This makes it possible to shorten front blank space of the post-printing film tape 17, thereby reducing the running cost of the film tape 17.

Further, when the heat roller 15 heats the target layer to 80° C. or above but below 90° C. the temperature inside the ink layer becomes 60° C. or above, but because the ink used in the ink layer 34 is a low melting point-type ink (the melting point of the ink becomes 60° C. or above), the ink is once fused in the adhesive agent having high viscosity at the time of character printing. As a result, melting of the ink under the heat from the heat roller 15 becomes difficult, thereby eliminating the risk of faulty printing caused by ink re-melting when being heated by the heat roller 15. Here, the release adhesive layer is also transparent. Needless to say, the adhesive layer present between the film layer and the ink layer is necessarily transparent or semi-transparent, to thus make the ink layer visible through the transparent film.

Since the heat roller 15 comes into contact with the film tape 17 onto which characters and the like are printed from the release agent layer 31 side (back surface side of the adhesive layer 33), direct contact with the adhesive layer 33 can be avoided. As a result, the heated adhesive layer 33 does not adhere to the heat roller 15.

Since the heated adhesive layer 33 maintains its adhesive properties even after its temperature decreases, the user can paste the linerless tape produced as described above onto the target body. As a result, the user no longer needs to remove the release sheet, as was done in the case of using the conventional laminated tape. Further, since the transferred ink layer 34 is printed as mirror image with respect to the film tape 17, as described above, the user can recognize the characters and the like printed as normal image, through the transparent film.

In the sixth embodiment, since the adhesive layer of the post-printing film 17 does not touch the conveying roller 77 when the post-printing film 17 is heated, there is no risk of the adhesive agent adhering to the conveying roller 77. This can prevent faulty conveyance and can also prevent the adhered adhesive agent from smearing on the printing tape 17.

The auxiliary sheet medium can employ a medium having a release adhesive layer coated on a surface thereof contacting the post-printing film 17. As a result, the auxiliary sheet medium 74 and the heated post-printing film 17 can be smoothly released, thereby enabling excellent tape conveyance.

Figure 24:
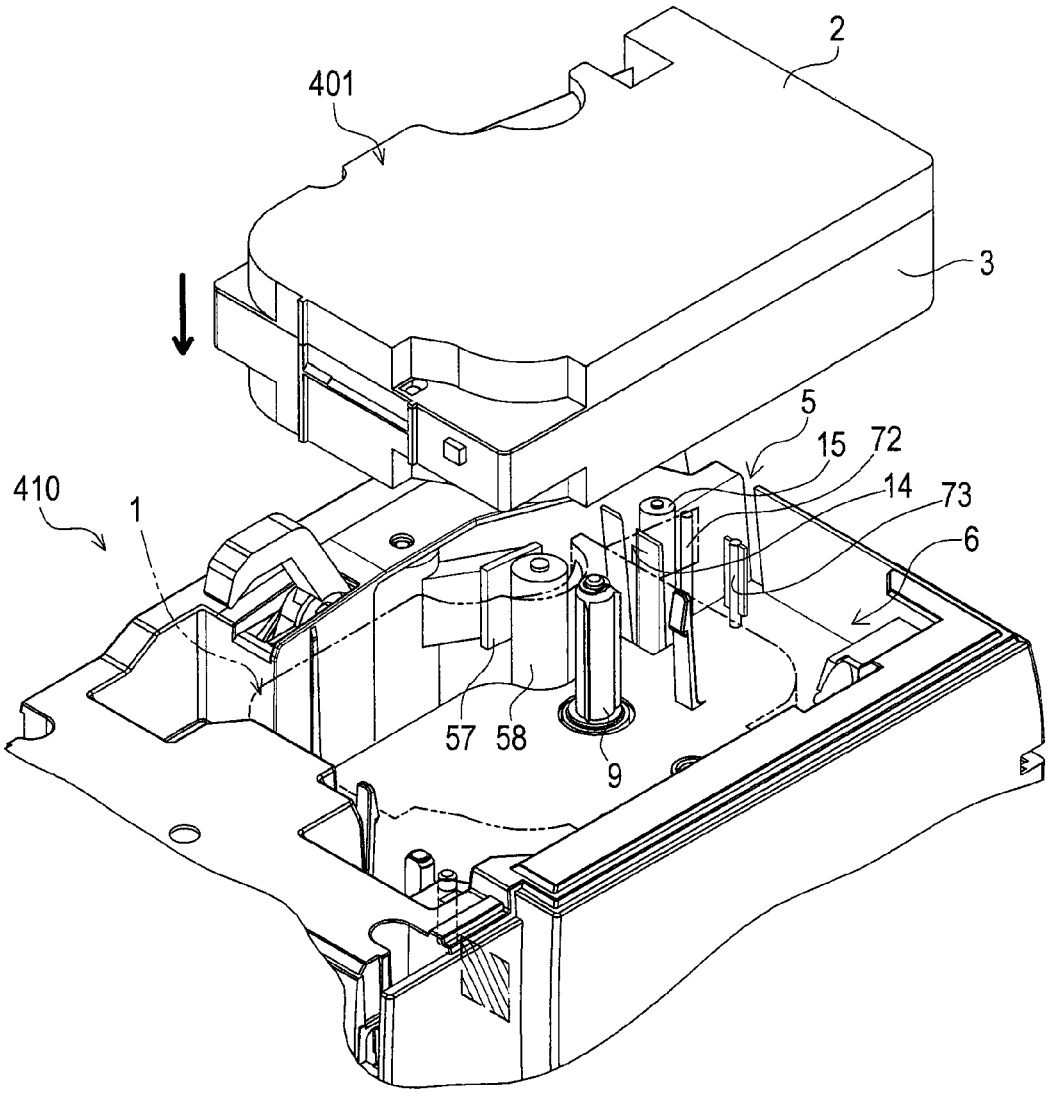
FIG. 24 is an enlarged perspective view of a relevant part showing mounting of the tape cassette in the cassette housing part of the tape printing apparatus according to the sixth embodiment.
Figure 25:
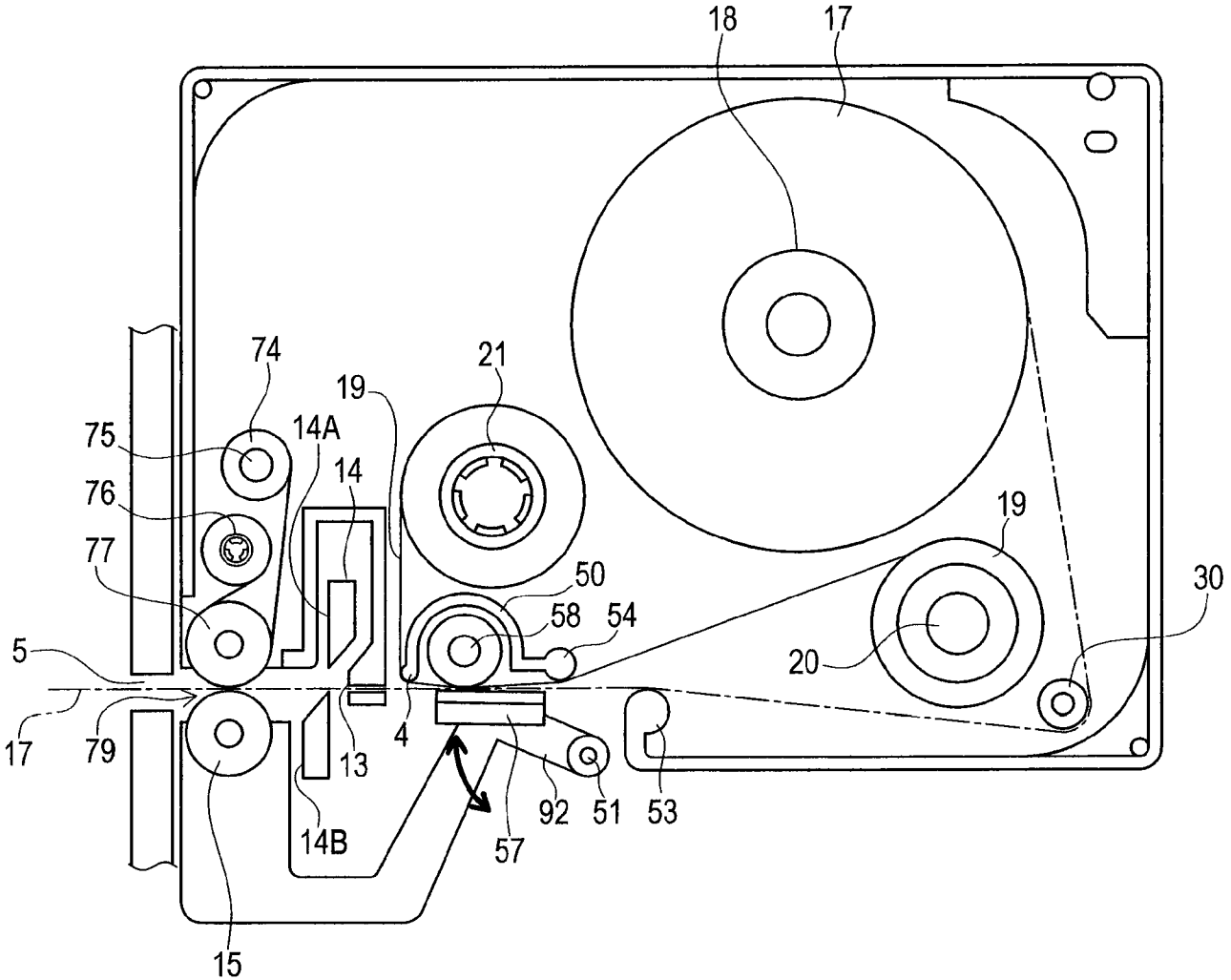
FIG. 25 is a plan view showing a pattern of an internal configuration of the tape cassette according to the sixth embodiment.

In the sixth embodiment, the tape cassette 301 and the auxiliary cassette 70 are configured separately), but the tape cassette and the auxiliary cassette can also be integrally configured, as shown in FIG. 24. In this case, the tape cassette 401 is provided with the auxiliary sheet medium 74, the auxiliary sheet medium take-up spool 76, the conveying roller 77, the film tape 17, the ink ribbon 19 and the like, as shown in FIG. 25. The tape cassette 401 has a cut-out portion, as shown in FIG. 25. If this cut-out portion is present between the conveying roller 77 and the tape discharge port 13. When the tape cassette 401 is mounted on the tape printing apparatus 410, the fixed blade 14A of the tape printing apparatus 410 is positioned in this cut-out portion. In the tape printing apparatus 410 using the tape cassette 401, as well, since the adhesive layer of the post-printing film tape 17 does not come into contact with the conveying roller 77 when the post-printing film tape 17 is heated, the adhesive agent does not adhere to the conveying roller 77, thereby making it possible to prevent faulty conveyance. Thus, even if the adhesive agent adheres to the auxiliary sheet medium 74, it is possible to prevent the adhesive agent that adhered to the auxiliary sheet medium from smearing on the post-printing film tape 17 that is subsequently fed.

The outer shape of the tape printing apparatus 410, the tape cassette 301, the tape cassette 401, and the auxiliary cassette 70 as shown in the description of the sixth embodiment is given as merely one example, and the present disclosure is not limited to this outer shape.

Other Embodiments

The tape printing apparatus and the like shown in the fifth embodiment and sixth embodiment as described above can employ the respective elements of the tape printing apparatus and the like shown in the third embodiment and fourth embodiment as described above.

Figure 26:
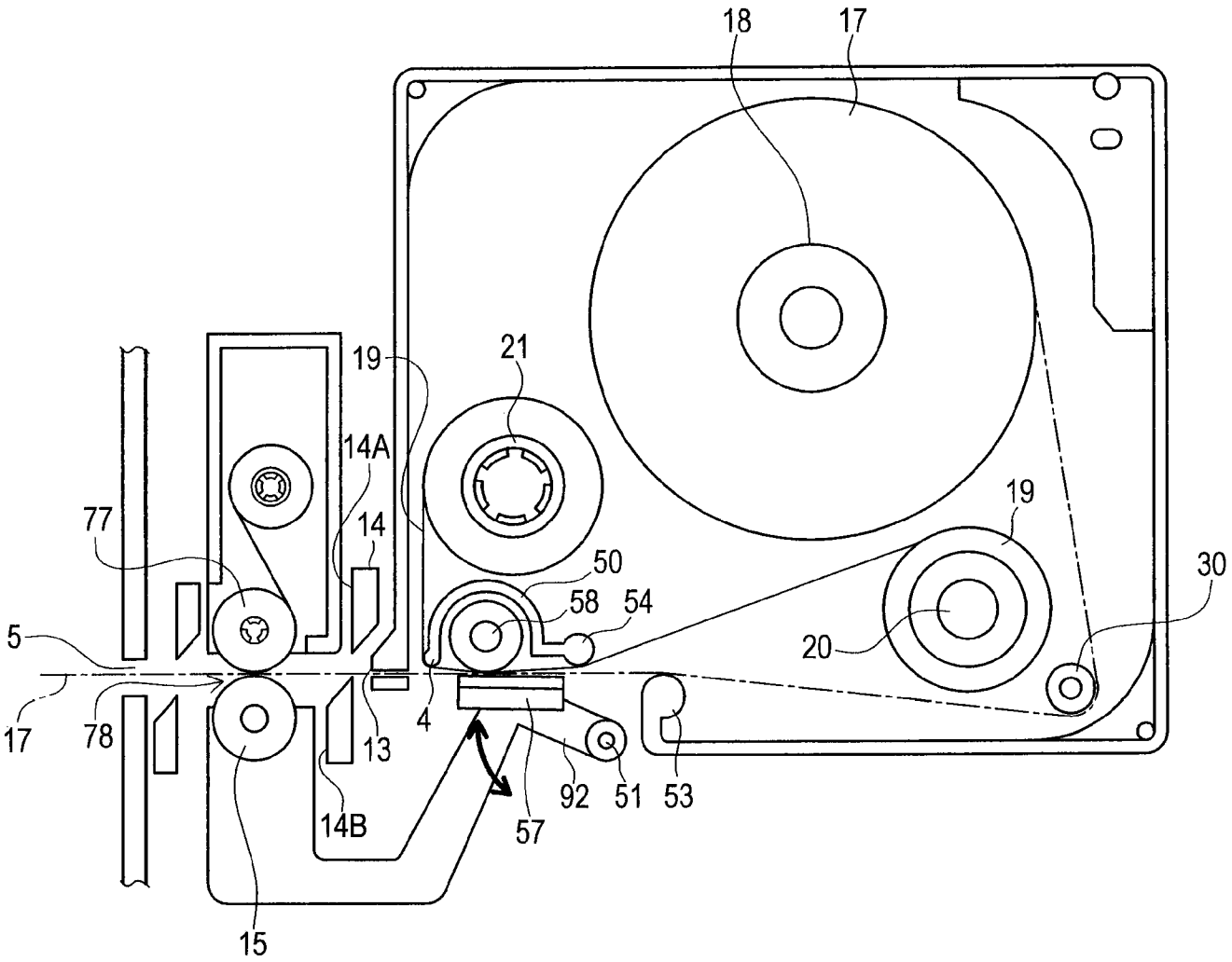
FIG. 26 is a plan view showing a pattern of an internal configuration of a tape cassette and an auxiliary cassette according to another embodiment.

For instance, as shown in FIG. 26, the tape printing apparatus may be configured so as to accommodate the auxiliary cassette 71.

Figure 27:
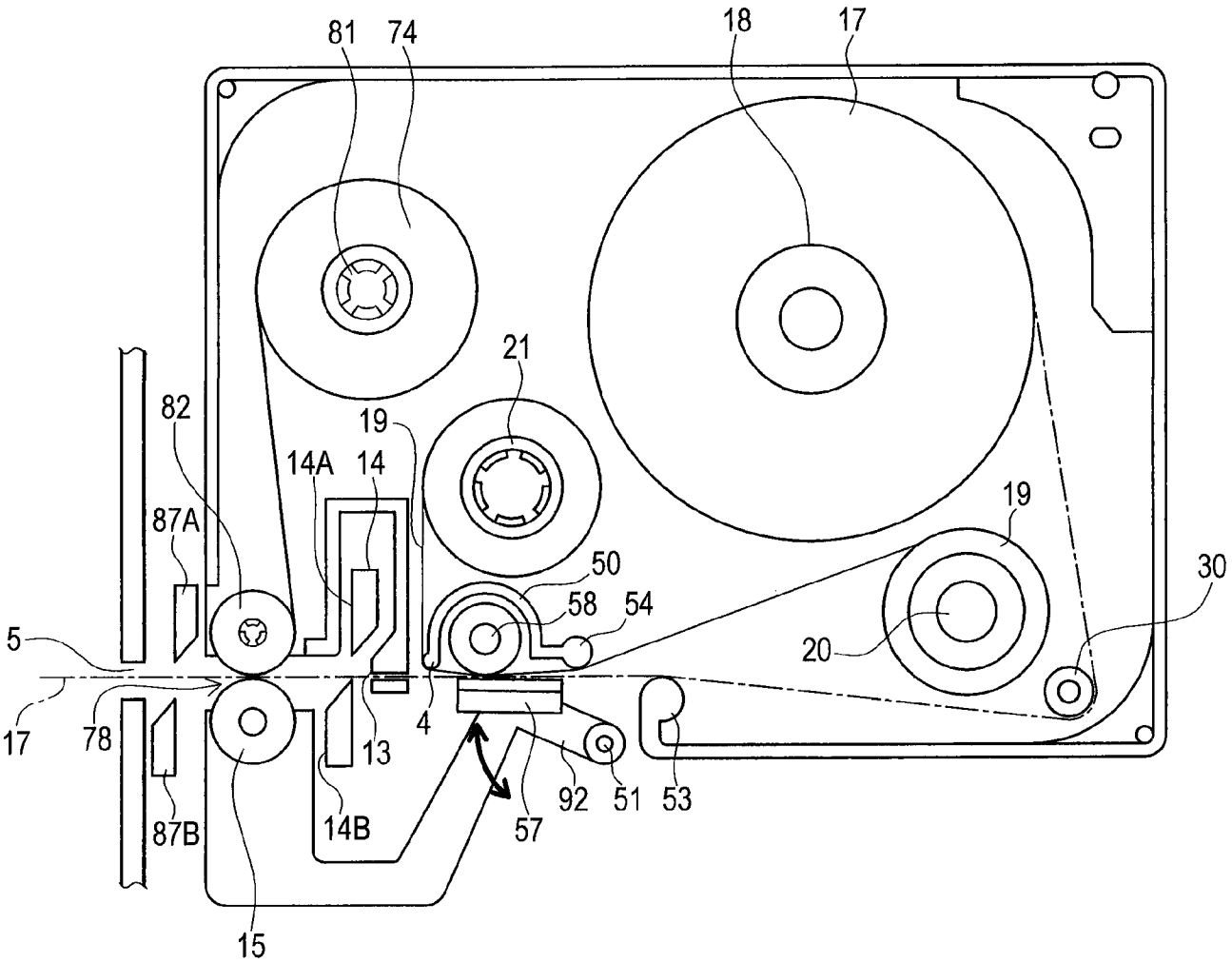
FIG. 27 is a plan view showing a pattern of an internal configuration of the tape cassette according to another embodiment.

Also, as shown in FIG. 27, the tape printing apparatus may be configured so as to accommodate the auxiliary sheet medium 74 in the tape cassette.

Figure 28:
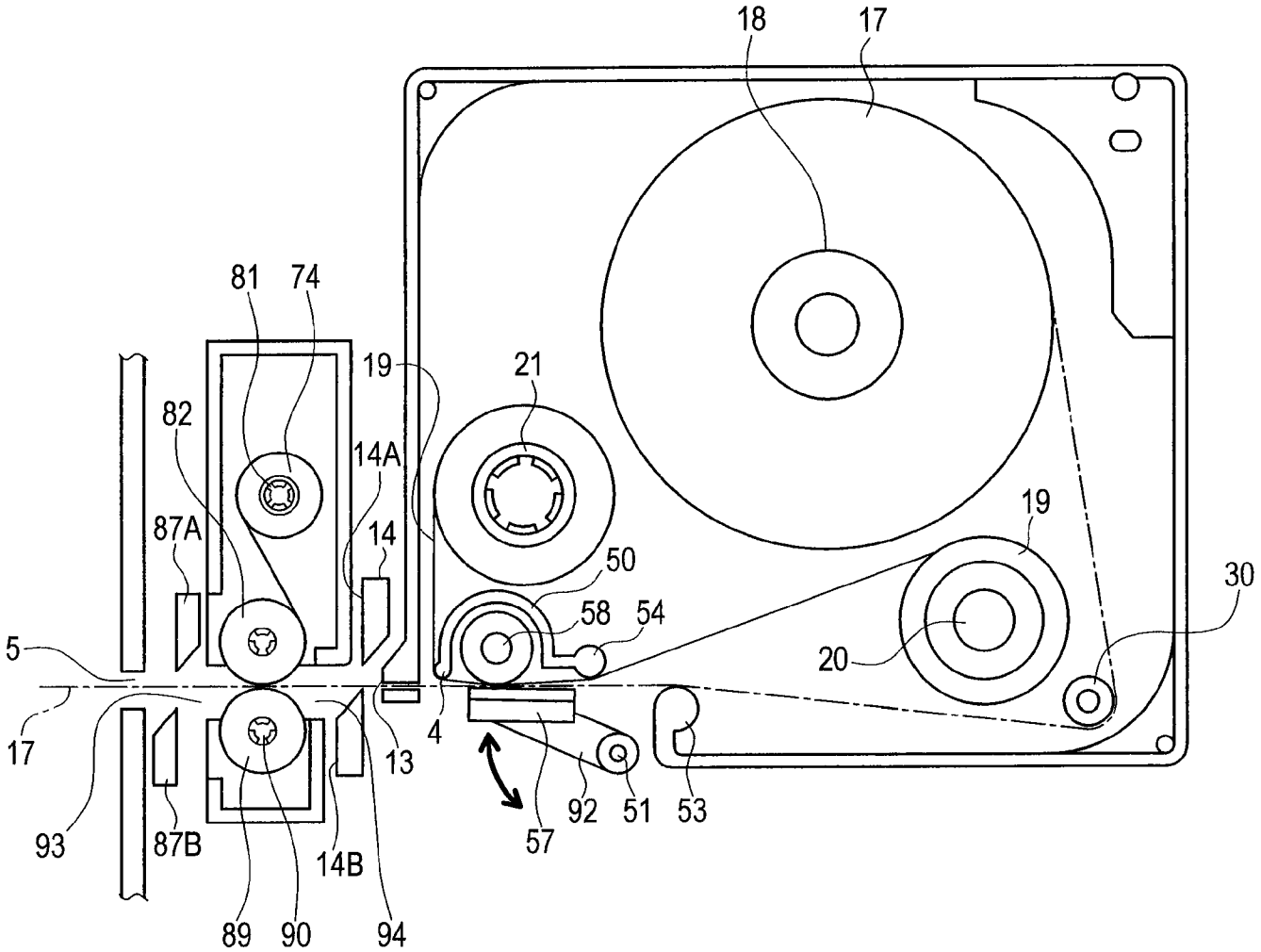
FIG. 28 is a plan view showing a pattern of an internal configuration of the tape cassette and the auxiliary cassette according to another embodiment.

Also, as shown in FIG. 28, the tape printing apparatus may be configured so as to accommodate the auxiliary cassette 88.

Figure 29:
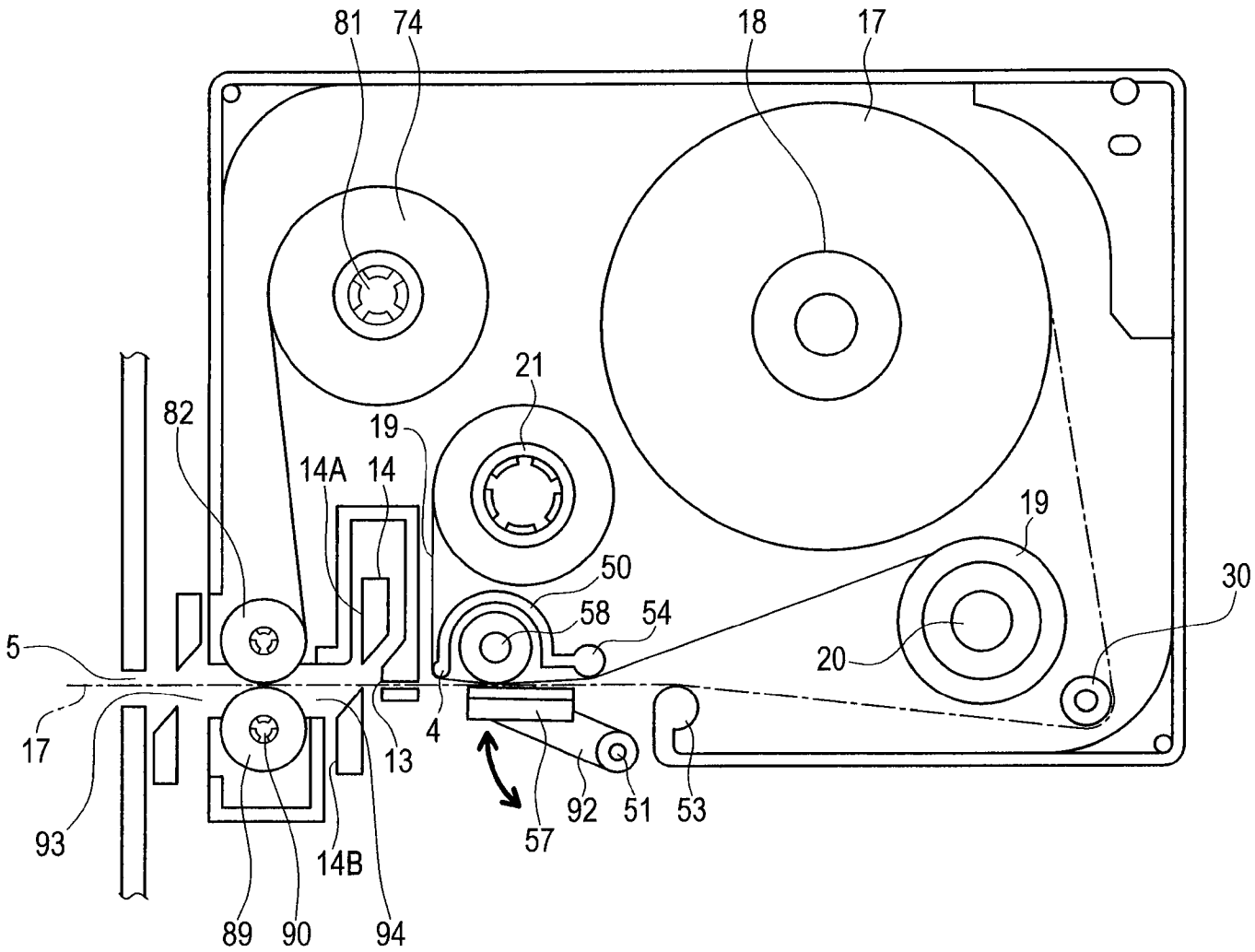
FIG. 29 is a plan view showing a pattern of an internal configuration of the tape cassette according to another embodiment.
Figure 30:
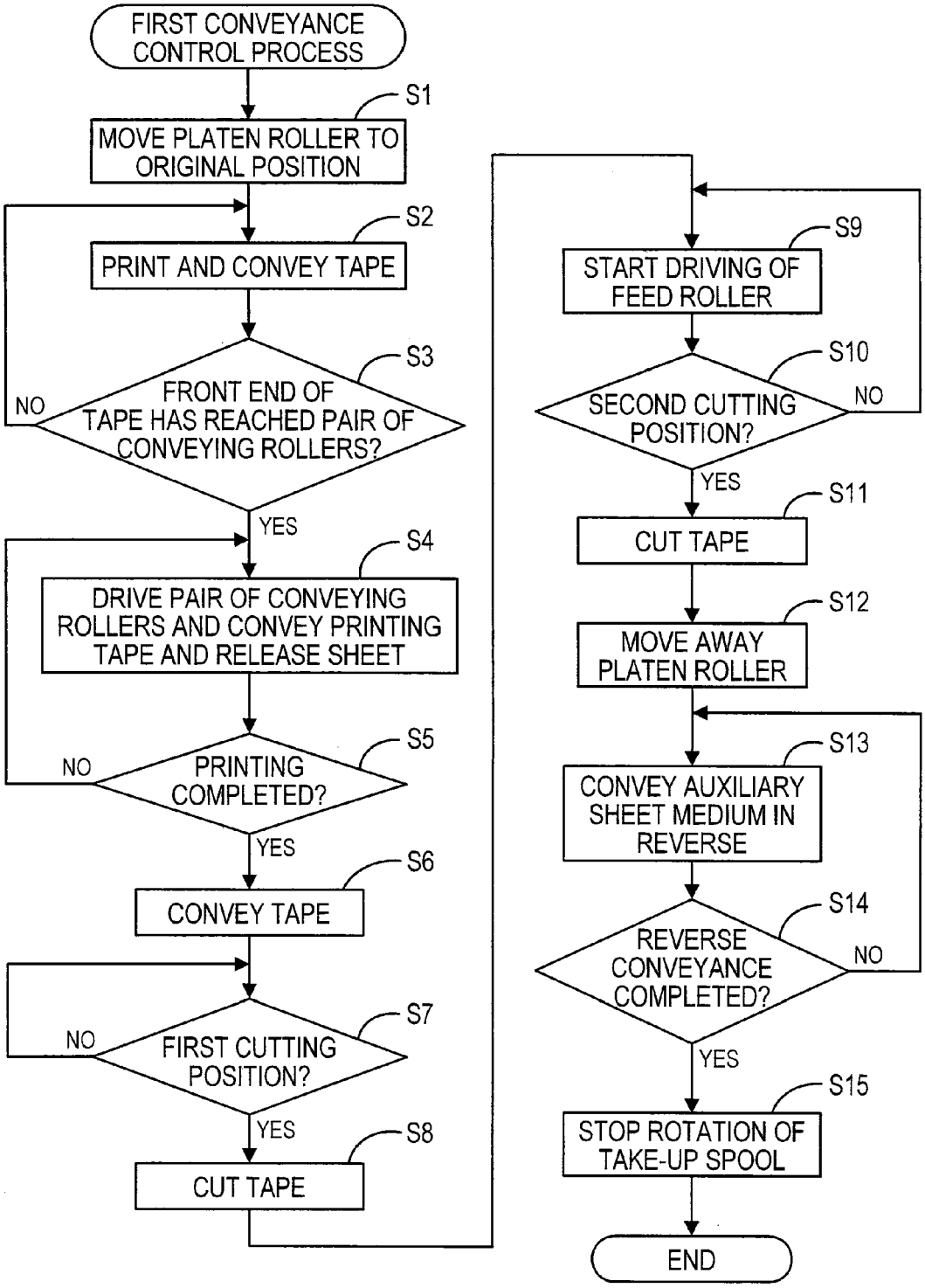
FIG. 30 is a flowchart showing a first conveyance control process.

Also, as shown in FIG. 29, the tape printing apparatus may be configured so as to accommodate the auxiliary sheet medium 74 and the heat roller 89 in the tape cassette.

Use of the above-described configurations will naturally require changes to a part of the configuration of the tape cassette.

The operation of the respective driving devices in the tape printing apparatus having the second cutter 87 as described above will next be described. The following description is based on the third embodiment as described above (FIG. 9 and FIG. 10), with the basic operation being the same in the other embodiments.

The first conveyance control process is executed by a processor (not shown) which is provided in the tape printing apparatus 510. Execution of the first conveyance control process is started by output of an instruction signal for print control.

Figure 31:
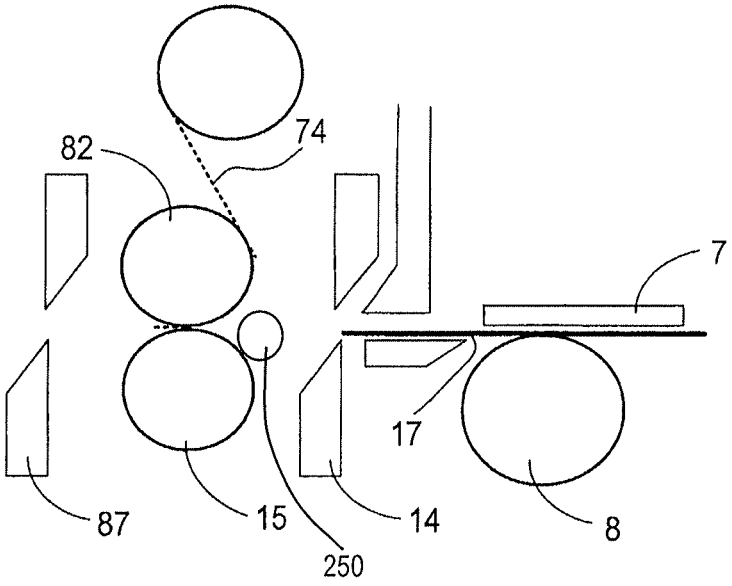
FIG. 31 is schematic diagram showing a condition where the auxiliary sheet medium and the film tape are conveyed.

First, at S1, the platen roller 8 is moved to its original position (refer to FIG. 31). At this time, the front end of the film tape 17 is located at the periphery of the cutter unit 14 (refer to FIG. 31).

At S2, the print operation to the film tape 17 and the conveyance operation of the film tape 17 are carried out. As these operations have already been described above, further description thereof is hereby omitted.

Figure 32:
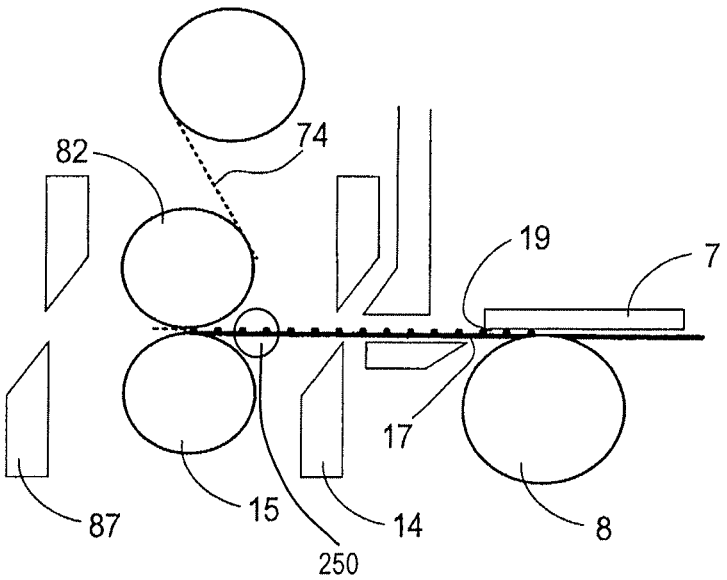
FIG. 32 is a schematic diagram showing a condition where the auxiliary sheet medium and the film tape are conveyed.

At S3, a judgment is made as to whether the front end of the film tape 17 has reached the pair of conveying rollers (heat roller 15 and feed roller 82). This judgment is carried out by calculating the amount of the conveyed film tape 17 based on the number of rotations of the platen roller. The front end of the film tape 17 may also be detected by use of a sensor 250 as shown, for example, in FIGS. 17, 31 and 32.

If it is judged that the front end of the printed film tape 17 has not reached the pair of conveying rollers (S3: NO), the flow returns to S2. As a result, during the period of time required by the front end of the printed film tape 17 to reach the pair of conveying rollers, the print operation and the conveying operation with respect to the film tape 17 are successively carried out.

If it is judged that the front end of the printed film tape 17 has reached the pair of conveying rollers (S3: YES), the flow proceeds to S4.

At S4, the drive operation of the pair of conveying rollers is started. The auxiliary sheet medium 74 is adhered to the printed film tape 17 (ink layer side) in accordance with the rotation of the pair of conveying rollers. The printed film tape 17 to which the auxiliary sheet medium 74 has been adhered is conveyed towards the second cutter 87.

Figure 33:
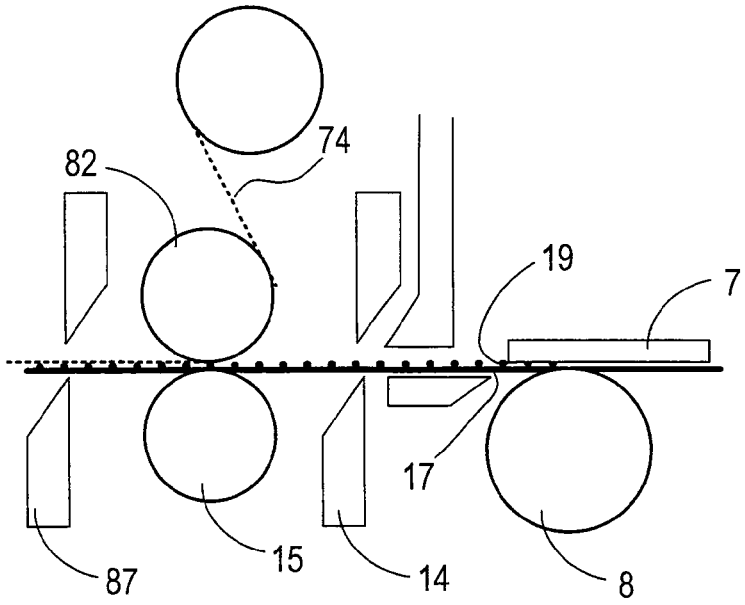
FIG. 33 is a schematic diagram showing a condition where the auxiliary sheet medium and the film tape are conveyed.

At S5, a judgment is made as to whether printing is completed. The operation at S4 (specifically, the print operation and the conveyance operation with respect to the film tape 17) is repeated until printing is completed (refer to FIG. 33).

Figure 34:
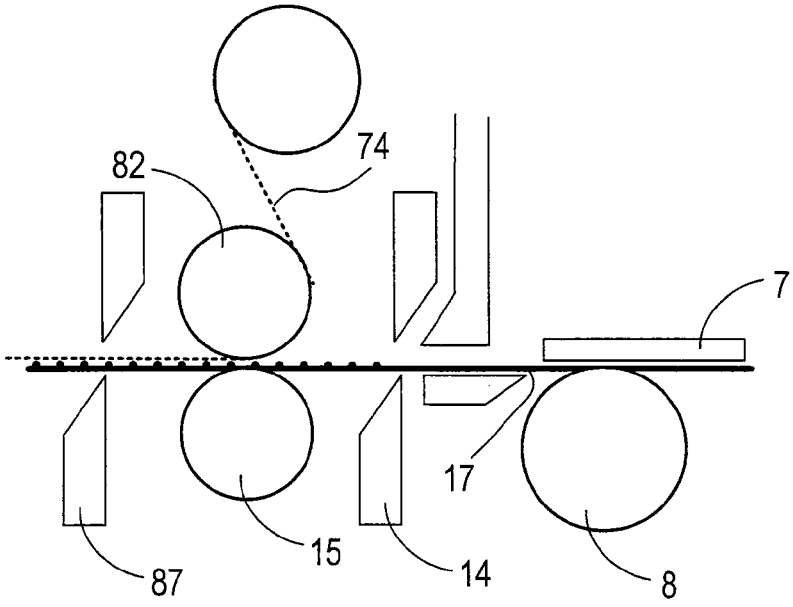
FIG. 34 is a schematic diagram showing a condition where the auxiliary sheet medium and the film tape are conveyed.
Figure 35:
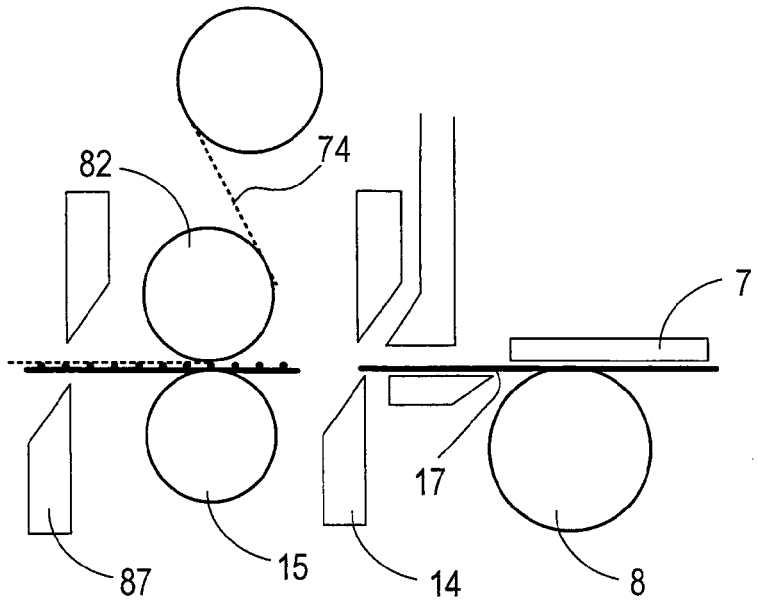
FIG. 35 is a schematic diagram showing a condition where the auxiliary sheet medium and the film tape are conveyed.
Figure 36:
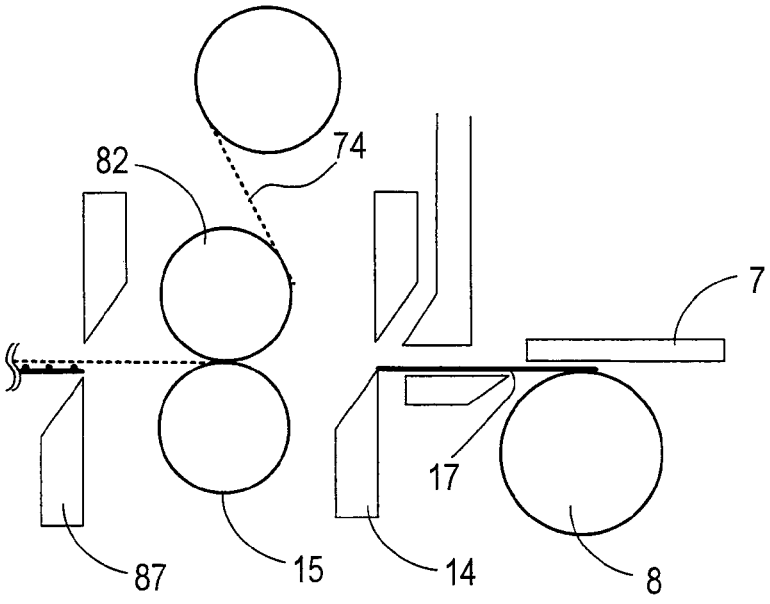
FIG. 36 is a schematic diagram showing a condition where the auxiliary sheet medium and the film tape are conveyed.
Figure 37:
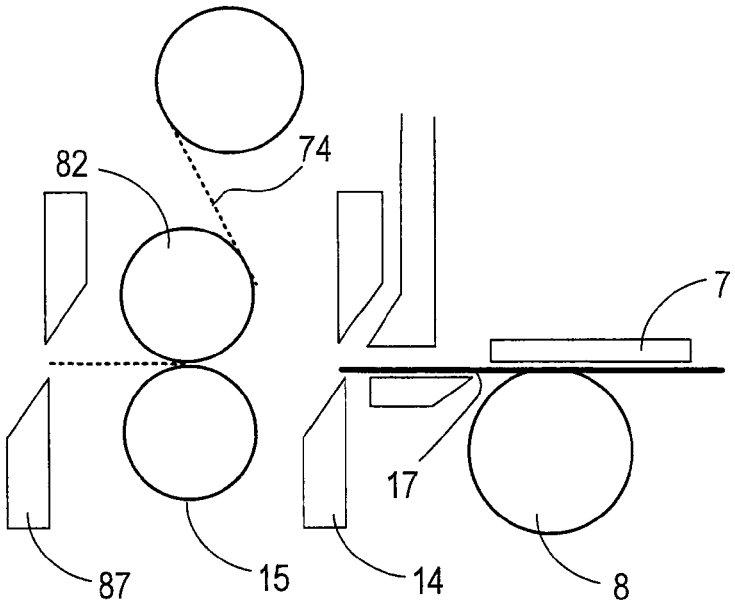
FIG. 37 is a schematic diagram showing a condition where the auxiliary sheet medium and the film tape are conveyed.

If it is judged that printing has been completed (S5: YES), the flow shifts to S6. At S6, the printed film tape 17 is conveyed towards the pair of conveying rollers (refer to FIG. 34).

At S7, a judgment is made as to whether the back end of the printed film tape 17 is present at the cutting position (first cutting position) by the cutter unit 14 (first cutter). This judgment is carried out using the amount of the conveyed film tape 17 which is calculated based on the amount of rotation of the platen roller 8. A judgment may be made as to whether cutting will be made at the first cutting position by printing predetermined contents at a first cutting scheduled position and then reading the printed contents by a sensor which is not shown here.

If it is judged that the back end of the printed film tape 17 is not present at the first cutting position (S7: NO), the flow returns to S6. As a result, during the time required by the printed film tape 17 to be conveyed to the first cutting position, the conveying operation of the printed film tape 17 is carried out successively.

On the other hand, if it is judged that the back end of the printed film tape 17 is present at the first cutting position (S7: YES), the flow shifts to S8.

At S8, the printed film tape 17 is cut. At this time, the movable blade 14B is driven and controlled. At the time the printed film tape 17 is cut, driving of the rotating platen roller 8 is stopped.

After the printed film tape 17 has been cut, the flow shifts to S9.

At S9, rotation driving of the heat roller 15 is started again. Since the printed film tape 17 has been cut, the platen roller 8 is not driven to rotate. As a result, the printed film tape 17 that was cut is conveyed by rotation driving of the heat roller 15.

At S10, a judgment is made as to whether the back end of the printed film tape 17 is present at the cutting position (second cutting position) by the second cutter 87 (second cutter). This judgment is carried out based on the amount of the conveyed printed film tape 17 that is calculated based on the rotation amount of the heat roller 15.

If it is judged that the back end of the printed film tape 17 is not present at the second cutting position (S10: NO), the flow returns to S9. As a result, during the time required by the printed film tape 17 to be conveyed to the second cutting position, the conveyance operation of the printed film tape 17 is successively carried out.

On the other hand, if it is judged that the back end of the printed film tape 17 is present at the second cutting position (S10: YES), the flow shifts to S11.

At S11, the auxiliary sheet medium 74 is cut. At this time, the movable blade 87B is driven and controlled. At the time the auxiliary sheet medium 74 is cut, driving of the heat roller 15 is stopped.

After the auxiliary sheet medium 74 has been cut, the flow shifts to S12.

At S12, the platen roller 8 is moved away from the thermal head 7. Then, the flow shifts to S13.

At S13, the auxiliary sheet medium 74 is conveyed in a reverse direction. More specifically, the auxiliary sheet medium 74 is rewound in a reverse direction with the conveying direction at the time of printing. At this time, the auxiliary sheet medium spool 81 is rotated in a reverse direction with the rotation direction at the time of printing. As a result, the auxiliary sheet medium 74 is rewound onto the auxiliary sheet medium spool 81.

At S14, a judgment is made as to whether to terminate the reverse conveyance of the auxiliary sheet medium 74. This judgment is carried out based on the amount of the auxiliary sheet medium 74 that was conveyed in a reverse direction, which is calculated based on the amount of rotation of the feed roller 82. When the front end portion of the auxiliary sheet medium 74 has been rewound up to near the heat roller 15, the reverse conveyance is terminated.

If it is judged not to terminate the reverse conveyance of the auxiliary sheet medium (S14: NO), the flow returns to S13. As a result, during the time required until reverse conveyance of the auxiliary sheet medium 74 is completed, the rewind operation of the auxiliary sheet medium 74 is successively carried out.

On the other hand, if it is judged to terminate the reverse conveyance of the auxiliary sheet medium (S14: YES), the flow shifts to S15.

At S15, reverse rotation driving of the auxiliary sheet medium spool 81 is stopped.

Figure 38:
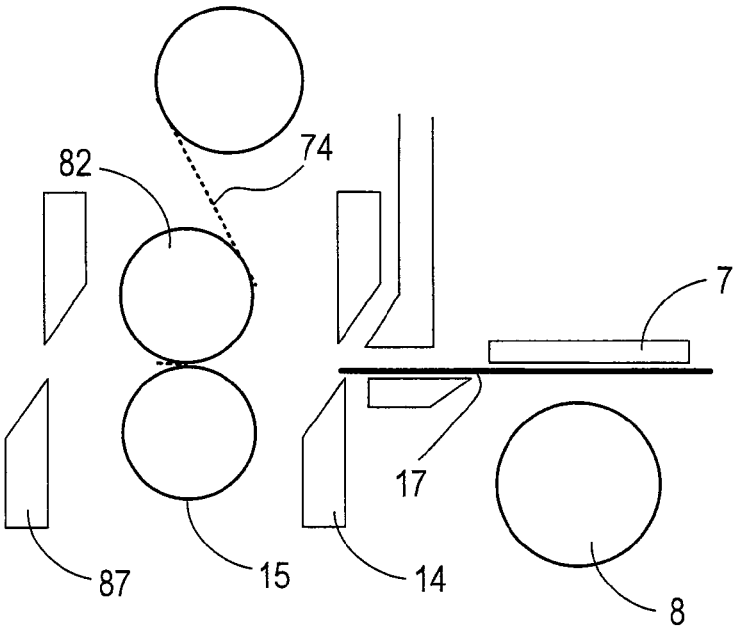
FIG. 38 is a schematic diagram showing a condition where the auxiliary sheet medium and the film tape are conveyed.
Figure 39:
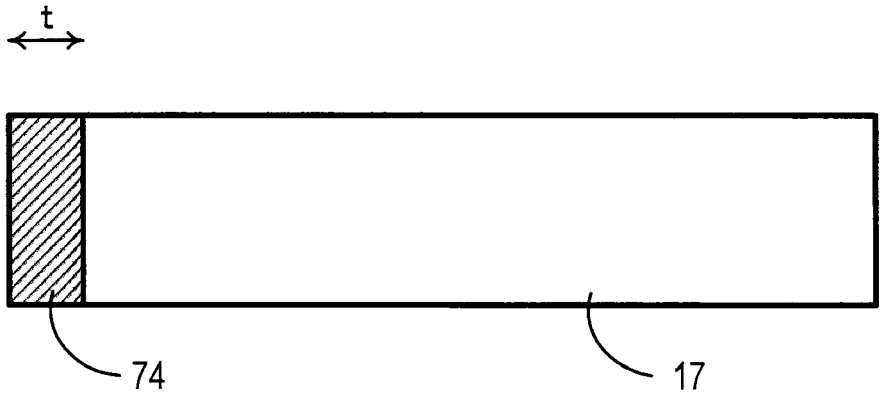
FIG. 39 is a schematic diagram showing a location of the auxiliary sheet medium on the produced printing tape.

In the above processes, after the printed film tape 17 has been cut by the second cutter 87, the auxiliary sheet medium 74 is rewound onto the auxiliary sheet medium spool 81. The auxiliary sheet medium 74 can thus be efficiently used. The front end portion of the rewound auxiliary sheet medium 74 stays at the position shown in FIG. 38 until the next adhering operation. Thus, the film tape 17 thus formed includes only a portion of auxiliary sheet medium 74 having length "t", as shown in FIG. 39. As a result, the film tape 17 thus formed can be stored in a state in which the auxiliary sheet medium 74 can be easily peeled off therefrom.

Figure 40:
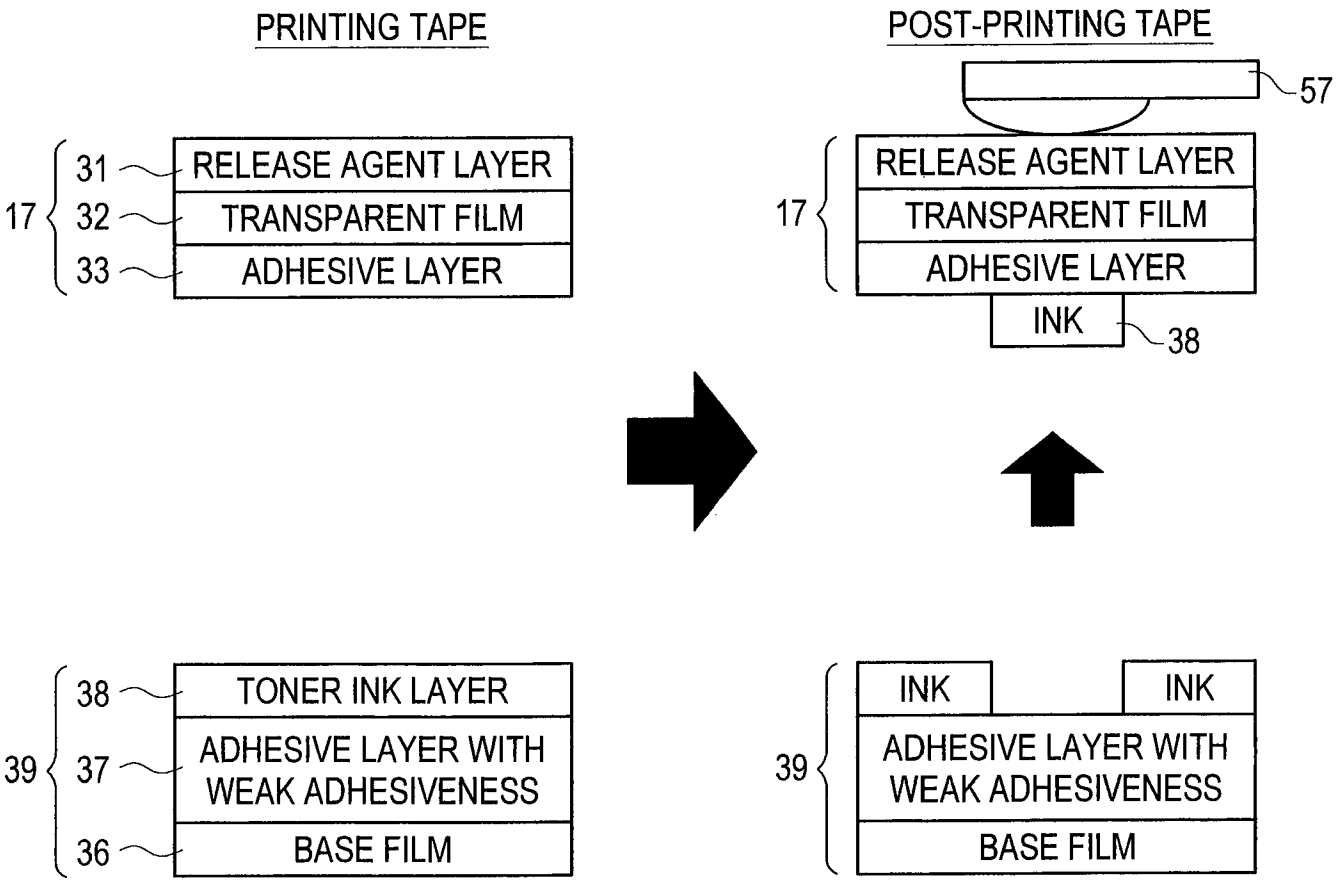

In the fifth embodiment and the like, it is possible to employ a toner ink ribbon 39 comprising a toner ink layer 38 which has toner ink applied on one surface thereof through an adhesive layer having weak adhesive properties with respect to the base film 36 as shown in FIG. 40.

According to a transfer mechanism in which an ink layer is transferred to the adhesive layer upon being heated by the thermal head 57, the adhesive layer 33A of the film tape 17 heated by the thermal head 57, similarly with FIG. 21, is heated to a temperature of 80° C. or above but below 90° C., which is equal to or higher than its melting temperature, thereby exhibiting adhesive properties. Then, the toner ink layer 38 of the toner ink ribbon 39 which came in contact with the adhesive layer 33A of the film tape 17 is adhered to the adhesive layer 33A, thereby being transferred to the film tape 17. In this case, the toner ink does not melt at a temperature below 90° C. and is transferred to the film tape 17 in a powdery state.

The post-printing film tape 17 passes between the tape conveying roller 16 and the heat roller 15, and upon being heated by the heat roller 15 to 80° C. or above but below 90° C., its adhesive layer 33B exhibits adhesive properties, and the toner ink is kept in a transferred state to the film tape 17 without melting.

Accordingly, heating of the post-printing film tape 17 does not cause the ink to melt, thereby eliminating the risk of faulty printing.

Seventh Embodiment

Next, a tape cassette and a tape printing apparatus according to a seventh embodiment will be described based on FIG. 41 and FIG. 42. In the following description, elements which are the same as those of the tape cassettes and the tape printing apparatuses according to the above-described embodiments are denoted by the same numerical symbols.

(Printing Tape Cassette)

First, a tape cassette 701 will be explained. As shown in FIG. 41, the tape cassette 701 is detachable in a cassette housing part 6 provided in a tape printing apparatus 710.

The tape cassette 701 has an upper case 2 and a lower case 3. The upper case 2 serves as a lid member for covering an upper surface of the lower case 3. The lower case 3 has a printing tape spool 118, a ribbon spool 20 and a ribbon take-up spool 21 (refer to FIG. 42).

A printing tape 117 is wound on the printing tape spool 118. The printing tape 117 is a tape of long length. The detail of the printing tape 117 will be described later. An ink ribbon 19 is wound on the ribbon spool 20. The ribbon take-up spool 21 draws out the ink ribbon 19 from the ribbon spool 20 and takes up the ink ribbon 19 consumed in printing of characters and the like.

The tape cassette 701 has a tape guiding skid 30, a guiding pin 42 and an opening 43 which regulate a conveying position of the printing tape 117.

The tape cassette 701 has a regulating protruding part 44 and a regulating protruding part 45 which regulate a conveying position of the ink ribbon 19.

The tape cassette 701 has a head insertion opening 40 formed therein. The head insertion opening 40 passes through the upper case 2 and the lower case 3. Upon loading the tape cassette 701 in the cassette housing part 6 of the tape printing apparatus 710, a thermal head 7 is inserted in the head insertion opening 40.

Figure 42:
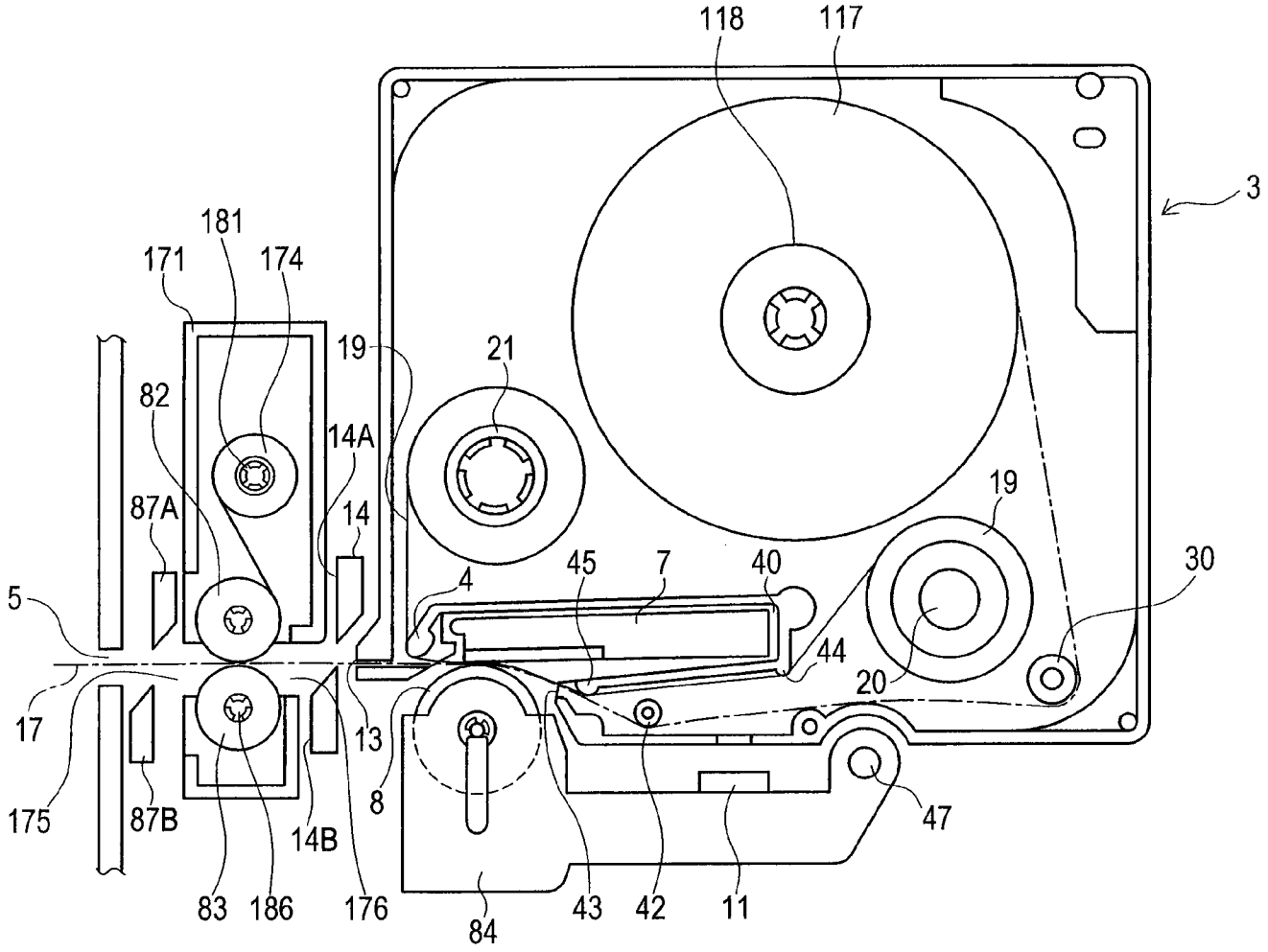
FIG. 42 is a plan view showing a pattern of an internal configuration of the tape cassette and the auxiliary cassette according to the seventh embodiment.

The tape cassette 701 has a separating member 4 formed thereon (refer to FIG. 42). The separating member 4 regulates a conveying position of the ink ribbon 19. The separating member 4 further has the function of separating the printing tape 117 laminated at a printing position (to be described later) and the ink ribbon 19.

The tape cassette 701 has a discharge port 13 formed therein. The printed printing tape 117 is discharged to the exterior of the tape cassette 701 through the discharge port 13.

The tape cassette 701 has an identification portion (for indicating the type of a tape cassette) to be read by a type identifying sensor (to be described later) provided in the tape printing apparatus 710.

(Auxiliary Cassette)

Next, the auxiliary cassette 170 will be described. As shown FIG. 41, the auxiliary cassette 170 is detachable in the cassette housing part 6 provided in the tape printing apparatus 710.

Further, the auxiliary cassette 170 is mounted between a cutter unit 14 and a second cutter unit 87 in the cassette housing part of the tape printing apparatus 710, as shown in FIG. 42.

The auxiliary cassette 170 has a tape spool 181, a feed roller 82 and a feed roller 83. A laminating film 174 is wound on the tape spool 181. One side of the laminating film 174 has an adhesive agent applied thereto. The details of the laminating film 174 will be described later.

The feed roller 82 and the feed roller 83 are arranged rotatably in the auxiliary cassette 170. Further, release treatment (such as silicon treatment) is applied to the surface of the feed roller 83 so that the adhesive agent of the laminating film 174 is not adhered.

The outer shape of the auxiliary cassette 170 is defined by the cassette case 171. In other words, the auxiliary cassette 170 is configured so that the laminating film 174, the feed roller 82 and the feed roller 83 are accommodated inside the cassette case 171.

The cassette case 171 is provided with a tape discharge port 175 and a tape entry port 176 (refer to FIG. 42). The printed tape 117 to which the laminating film 174 has been adhered is discharged from the tape discharge port 175. The printed printing tape 117 enters the auxiliary cassette 170 through the tape entry port 176.

Even if not accommodated in the cassette housing part 6, the front end of the laminating film 174 is kept clamped between the feed roller 82 and the feed roller 83. This makes it possible to prevent the adhesive agent of the laminating film 174 from unnecessarily adhering to an extra portion. It becomes also possible to prevent inappropriate adherence of a transparent adhesive tape to a printing tape caused by misfeeding of the transparent adhesive tape. Furthermore, when not conducting a conveyance operation, the adhesive force to the contiguous feed roller 83 prevents the laminating film 174 from moving backward inside the tape cassette.

(Cassette Housing Part)

Next, the cassette housing part 6 of the tape printing apparatus 710 and elements arranged therearound will be explained.

Figure 41:
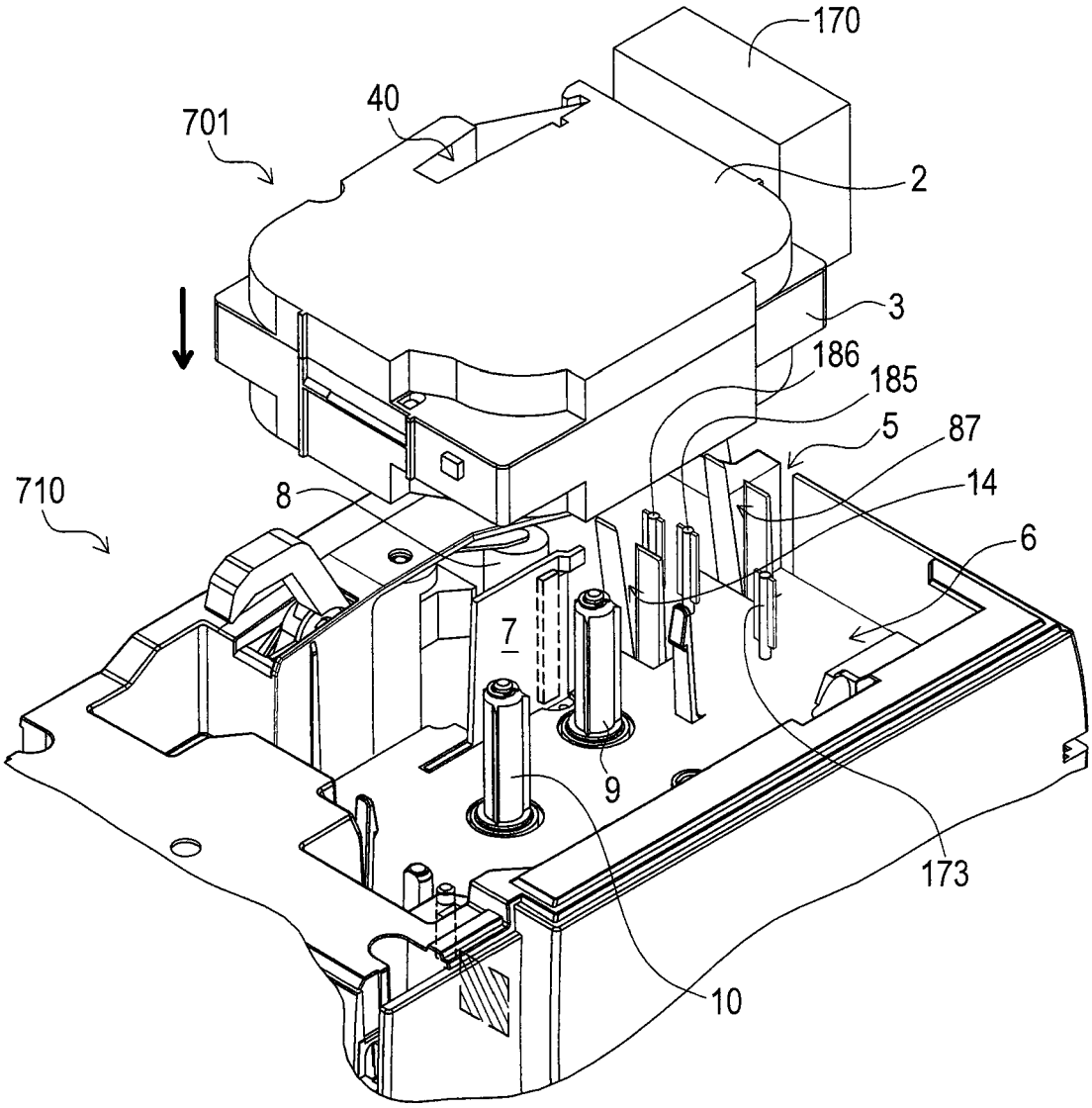
FIG. 41 is an enlarged perspective view of a relevant part showing mounting of a tape cassette and an auxiliary cassette in a cassette housing part of a tape printing apparatus according to a seventh embodiment.

The cassette housing part 6 has a thermal head 7 fixed therein (refer to FIG. 41 and FIG. 42). The thermal head 7 is tabular with a rectangular shape in a longitudinal direction thereof, and has a predetermined number of heat generating elements formed at a left-hand margin at a front surface thereof, the heat generating elements being aligned along the above-described left-hand margin.

The tape printing apparatus 710 has a platen roller 8. The platen roller 8 is rotatably supported by a holder 84. The holder 84 is rotatably supported by a holder shaft 47.

The platen roller 8 is rotated under driving of un upper motor, which is not shown. The rotation of the platen roller 8 conveys the printing tape 117 which is to be printed or already printed.

The holder 84 has a read sensor 11 attached thereto. The read sensor 11 reads a zebra mark (to be described later) printed on the printing tape 117.

The cassette housing part 6 has a ribbon take-up shaft 9. Upon loading the above-described tape cassette 701 in the tape printing apparatus 710, the ribbon take-up shaft 9 is coupled to the ribbon take-up spool 21. The ribbon take-up shaft 9 is rotated by a driving mechanism, which is not shown. The ink ribbon 19 can be drawn out by rotation of the ribbon take-up shaft 9.

The cassette housing part 6 has a printing tape take-up shaft 10. Upon loading the above-described tape cassette 701 in the tape printing apparatus 710, the printing tape take-up shaft 10 is coupled to (engaged with) a printing tape spool 118. The printing tape is rewound by rotation of the printing tape take-up shaft 10.

The cassette housing part 6 has a tape shaft 173. Upon loading the above-described auxiliary cassette 170 in the tape printing apparatus 710, the tape shaft 173 is coupled to the tape spool 181. The tape shaft 173 is rotated by a driving mechanism, which is not shown. The laminating film 174 can be rewound by rotation of the tape shaft 173.

The cassette housing part 6 has a feed roller shaft 185 and a feed roller shaft 186. Upon loading the above-described tape cassette 701 in the tape printing apparatus 710, the feed droller shaft 185 is coupled to the feed roller 82. The feed roller shaft 185 is rotated by a driving mechanism, which is not shown. Upon loading the above-described tape cassette 701 in the tape printing apparatus 710, the feed roller shaft 186 is coupled to the feed roller 83. The feed roller shaft 186 is rotated by a driving mechanism, which is not shown. The laminating film 174 is rewound onto the tape spool 181 by rotation of the feed roller shaft 185 and the feed roller shaft 186.

The tape printing apparatus 710 has a cutter unit 14. The cutter unit 14 is composed of a fixed blade 14A and a movable blade 14B. The cutter unit 14 cuts the printed printing tape 117 by moving of the movable blade 14B toward the fixed blade 14A. The fixed blade 14B is driven by a driving mechanism, which is not shown. The cutter unit 14 is arranged adjacent to a mounting position of the discharge port 13 of the tape cassette 701. Further, the cutter unit 14 is positioned closer to the tape entry port 176 of the auxiliary cassette 170.

The second cutter 87 is arranged downstream of the feed roller shaft 185 and the feed roller shaft 186 in the conveying direction, that is, positioned closer to the tape discharge port 175 of the auxiliary cassette 170. The second cutter 87 is composed of a fixed blade 87A and a movable blade 87B. The printed printing tape 117 is cut by moving of the movable blade 87B towards the fixed blade 87A. The movable blade 87B is driven and controlled by a driving mechanism not shown here.

The tape printing apparatus 710 has a discharge port 5 formed therein. The discharge port 5 is positioned downstream of the second cutter 87 in the conveying direction.

The tape printing apparatus 710 has a type identifying sensor (not shown) for identifying the type of the tape cassette 701 mounted.

The driving mechanisms as mentioned above are each driven by an operation of a driving circuit not shown here. Also, each of the driving mechanisms is controlled by a not-shown processor (such as a CPU) provided in the tape printing apparatus 710. Driving of each of the driving mechanisms will be described later.

(Printing and Conveyance of Printing Tape)

Next, printing onto the printing tape 117 and conveyance of the printing tape 117 will be explained.

The printing tape 117 wound on the printing tape spool 118 is conveyed by rotation driving of the platen roller 8 towards the thermal head 7 and the platen roller 8, passing through the tape guiding skid 30, the guiding pin 42 and the opening 43.

The ink ribbon 19 wound on the ribbon spool 20 is conveyed by rotation driving of the ribbon take-up spool 21 towards the thermal head 7 and the platen roller 8, passing through the regulating protruding part 44, the regulating protruding part 45 and the opening 43.

The printing tape 117 and the ink ribbon 19 are superimposed on each other by the thermal head 7 and the platen roller 8. At the time of printing, the heat generating elements of the thermal head 7 are driven to generate heat. The heat generated by the heat generating elements melts the ink layer 23 of heated portion of the ink ribbon 19, whereby the melted ink layer 23 is transferred to the printing tape 117.

Figure 43:
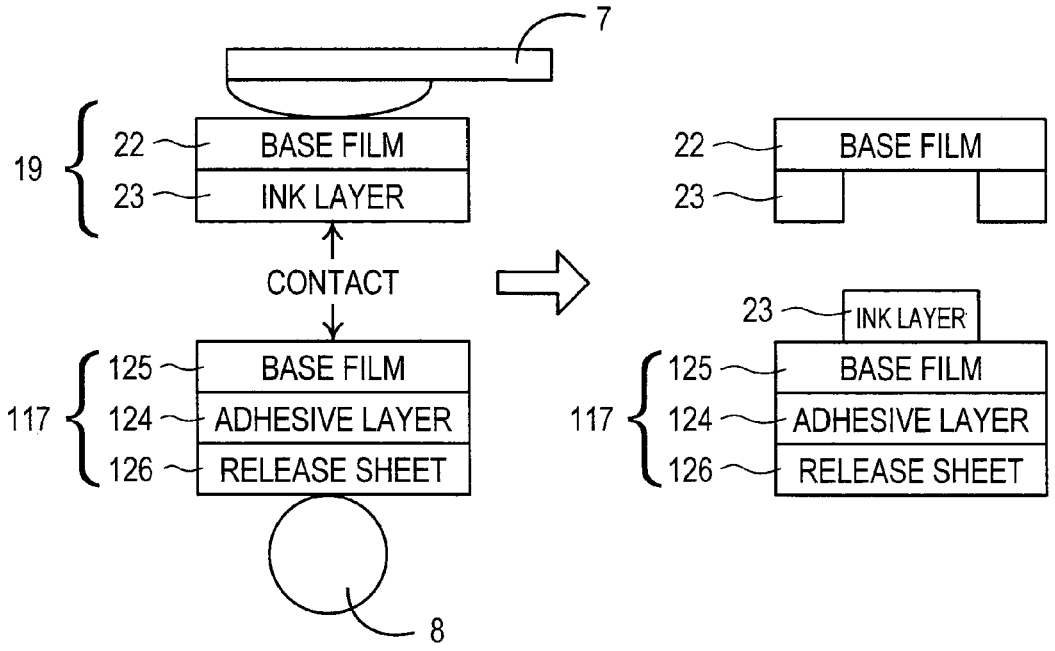
FIG. 43 is a view showing a pattern of the relationship between the ink ribbon and the printing tape in a printing process according to the seventh embodiment.
Figure 44:
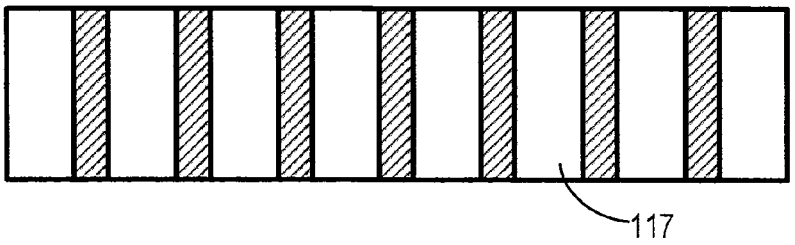
FIG. 44 is an example of zebra marks according to the seventh embodiment.

As shown in FIG. 43, the ink ribbon 19 is composed of a base film 22 and an ink layer 23. The printing tape 117 is composed of a base film 125, an adhesive layer 124 and a release sheet 126. The produced printing tape 117 is adhered to a target body by the surface of the adhesive layer 124, with the release sheet 126 being peeled off.

The surface (the side which is not in contact with the adhesive layer 124) of the release sheet 126 has, for instance, zebra marks printed thereon. The zebra marks are read by the read sensor 11 mentioned above.

The length of the predetermined interval is configured in a manner that it can be recognized by the tape printing apparatus 710. For instance, the length of the predetermined interval can be set constant (a fixed value), regardless of the types of tape cassettes to be loaded. In this case, the fixed value may be stored in the tape cassette 701 in advance. Alternatively, the above-mentioned identifying part (tape cassette 701) may be configured to have information on the length of the predetermined interval. In this case, the read sensor 11 detects the length of the interval of zebra marks, as well as the type of loaded tape cassette 701.

An amount of conveyed printing tape 117 can be obtained by multiplying the number of zebra marks read by the read sensor 11 and the length of the predetermined interval.

The color of zebra mark may be black, for instance. Zebra mark of any color may be employed so far as the color thereof is readable by the read sensor 11. The release sheet 126 having zebra marks printed thereon is peeled of at the time of adhering to a target body, as described above.

After printing, the ink ribbon 19 is taken up to the ribbon take-up spool 21, passing through the separating member 4. At this time, the printed printing tape 117 and the ink ribbon 19 are separated. Further, the printed printing tape 117 is discharged to the exterior of the tape cassette 701 through the discharge port 13.

Thereafter, the printed printing tape 117 is conveyed to the feed roller 82 and the feed roller 83, passing through the cutter unit 14.

Then, the produced printing tape 117 is conveyed to the discharge port 5 by rotation driving of the feed roller 82 and the feed roller 83. Further, the printed printing tape 117 is cut at a predetermined position by the cutter unit 14.

The printing tape 117 that was cut is rewound to a predetermined position by the printing tape spool 118.

(Laminating Process on Post-Printing Printing Tape 117)

Next, laminating process on the printed printing tape 117 will be explained. At the time of passing through the feed roller 82 and the feed roller 83 of the auxiliary cassette 170, the laminating film 174 is adhered to the printed printing tape 117.

Figure 45:
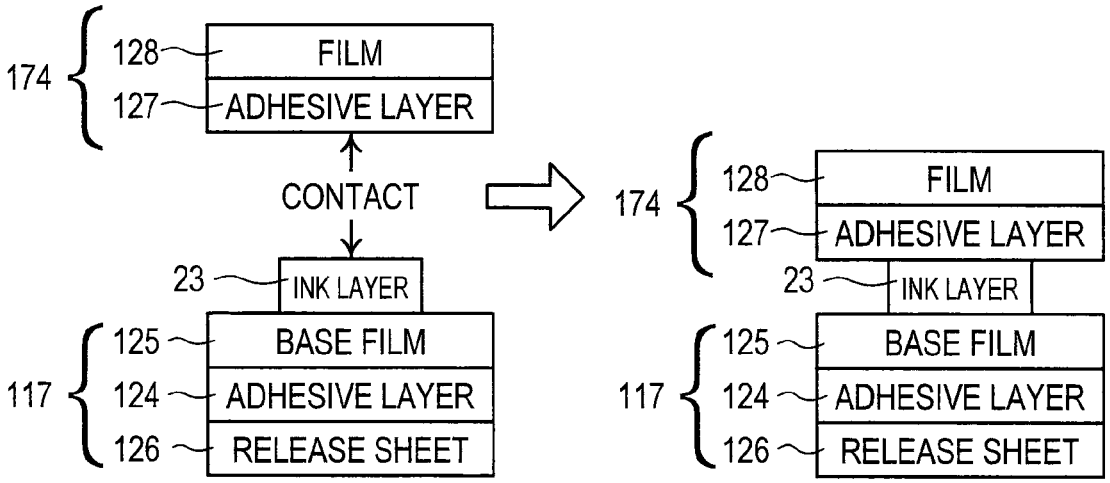
FIG. 45 is a view showing a pattern of the relationship between a printed printing tape and a laminating film in a laminating process according to the seventh embodiment.
Figure 46:
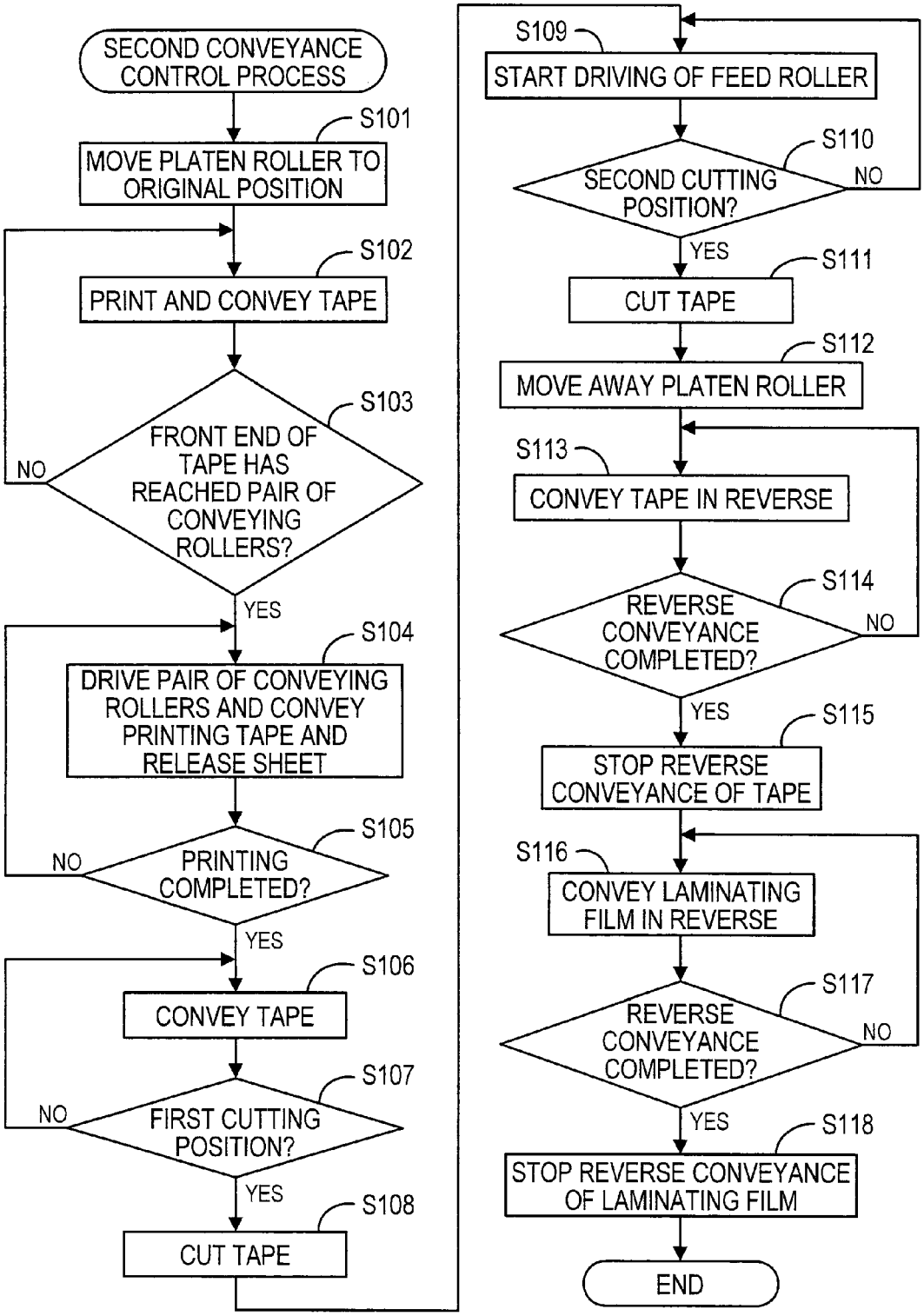
FIG. 46 is a flowchart showing a second conveyance control process.

As shown in FIG. 45, the laminating film 174 is composed of an adhesive layer 127 and a film 128. Materials of which ink layer (that is, printed contents) are visible can be employed as the film 128. For instance, a PET film, a polyethylene (PE) film and a polypropylene (PP) film can be employed.

Alternatively, the film 128 may be semi-transparent. For instance, a frosted film (MATT film) can be employed. Further, a colored film may be employed. It is also possible to employ a film of which both ends in the width direction have floral patterns, characters or the like printed thereon.

The adhesive layer 127 is preferably made of a material of which adhesive agent will not be transferred to the feed roller 83. For instance, it is possible to form an adhesive layer 127 by adding a coating liquid to a film 128 (for instance, by using a bar coater). Such coating liquid is made by adding a curing agent (isocyanate series) to acrylic adhesive agent which can be crosslinked by isocyanate and the like in a manner that the ball tack becomes three or below.

Alternatively, an adhesive agent of acrylic series, urethane series, epoxy series, silicone series, polyester series or the like may be used as an adhesive agent of the adhesive layer 127. Additionally, as the above-mentioned curing agent, an agent of isocyanate series, epoxy series, metal chelate series or the like may be employed. Needless to say, the adhesive layer 127 must be transparent or semi-transparent, to thus make the ink layer visible therethrough.

When the laminating film 174 and the printed printing tape 117 are superimposed on each other by the feed roller 82 and the feed roller 83, the laminating film 174 is adhered to the ink layer.

The printed printing tape 117 which has been laminated is conveyed to the second cutter 87 and cut at a predetermined position.

Next, there will be described the operation of the respective driving devices in the tape printing apparatus 710.

The second conveyance control process is executed by a processor (not shown) which is provided in the tape printing apparatus 710. Execution of the second conveyance control process is started by output of an instruction signal for print control.

Figure 47:
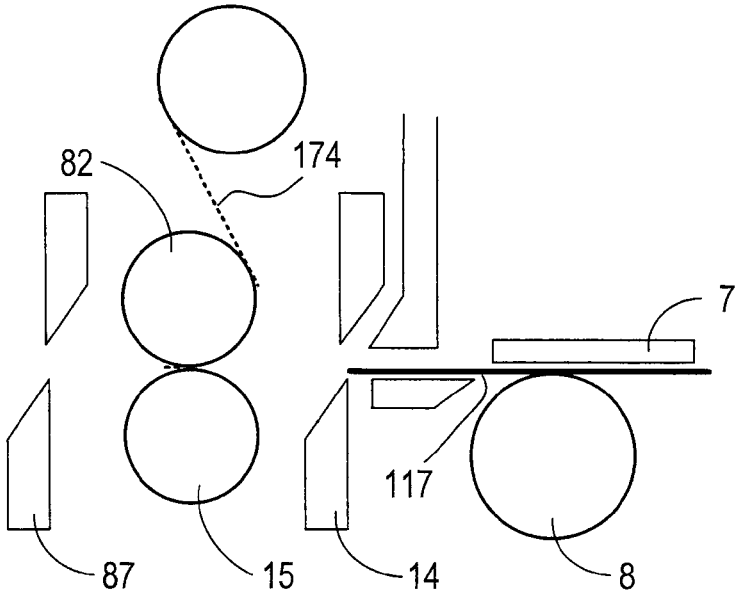
FIG. 47 is a schematic diagram showing a condition where the laminating film and the printing tape are conveyed.
Figure 48:
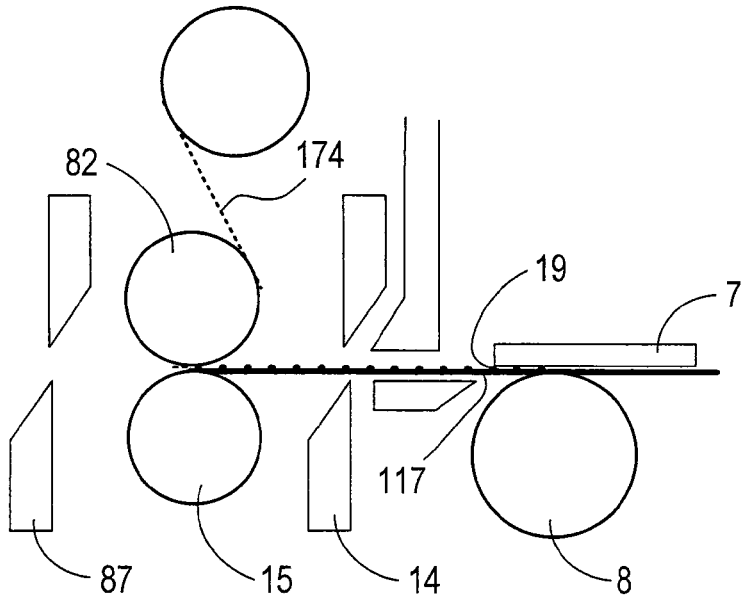
FIG. 48 is a schematic diagram showing a condition where the laminating film and the printing tape are conveyed.

First, at S101, the platen roller 8 is moved to its original position (refer to FIG. 47). At this time, the front end of the printing tape 117 is located at the periphery of the cutter unit 14 (refer to FIG. 47).

At S102, the print operation to the printing tape 117 and the conveyance operation of the printing tape 117 are carried out. As these operations have already been described above, further description thereof is hereby omitted.

At S103, a judgment is made as to whether the front end of the printing tape 117 has reached the pair of conveying rollers (feed roller 82 and feed roller 83). This judgment is carried out by calculating the amount of the conveyed printing tape 117 based on the number of rotations of the platen roller 8. The front end position of the printing tape 117 may also be detected by use of a sensor which is not shown here.

If it is judged that the front end of the printed printing tape 117 has not reached the pair of conveying rollers (S103: NO), the flow returns to S102. As a result, during the period of time required by the front end of the printed printing tape 117 to reach the pair of conveying rollers, the print operation and the conveying operation with respect to the printing tape 117 are successively carried out.

If it is judged that the front end of the printed printing tape 117 has reached the pair of conveying rollers (S103: YES), the flow proceeds to S104.

At S104, the drive operation of the pair of conveying rollers is started. The laminating film 174 is adhered to the printed printing tape 117 (ink layer side) in accordance with the rotation of the pair of conveying rollers. The printed printing tape 117 to which the laminating film 174 has been adhered is conveyed towards the second cutter unit 87.

Figure 49:
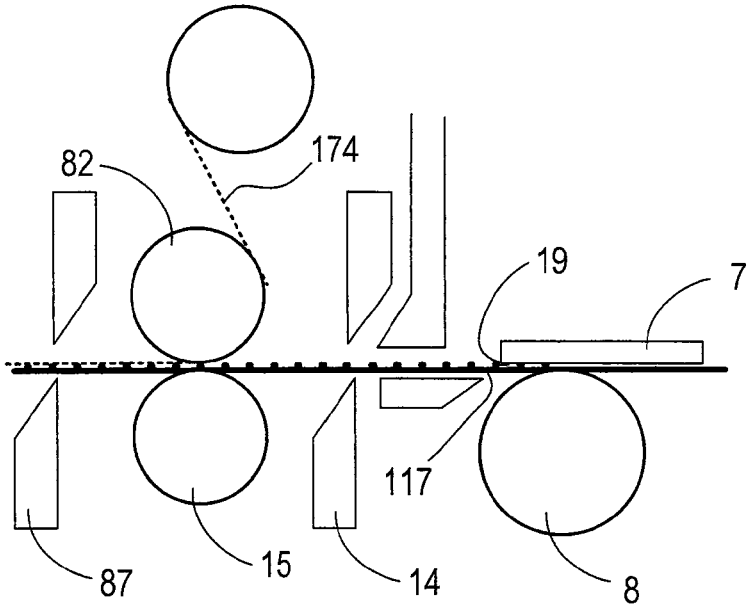
FIG. 49 is a schematic diagram showing a condition where the laminating film and the printing tape are conveyed.
Figure 50:
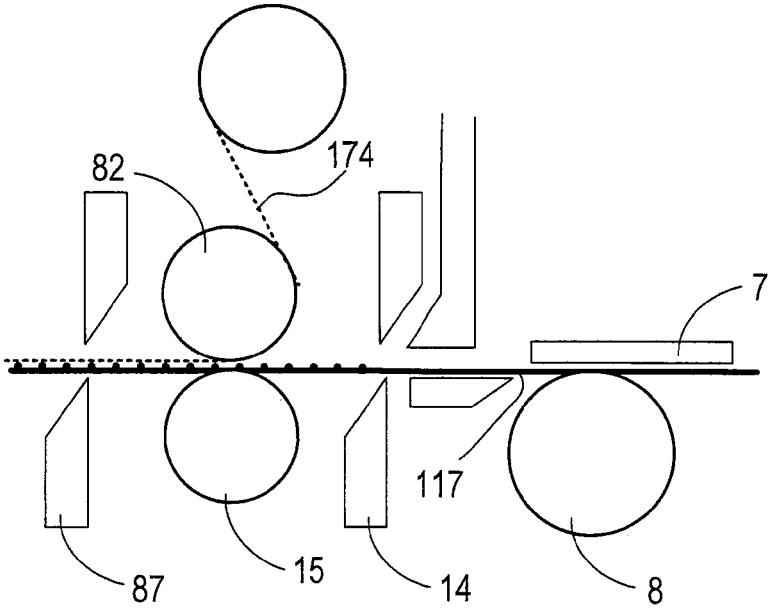
FIG. 50 is a schematic diagram showing a condition where the laminating film and the printing tape are conveyed.
Figure 51:
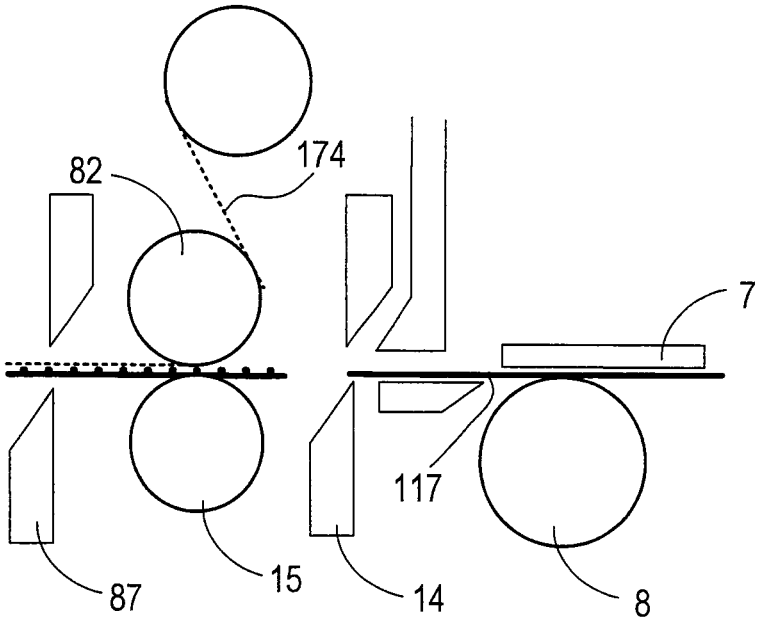
FIG. 51 is a schematic diagram showing a condition where the laminating film and the printing tape are conveyed.
Figure 52:
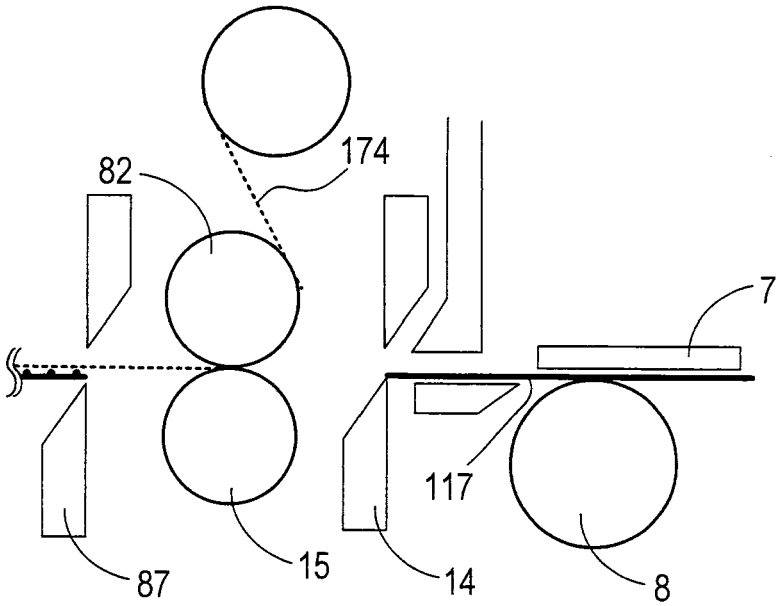
FIG. 52 is a schematic diagram showing a condition where the laminating film and the printing tape are conveyed.
Figure 53:
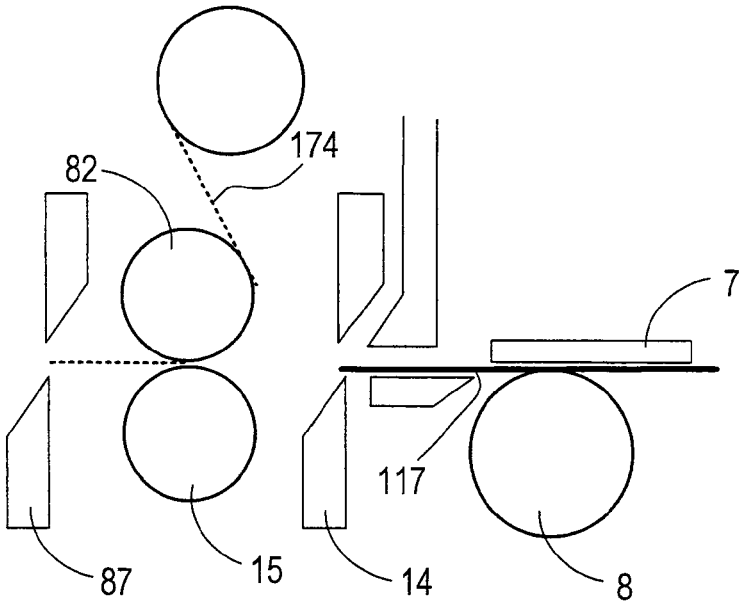
FIG. 53 is a schematic diagram showing a condition where the laminating film and the printing tape are conveyed.

At S105, a judgment is made as to whether printing is completed. The operation at S104 (specifically, the print operation and the conveyance operation) is repeated until printing is completed (refer to FIG. 49).

If it is judged that printing has been completed (S105: YES), the flow shifts to S106. At S106, the printed printing tape 117 is conveyed towards the pair of conveying rollers.

At S107, a judgment is made as to whether the printed printing tape 117 is present at the cutting position (first cutting position) by the cutter unit 14 (first cutter). This judgment is carried out using the amount of the conveyed printing tape 117 which is calculated based on the amount of rotation of the platen roller 8. A judgment may be made as to whether cutting will be made at the first cutting position by printing predetermined contents at a first cutting scheduled position and then reading the printed contents by a sensor which is not shown here.

If it is judged that the printed printing tape 117 is not present at the first cutting position (S107: NO), the flow returns to S106. As a result, during the time required by the printed printing tape 117 to be conveyed to the first cutting position, the conveying operation of the printed printing tape 117 is carried out successively.

On the other hand, if it is judged that the printed printing tape 117 is present at the first cutting position (S107: YES), the flow shifts to S108.

At S108, the printed printing tape 117 is cut. At this time, the movable blade 14B is driven and controlled. At the time the printed printing tape 117 is cut, driving of the rotating platen roller 8 is stopped.

After the printed printing tape 117 has been cut, the flow shifts to S109.

At S109, rotation driving of the feed roller 82 and the feed roller 83 is started again. Since the printed printing tape 117 has been cut, the platen roller 8 is not driven to rotate. As a result, the printed printing tape 117 that was cut is conveyed by rotation driving of the feed roller 82 and the feed roller 83.

At S110, a judgment is made as to whether the printed printing tape 117 is present at the cutting position (second cutting position) by the second cutter unit 87 (second cutter). This judgment is carried out based on the conveyed amount of the printed printing tape 117 that is calculated based on the rotation amount of the feed roller 82 and the feed roller 83.

If it is judged that the back end of the printed printing tape 117 is not present at the second cutting position (S110: NO), the flow returns to S109. As a result, during the time required by the printed printing tape 117 to be conveyed to the second cutting position, the conveyance operation of the printed printing tape 117 is successively carried out.

On the other hand, if it is judged that the back end of the printed printing tape 117 is present at the second cutting position (S110: YES), the flow shifts to S111.

At S111, the printed printing tape 117 is cut. At this time, the movable blade 87B is driven and controlled. At the time the printed printing tape 117 is cut, driving of the feed roller 82 and the feed roller 83 is stopped.

After the laminating film 174 has been cut, the flow shifts to S112.

At S112, the platen roller 8 is moved away from the thermal head 7. Then, the flow shifts to S113.

At S113, the printing tape 117 is conveyed in a reverse direction. More specifically, the printing tape 117 is rewound in a reverse direction with the conveying direction at the time of printing. At this time, the printing tape spool 118 is rotated in a reverse direction with the rotation direction at the time of printing. As a result, the printing tape 117 is rewound onto the printing tape spool 118.

At S114, a judgment is made as to whether to terminate the reverse conveyance of the printing tape 117. This judgment is carried out based on the amount of the printing tape 117 that was conveyed, which is calculated based on the number & of zebra marks read by the read sensor 11.

If it is judged not to terminate the reverse conveyance of the printing tape 117 (S114: NO), the flow returns to S113. As a result, during the time required until reverse conveyance of the printing tape 117 is completed, the rewind operation of the printing tape 117 is successively carried out.

On the other hand, if it is judged to terminate the reverse conveyance of the printing tape 117 (S114: YES), the flow shifts to S115.

At S115, reverse-rotation driving of the printing tape spool 118 is stopped.

At S116, the laminating film 174 is conveyed in a reverse direction. More specifically, the laminating film 174 is rewound in a reverse direction with the conveying direction at the time of printing. At this time, the tape spool 181 is rotated in a reverse direction with the rotation direction at the time of printing. As a result, the laminating film 174 is rewound onto the tape spool 181.

At S117, a judgment is made as to whether to terminate the reverse conveyance of the laminating film 174. This judgment is carried out based on the amount of the laminating film that was conveyed, which is calculated based on the amount of rotations of the feed roller 82.

If it is judged not to terminate the reverse conveyance of the laminating film 174 (S117: NO), the flow returns to S116. As a result, during the time required until reverse conveyance of the laminating film 174 is completed, the rewind operation of the laminating film 174 is successively carried out.

On the other hand, if it is judged to terminate the reverse conveyance of the laminating film 174 (S117: YES), the flow shifts to S118.

At S118, reverse-rotation driving of the tape spool 181 is stopped.

Here, the rewind operation of the printing tape spool 118 is controlled to stop during the state in which the printed printing tape 117 can be securely guided to the discharge port 13, at the time of subsequent printing process.

Figure 55:
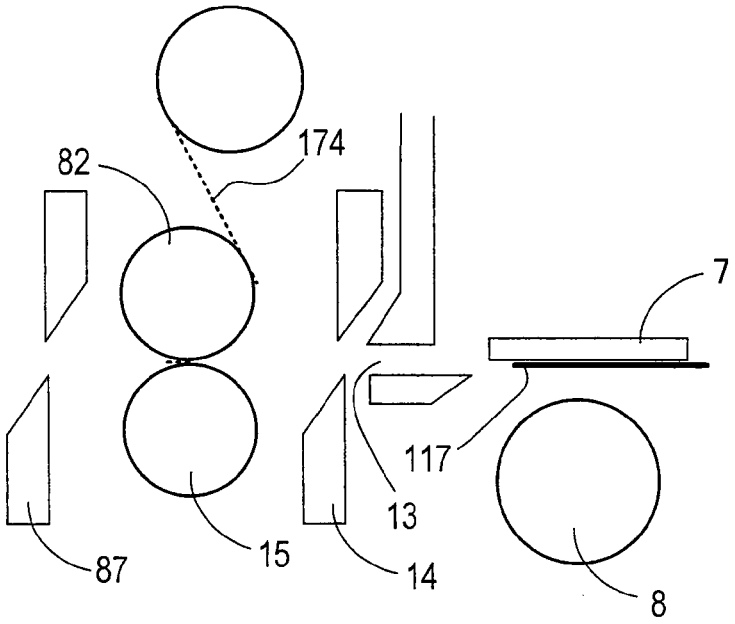
FIG. 55 is a schematic diagram showing a condition where the printing tape is rewound by a normal amount or more.
Figure 56:
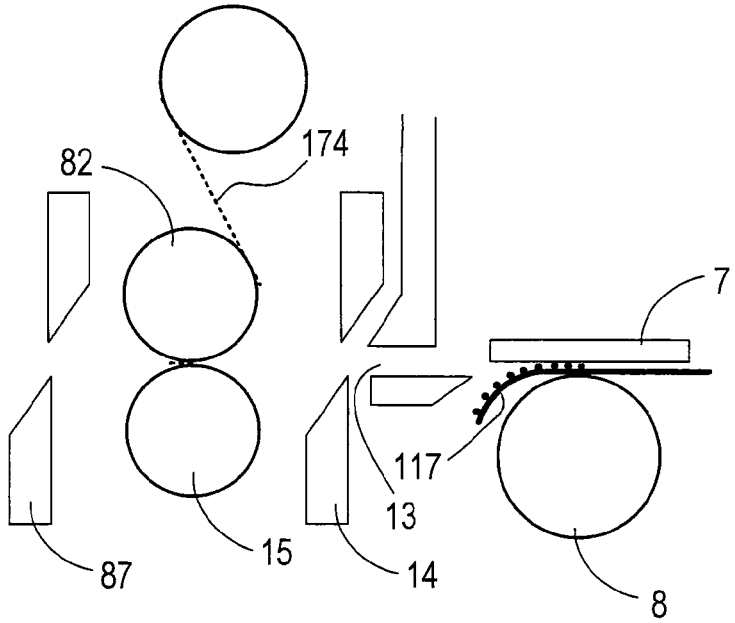
FIG. 56 is a schematic diagram showing a condition where the printed printing tape fails to be conveyed normally.
Figure 57:
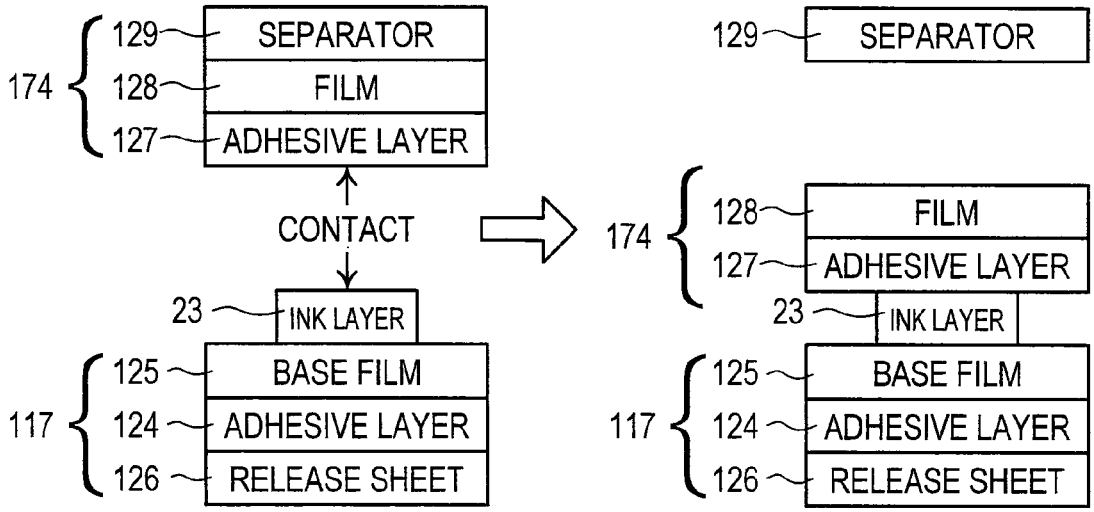
FIG. 57 is an explanatory diagram showing a pattern of the relationship between the printed printing tape and the laminating film in a laminating process.

For instance, if the front end of the printing tape 117 is rewound to the position as indicated in FIG. 55, the front end of the printed printing 117 may possibly fail to be guided to the discharge port 13 at the time of subsequent printing process (refer to FIG. 56).

Figure 54:
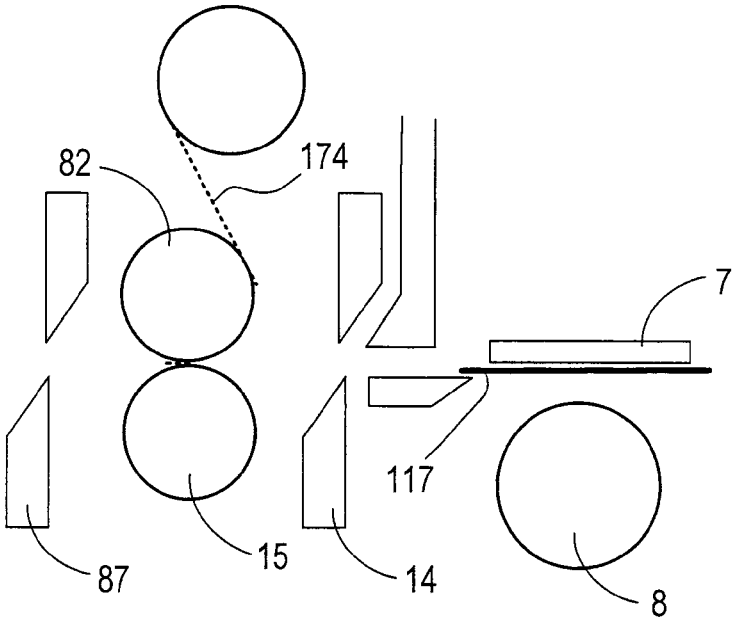
FIG. 54 is a schematic diagram showing a condition where the laminating film and the printing tape are conveyed.

Therefore, the reverse-rotation driving of the printing tape spool 118 is preferably controlled so that the front end of the printing tape 117 is controlled to stop upon being rewound to the position as indicated in FIG. 54. As a result, it is possible to securely guide the printed printing tape 117 to the discharge port 13 while shortening the front blank space of the printing tape 117.

Since the tape printing apparatus of the present embodiment is configured in the above-described manner, the printed surface of the printing tape 117 is protected by the laminating film 174. Further, the cutter unit 14 is arranged adjacent to the thermal head 7 in a downstream side of the conveying direction of the printing tape 117. Accordingly, blank space of the front end of the produced printing tape 117 can be shortened.

Also, the pos-cutting printing tape 117 is rewound onto the tape spool by a predetermined length. As a result, the blank space of the front end of the produced printing tape 117 can be shortened. Since the blank space of the front end of the produced printing tape 117 can be shortened, it is possible to reduce the amount of consumed printing tape 117.

Furthermore, the laminating film 174 that was cut is also rewound onto the tape spool 181 by a predetermined length. This makes it possible to reduce the amount of consumed laminating film 174.

It is to be noted that the laminating film may be configured to include a separator, in addition to an adhesive layer and a film. In this case, the separator 129 from which the film and the adhesive layer are separated is rewound on a separator take-up spool provided in the tape cassette.

Figure 58:
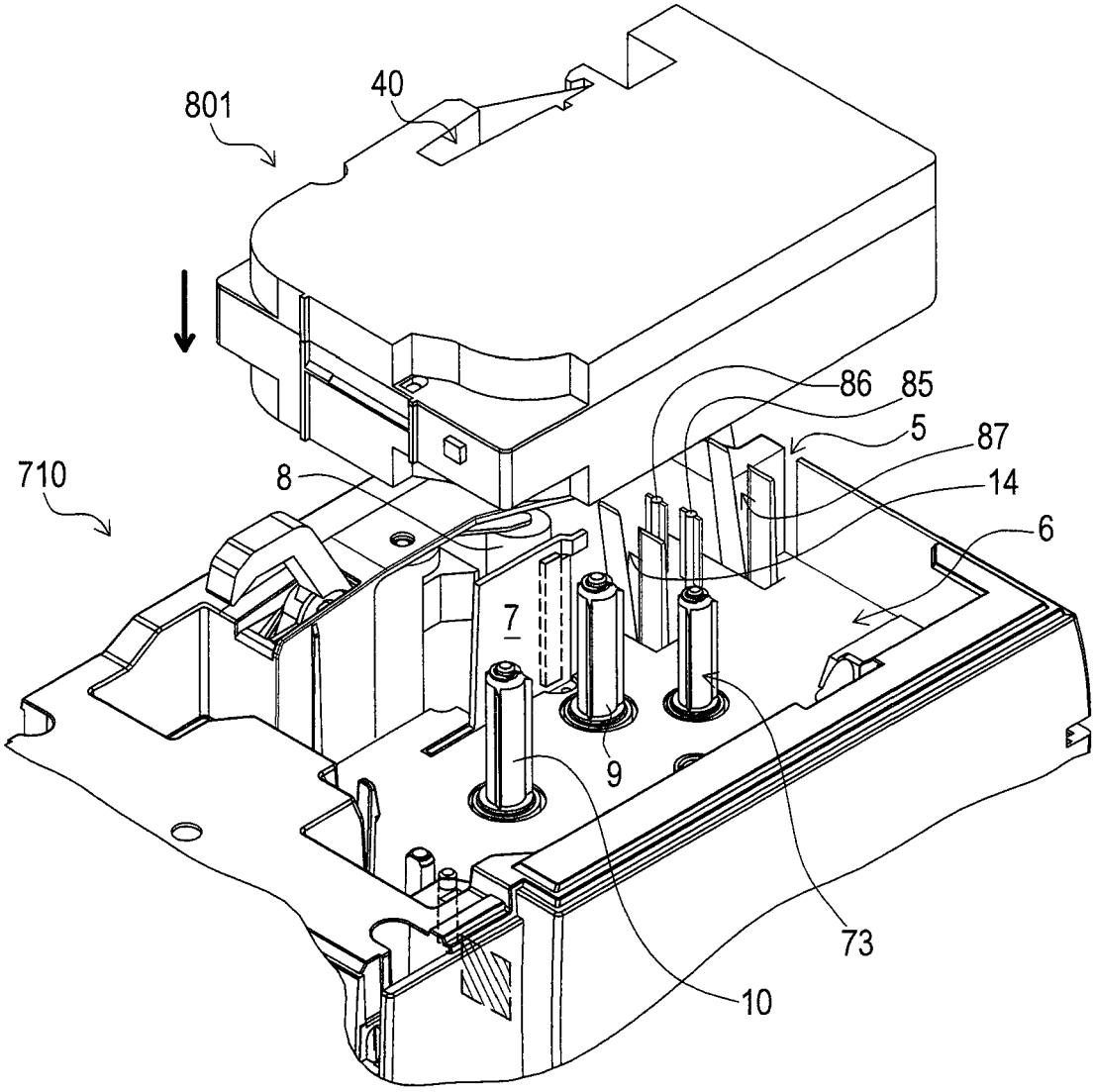
FIG. 58 is an enlarged perspective view of a relevant part showing mounting of the tape cassette in the cassette housing part of the tape printing apparatus according to another embodiment.
Figure 59:
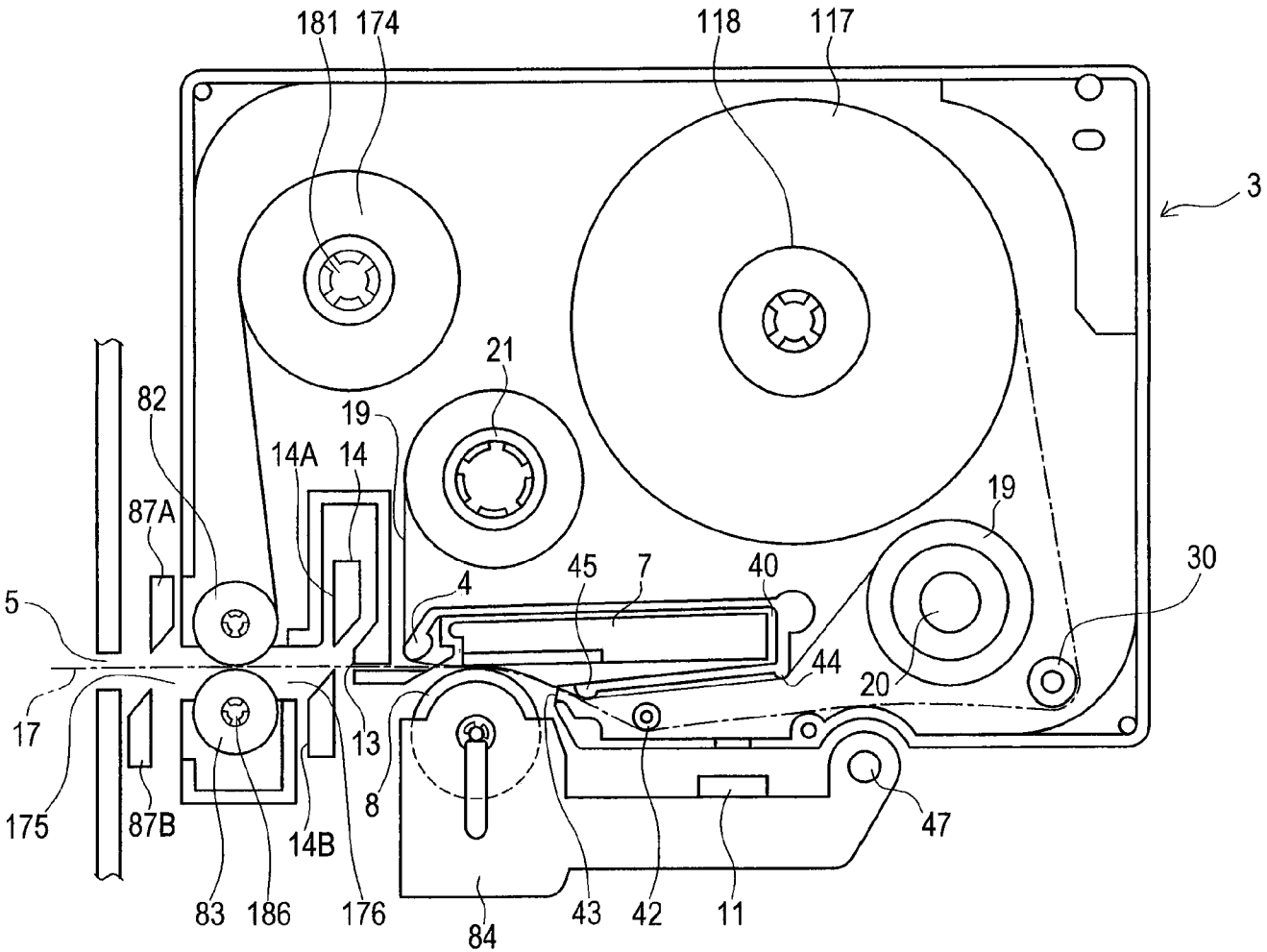
FIG. 59 is a plan view showing a pattern of an internal configuration of the tape cassette and the auxiliary cassette according to another embodiment.

Alternatively, a tape cassette 801 having integrated tape cassette and auxiliary cassette may be mounted in the tape printing apparatus 710, as shown in FIG. 58 and FIG. 59.

Eighth Embodiment

Next, a tape cassette and a tape printing apparatus according to an eighth embodiment will be described. The tape printing apparatus according to the eighth embodiment has the same configuration as that of the tape printing apparatus 710 according to the seventh embodiment. Therefore, further description thereof is hereby omitted.

The tape cassette and the auxiliary cassette according to the eighth embodiment are basically the same as the tape cassette 701, the auxiliary cassette 170 and the tape cassette 801. However, in the eighth embodiment, a printing tape 217 is used instead of the printing tape 117, and a double-sided adhesive tape 274 is used instead of the laminating film 174.

The printing tape 217 is a transparent film and a printing process is carried out at the position between a thermal head 7 and a platen roller 8. Characters and the like are printed on the printing tape 217 as mirror image and the printed characters ant the like are visible as normal image when looked from the other side of the printed surface. Since the printing operation is the same as that of the seventh embodiment, further description thereof is hereby omitted.

Figure 60:
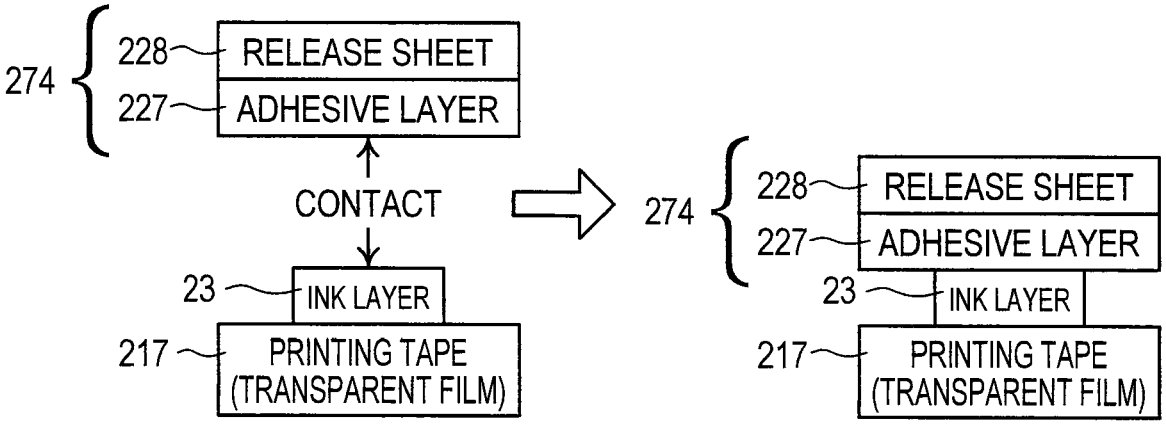
FIG. 60 is a schematic diagram showing a relationship between a printed printing tape and a double-sided adhesive tape according to an eighth embodiment.
Figure 61:
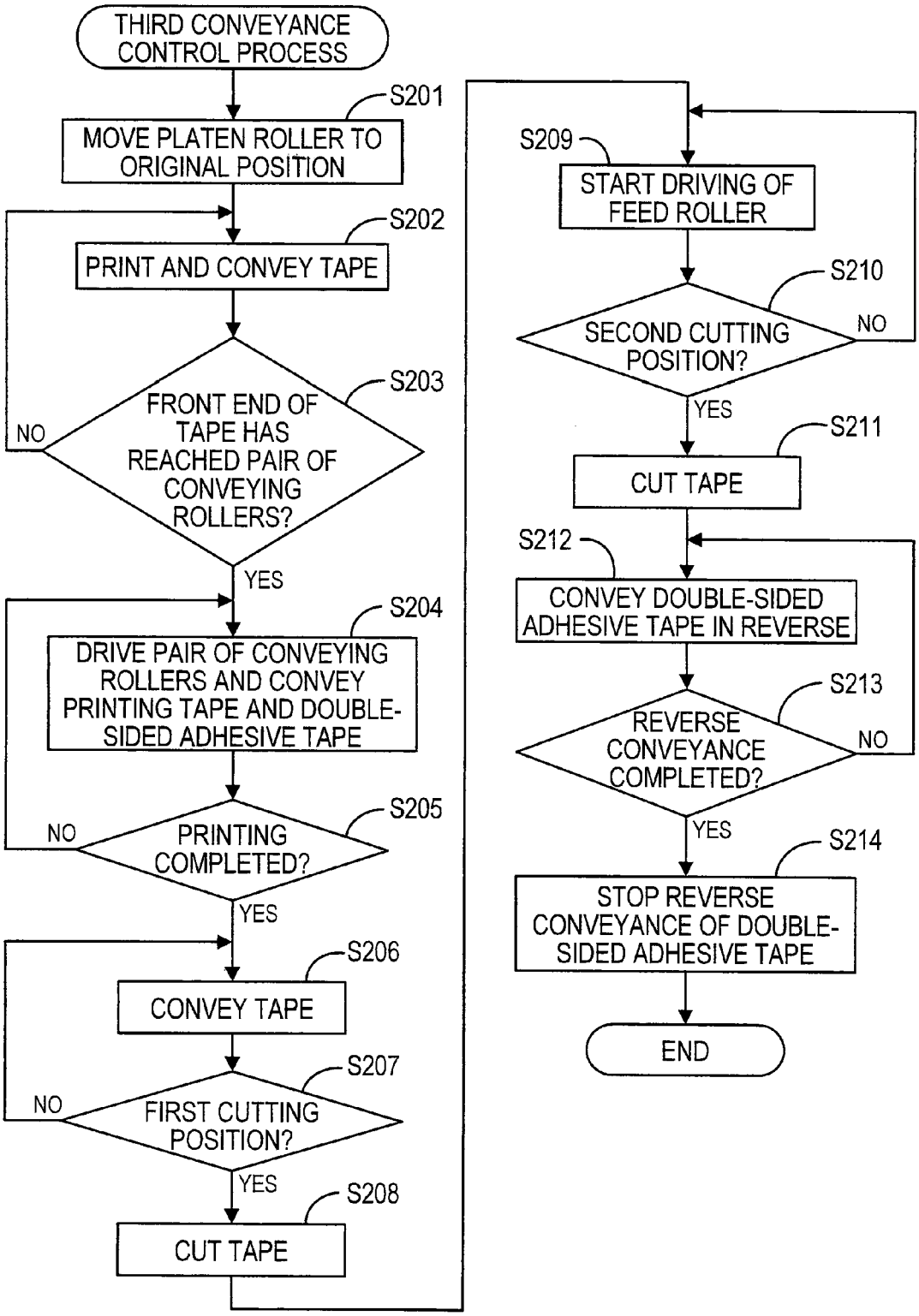
FIG. 61 is a flowchart showing a third conveyance control process.

As shown in FIG. 60, the double-sided adhesive tape 274 is composed of an adhesive layer 227 and a release sheet 228.

The printing tape 217 and the double-sided adhesive tape 274 are adhered to each other at the position between the feed roller 82 and the feed roller 83. Further, the release sheet 228 is peeled off at the time of adhering to the target body.

The read sensor 11 does not work in the eighth embodiment, since zebra marks (refer to the above description on the seventh embodiment) cannot be printed on the printing tape 217. Thus, the tape printing apparatus according to the eighth embodiment can be implemented by removing the read sensor 11 from the tape printing apparatus 710.

Since the read sensor 11 does not work, the reverse conveyance of the printing tape 217 is not carried out, also. Thus, the tape printing apparatus according to the eighth embodiment can be implemented by removing the printing tape take-up shaft 10 from the tape printing apparatus 710.

Next, there will be described the operation of the respective driving devices in the tape printing apparatus 710 according to the eighth embodiment.

The third conveyance control process is executed by a processor (not shown) which is provided in the tape printing apparatus 710. Execution of the third conveyance control process is started by output of an instruction signal for print control.

Figure 62:
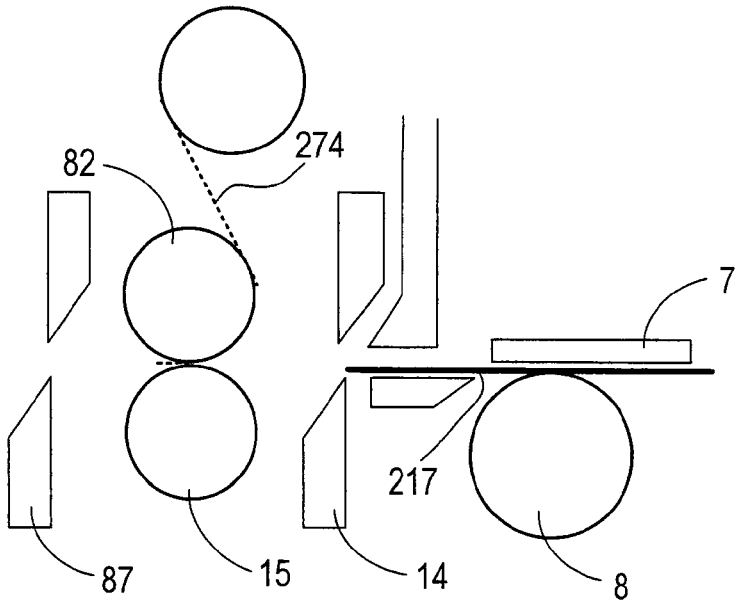
FIG. 62 is a schematic diagram showing a condition where the double-sided adhesive tape and the printing tape are conveyed.
Figure 63:
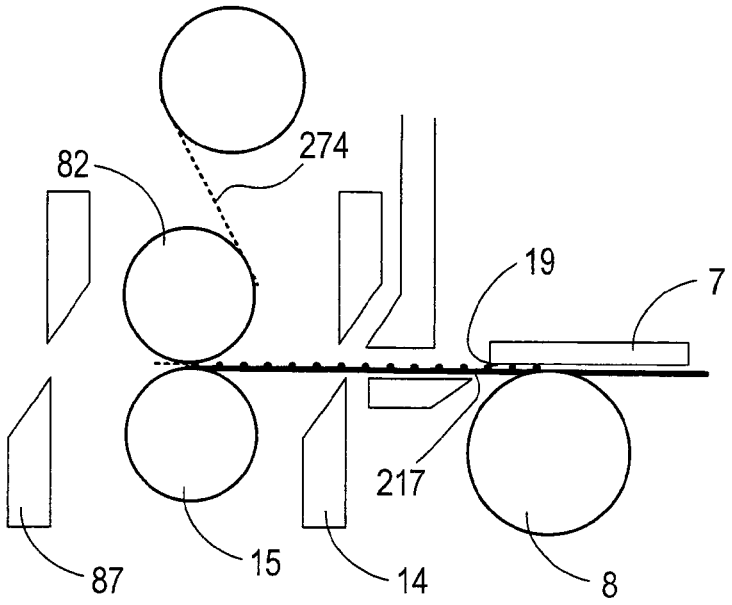
FIG. 63 is a schematic diagram showing a condition where the double-sided adhesive tape and the printing tape are conveyed.

First, at S201, the platen roller 8 is moved to its original position (refer to FIG. 62). At this time, the front end of the printing tape 217 is located at the periphery of the cutter unit 14 (refer to FIG. 62).

At S202, the print operation to the printing tape 217 and the conveyance operation of the printing tape 217 are carried out. As these operations have already been described above, further description thereof is hereby omitted.

At S203, a judgment is made as to whether the front end of the printing tape 217 has reached the pair of conveying rollers (feed roller 82 and feed roller 83). This judgment is carried out by calculating the amount of the conveyed printing tape 217 based on the number of rotations of the platen roller 8. The front end position of the printing tape 217 may also be detected by use of a sensor which is not shown here.

If it is judged that the front end of the printed printing tape 217 has not reached the pair of conveying rollers (S203: NO), the flow returns to S202. As a result, during the period of time required by the front end of the printed printing tape 217 to reach the pair of conveying rollers, the print operation and the conveying operation with respect to the printing tape 217 are successively carried out.

If it is judged that the front end of the printed printing tape 217 has reached the pair of conveying rollers (S203: YES), the flow proceeds to S204.

At S204, the drive operation of the pair of conveying rollers is started. The double-sided adhesive tape 274 is adhered to the printed printing tape 217 (ink layer side) in accordance with the rotation of the pair of conveying rollers. The printed printing tape 217 to which the double-sided adhesive tape 274 has been adhered is conveyed towards the second cutter unit 87.

Figure 64:
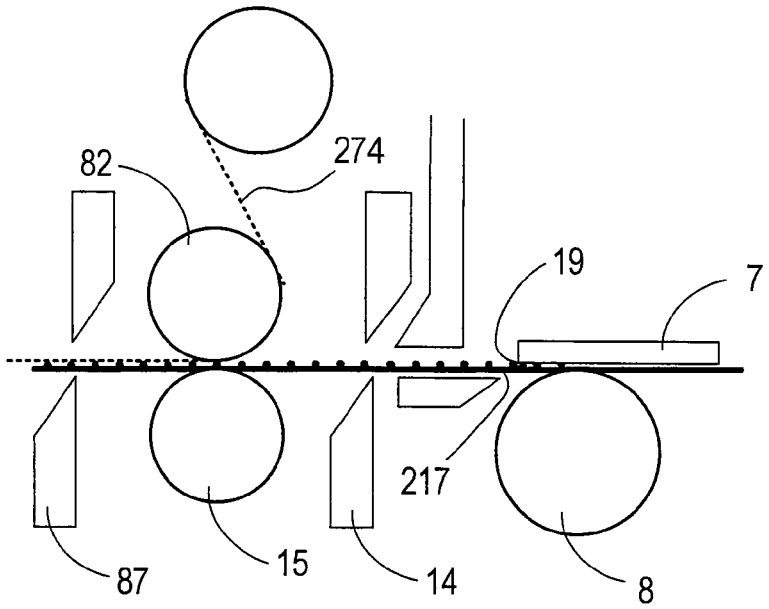
FIG. 64 is a schematic diagram showing a condition where the double-sided adhesive tape and the printing tape are conveyed.
Figure 65:
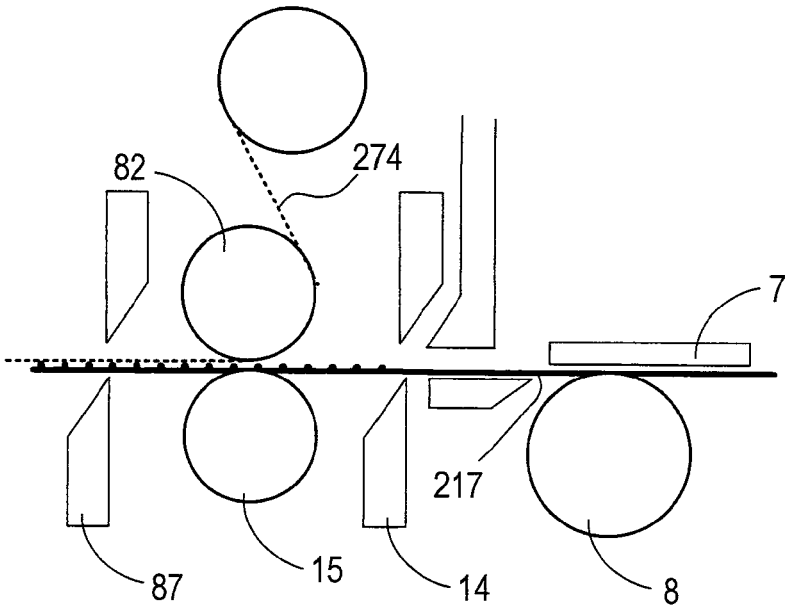
FIG. 65 is a schematic diagram showing a condition where the double-sided adhesive tape and the printing tape are conveyed.
Figure 66:
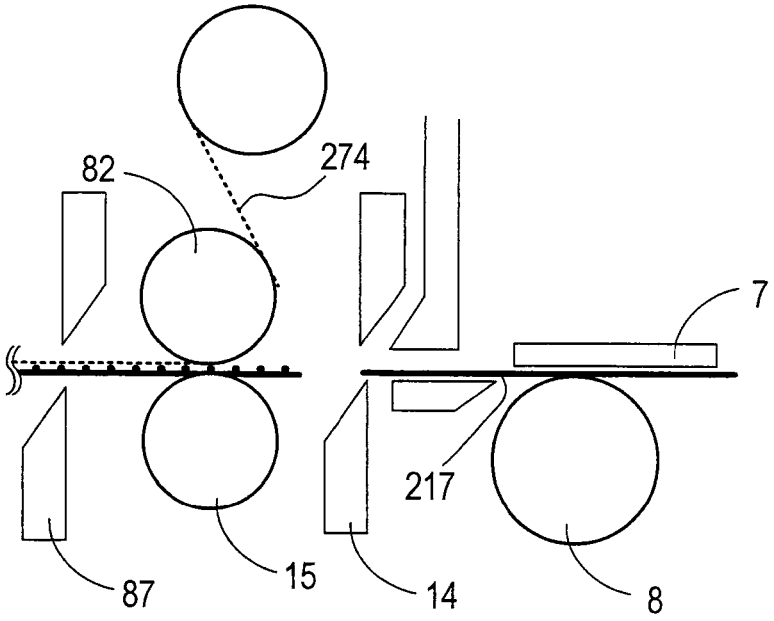
FIG. 66 is a schematic diagram showing a condition where the double-sided adhesive tape and the printing tape are conveyed.
Figure 67:
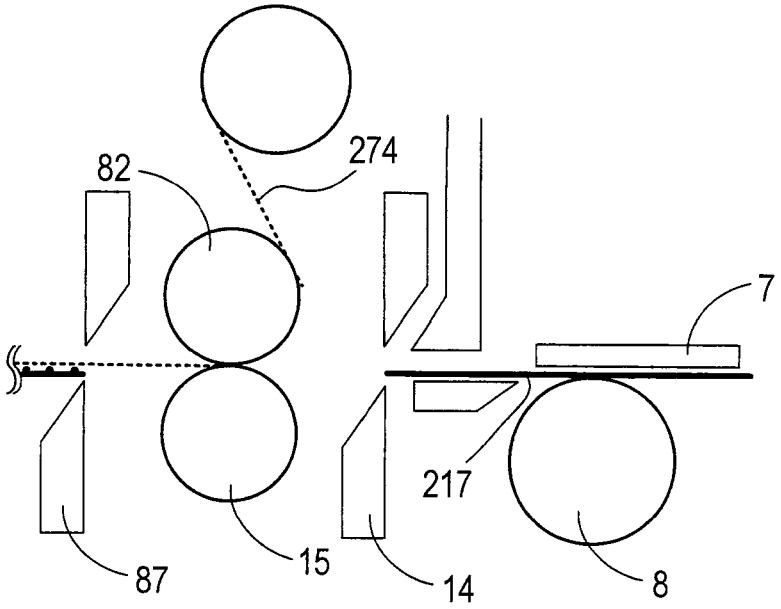
FIG. 67 is a schematic diagram showing a condition where the double-sided adhesive tape and the printing tape are conveyed.
Figure 68:
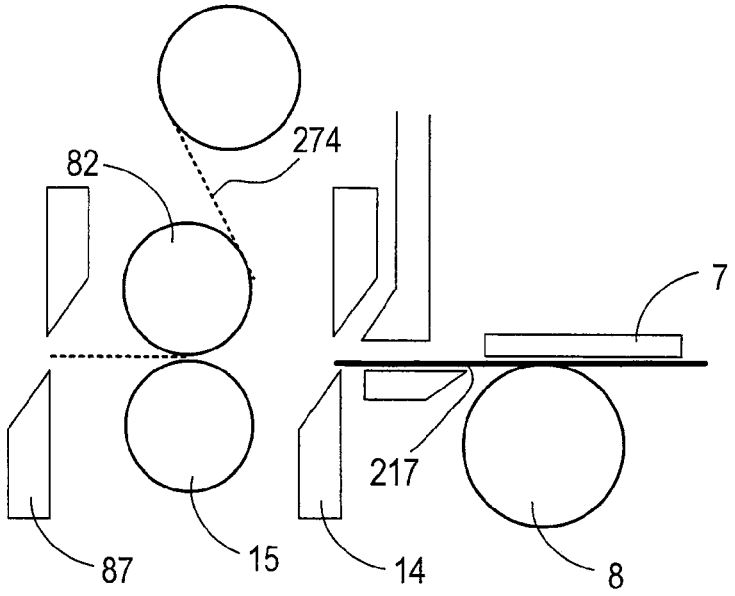
FIG. 68 is a schematic diagram showing a condition where the double-sided adhesive tape and the printing tape are conveyed.
Figure 69:
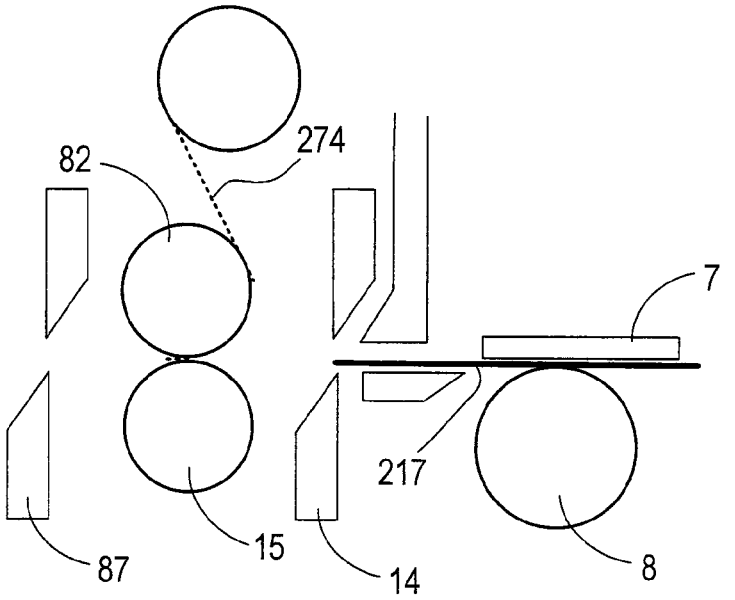
FIG. 69 is a schematic diagram showing a condition where the double-sided adhesive tape and the printing tape are conveyed.

At S205, a judgment is made as, to whether printing is completed. The operation at S204 (specifically, the print operation and the conveyance operation) is repeated until printing is completed (refer to FIG. 64).

If it is judged that printing has been completed (S205: YES), the flow shifts to S206. At S206, the printed printing tape 217 is conveyed towards the pair of conveying rollers.

At S207, a judgment is made as to whether the printed printing tape 217 is present at the cutting position (first cutting position) by the cutter unit 14 (first cutter). This judgment is carried out using the amount of the conveyed printing tape 217 which is calculated based on the amount of rotation of the platen roller 8. A judgment may be made as to whether cutting will be made at the first cutting position by printing predetermined contents at a first cutting scheduled position and then reading the printed contents by a sensor which is not shown here.

If it is judged that the printed printing tape 217 is not present at the first cutting position (S207: NO), the flow returns to S206. As a result, during the time required by the printed printing tape 217 to be conveyed to the first cutting position, the conveying operation of the printed printing tape 217 is carried out successively.

On the other hand, if it is judged that the printed printing tape 217 is present at the first cutting position (S207: YES), the flow shifts to S208.

At S208, the printed printing tape 217 is cut. At this time, the movable blade 14B is driven and controlled. At the time the printed printing tape 217 is cut, driving of the rotating platen roller 8 is stopped.

After the printed printing tape 217 has been cut, the flow shifts to S209.

At S209, rotation driving of the feed roller 82 and the feed roller 83 is started again. Since the printed printing tape 217 has been cut, the platen roller 8 is not driven to rotate. As a result, the printed printing tape 217 that was cut is conveyed by rotation driving of the feed roller 82 and the feed roller 83.

At S210, a judgment is made as to whether the printed printing tape 217 is present at the cutting position (second cutting position) by the second cutter unit 87 (second cutter). This judgment is carried out based on the conveyed amount of the printed printing tape 217 that is calculated based on the rotation amount of the feed roller 82 and the feed roller 83.

If it is judged that the back end of the printed printing tape 217 is not present at the second cutting position (S210: NO), the flow returns to S209. As a result, during the time required by the printed printing tape 217 to be conveyed to the second cutting position, the conveyance operation of the printed printing tape 217 is successively carried out.

On the other hand, if it is judged that the back end of the printed printing tape 217 is present at the second cutting position (S210: YES), the flow shifts to S211.

At S211, the printed printing tape 217 is cut. At this time, the movable blade 87B is driven and controlled. At the time the printed printing tape 217 is cut, driving of the feed roller 82 and the feed roller 83 is stopped.

After the double-sided adhesive tape 274 has been cut, the flow shifts to S212.

At S212, the double-sided adhesive tape 274 is conveyed in a reverse direction. More specifically, the double-sided adhesive tape 274 is rewound in a reverse direction with the conveying direction at the time of printing. At this time, the tape spool 181 is rotated in a reverse direction with the rotation direction at the time of printing. As a result, the double-sided adhesive tape 274 is rewound onto the tape spool 181.

At S213, a judgment is made as to whether to terminate the reverse conveyance of the double-sided adhesive tape 274. This judgment is carried out based on the amount of the double-sided adhesive tape 274 that was conveyed, which is calculated based on the amount of rotation of the feed roller 82.

If it is judged not to terminate the reverse conveyance of the double-sided adhesive tape 274 (S213: NO), the flow returns to S212. As a result, during the time required until reverse conveyance of the double-sided adhesive tape 274 is completed, the rewind operation of the double-sided adhesive tape 274 is successively carried out.

On the other hand, if it is judged to terminate the reverse conveyance of the double-sided adhesive tape 274 (S213: YES), the flow shifts to S214.

At S214, reverse-rotation driving of the tape spool 181 is stopped.

According to the tape printing apparatus as described above, the printed surface of the printing tape 217 is laminated with the double-sided adhesive tape 274. Therefore, printed characters and the like are not exposed at the surface, thereby preventing the characters and the like from being blurred or erased even when the surface of the produced printing tape is scratched or water, chemicals and the like are come into contact with the surface of the printing tape.

In addition, since characters and the like are printed on the printing tape 217 as mirror image, the printed characters and the like are visible as normal image when looked from the other side of the printed surface.

Further, the double-sided adhesive tape 274 that was cut is rewound onto the tape spool 181 by a predetermined length, thereby reducing the amount of consumed double-sided adhesive tape 274.

Furthermore, since the double-sided adhesive tape 274 includes the adhesive layer 227 and the release sheet 228, it becomes possible to make up the printing tape 217 from a transparent film only to thus reduce the thickness of the printing tape 217. Accordingly, the cutting force of the cutter unit 14 for cutting the printing tape 217 can be minimized and thereby increasing durability thereof. In addition, the cutting force of the cutter unit 14 for cutting the printing tape 217 can be minimized and therefore the cutter unit 14 can be made of low-cost materials.

While the presently exemplary embodiments have been shown and described, it is to be understood that this disclosure is for the purpose of illustration and that various changes and modifications may be made without departing from the scope of the disclosure as set forth in the appended claims.

What is claimed is:

1. A tape printing apparatus for forming a printed tape having a printing tape with a transparent film and an adhesive layer formed on the transparent film wound around a tape spool connected to a take-up shaft, on the adhesive layer an image or character being printed and a release sheet adhered to the adhesive layer of the printing tape, the tape printing apparatus comprising:

a print head that applies printing onto the adhesive layer of the printing tape;

a first conveying roller that conveys the printing tape; second conveying rollers that convey the printing tape with the release sheet adhered thereto;

a first cutter that cuts the printing tape without the release sheet adhered thereto, the first cutter being arranged between the print head and the second conveying rollers;

a second cutter that cuts the printing tape with the release sheet adhered thereto, the second cutter being arranged downstream of the second conveying rollers in a printing tape-conveying direction;

a release sheet providing mechanism that provides the release sheet onto the printing tape in cooperation with the second conveying rollers; and a control device that controls respective operations of the first conveying roller, the second conveying rollers, the first cutter: the second cutter, the release sheet providing mechanism and the take-up shaft, at least one sensor positioned along a printing tape conveying path for detecting various positions of the printing tape;

wherein the control device is configured to:

operate the first conveying roller to thereby conduct printing and conveyance of the printing tape;

operate, upon detecting that a predetermined front end position of the printing tape has reached the first cutter, the first cutter to thereby cut the printing tape at the predetermined front end position to produce a cut-off printing tape;

operate, upon detecting that the cut-off printing tape has reached the second conveying rollers, the second conveying rollers to thereby convey the cut-off printing tape and the release sheet; and operate, upon detecting that a predetermined rear end position of the cut-off printing tape with the release sheet adhered thereto has reached the second cutter, the second cutter thereby cuts the cut-off printing tape with the release sheet at the predetermined rear end position;

operate the release sheet providing mechanism to thereby reversely convey the release sheet to a grasping position of the second conveying rollers; and operate the take-up shaft to thereby rewind the printing tape around the tape spool.

2. The tape printing apparatus according to claim 1, further comprising:

a drive control mechanism that drives and controls the print head, wherein the drive control mechanism controls the print head so that an image or a character printed on the adhesive layer becoming a printing surface of the printing tape is visible as normal image when the printing tape is looked from a transparent film side of the printing tape.

3. The tape printing apparatus according to claim 1, wherein the adhesive layer exhibits adhesive properties upon being heated, and wherein the second conveying rollers include a heat roller that heats the cut-off printing tape.

4. A tape printing apparatus for forming a printed tape having a printing tape with a base film on which an image or character is printed, the base film being wound around a tape spool connected to a take-up shaft and a release sheet adhered on the base film by an adhesive layer, and an adhesive tape with a transparent or semi-transparent film adhered on the base film of the printing tape by an adhesive layer, the tape printing apparatus comprising:

a print head that applies printing onto the base film of the printing tape;

a first conveying roller that conveys the printing tape;

second conveying rollers that convey the printing tape with the adhesive tape adhered thereto;

a first cutter that cuts the printing tape without the adhesive tape adhered thereto, the first cutter being arranged between the print head and the second conveying rollers;

a second cutter that cuts the printing tape with the adhesive tape adhered thereto, the second cutter being arranged downstream of the second conveying rollers in a printing tape-conveying direction;

an adhesive tape providing mechanism that provides the adhesive tape onto the printing tape in cooperation with the second conveying rollers;

a control device that controls respective operations of the first conveying roller, the second conveying rollers, the first cutter, the second cutter, the adhesive tape providing mechanism and the take-up shaft;

at least one sensors positioned along a printing tape conveying path for detecting various positions of the printing tape;

wherein the control device is configured to:

operate the first conveying roller to thereby conduct printing and conveyance of the printing tape;

operate, upon detecting that a predetermined front end position of the printing tape has reached the first cutter, the first cutter to thereby cut the printing tape at the predetermined front end position to produce a cut-off printing tape;

operate, upon detecting that the cut-off printing tape has reached the second conveying rollers, the second conveying rollers to thereby convey the cut-off printing tape and the adhesive tape;

operate, upon detecting that a predetermined rear end position of the cut-off printing tape with the adhesive tape adhered thereto has reached the second cutter, the second cutter to thereby cut the cut-off printing tape with the adhesive tape at the predetermined rear end position;

operate the adhesive tape providing mechanism to thereby convey the printing tape in a reverse direction with respect to the printing tape conveying direction; and operate the take-up shaft to thereby rewind the printing tape around the tape spool.

5. A tape printing apparatus for forming a printed tape having a printing tape with a transparent film and an adhesive layer formed on the transparent film wound around a tape spool connected to a take-up shaft, on the adhesive layer an image or character being printed and a release sheet adhered to the adhesive layer of the printing tape, the tape printing apparatus comprising:

a print head that applies printing onto the adhesive layer of the printing tape;

a first conveying roller that conveys the printing tape; second conveying rollers that convey the printing tape with the release sheet adhered thereto;

a first cutter that cuts the printing tape without the release sheet adhered thereto, the first cutter being arranged between the print head and the second conveying rollers;

a second cutter that cuts the printing tape with the release sheet adhered thereto, the second cutter being arranged downstream of the second conveying rollers in a printing tape-conveying direction;

a release sheet providing mechanism that provides the release sheet onto the printing tape in cooperation with the second conveying rollers; and a control device that controls respective operations of the first conveying roller, the second conveying rollers, the first cutter, the second cutter, the release sheet providing mechanism and the take-up shaft;

a detection device for detecting predetermined front and rear ends of the printing tape, both ends being detected by calculating a conveyed amount of the printing tape through the control device;

the detection device positioned along a printing tape conveying path for detecting various positions of the printing tape;

wherein the control device is configured to:

operate the first conveying roller to thereby conduct printing and conveyance of the printing tape;

operate, upon detecting that a predetermined front end position of the printing tape has reached the first cutter, the first cutter to thereby cut the printing tape at the predetermined front end position to produce a cut-off printing tape;

operate, upon detecting that the cut-off printing tape has reached the second conveying rollers, the second conveying rollers to thereby convey the cut-off printing tape and the release sheet; and operate, upon detecting that a predetermined rear end position of the printing cut-off tape with the release sheet adhered thereto has reached the second cutter, the second cutter thereby cut the cut-off printing tape with the release sheet at the predetermined rear end position;

operate the release sheet providing mechanism to thereby reversely convey the release sheet to a grasping position of the second conveying rollers; and operate the take-up shaft to thereby rewind the printing tape around the tape spool.

6. A tape printing apparatus for forming a printed tape having a printing tape with a base film on which an image or character is printed, the base film being wound around a tape spool connected to a take-up shaft and a release sheet adhered on the base film by an adhesive layer, and an adhesive tape with a transparent or semi-transparent film adhered on the base film of the printing tape by an adhesive layer, the tape printing apparatus comprising:

a print head that applies printing onto the base film of the printing tape;

a first conveying roller that conveys the printing tape;

second conveying rollers that convey the printing tape with the adhesive tape adhered thereto;

a first cutter that cuts the printing tape without the adhesive tape adhered thereto, the first cutter being arranged between the print head and the second conveying rollers;

a second cutter that cuts the printing tape with the adhesive tape adhered thereto, the second cutter being arranged downstream of the second conveying rollers in a printing tape-conveying direction;

an adhesive tape providing mechanism that provides the adhesive tape onto the printing tape in cooperation with the second conveying rollers;

a control device that controls respective operations of the first conveying roller, the second conveying rollers, the first cutter, the second cutter, the adhesive tape providing mechanism and the take-up shaft;

a detection device for detecting predetermined front and rear ends of the printing tape, both ends being detected by calculating a conveyed amount of the printing tape through the control device;

the detection device positioned along a printing tape conveying path for detecting various positions of the printing tape;

wherein the control device is configured to:

operate the first conveying roller to thereby conduct printing and conveyance of the printing tape;

operate, upon detecting that a predetermined front end position of the printing tape has reached the first cutter, the first cutter to thereby cut the printing tape at the predetermined front end position to produce a cut-off printing tape;

operate, upon detecting that the cut-off printing tape has reached the second conveying rollers, the second conveying rollers to thereby convey the cut-off printing tape and the adhesive tape;

operate, upon detecting that a predetermined rear end position of the cut-off printing tape with the adhesive tape adhered thereto has reached the second cutter, the second cutter to thereby cut the cut-off printing tape with the adhesive tape at the predetermined rear end position;

operate the adhesive tape providing mechanism to thereby convey the printing tape in a reverse direction with respect to the printing tape conveying direction; and operate the take-up shaft to thereby rewind the printing tape around the tape spool.

* * * * *